US010939785B2

(12) United States Patent
Hart et al.

(10) Patent No.: US 10,939,785 B2
(45) **Date of Patent: *Mar. 9, 2021**

(54) BATH TRANSFER CHAIR

(71) Applicant: Andrew J. Hart Enterprises Limited, Woodbridge (CA)

(72) Inventors: Andrew J. Hart, Woodbridge (CA); Peter George Murray, Midland (CA)

(73) Assignee: ANDREW J HART ENTERPRISES LIMITED, Woodbridge (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/529,266

(22) Filed: Aug. 1, 2019

(65) Prior Publication Data

US 2019/0350411 A1 Nov. 21, 2019

Related U.S. Application Data

(63) Continuation-in-part of application No. 15/465,887, filed on Mar. 22, 2017, now Pat. No. 10,368,699.

(51) Int. Cl.

| | |
|---|---|
| ***A47K 3/12*** | (2006.01) |
| ***A61G 7/10*** | (2006.01) |
| ***A61G 5/10*** | (2006.01) |

(52) U.S. Cl.

CPC ..... *A47K 3/122* (2013.01); *A61G 5/1075* (2013.01); *A61G 7/1003* (2013.01); (Continued)

(58) Field of Classification Search

CPC ..... A47K 3/122

(Continued)

(56) References Cited

U.S. PATENT DOCUMENTS

| | | | |
|---|---|---|---|
| 5,036,557 | A | 8/1991 | Fales |
| 5,373,591 | A | 12/1994 | Myers |

(Continued)

FOREIGN PATENT DOCUMENTS

| | | | |
|---|---|---|---|
| CA | 2490450 | C | 3/2010 |
| DE | 19535932 | A1 | 4/1997 |

OTHER PUBLICATIONS

English machine translation of Abstract; German patent publication No. DE19535932.

*Primary Examiner* — Lori L Baker

(74) *Attorney, Agent, or Firm* — Phillip C. Mendes da Costa; Bereskin & Parr LLP/S.E.N.C.R.L., s.r.l.

(57) ABSTRACT

A transfer apparatus for receiving the chair seat of a wheelchair and supporting the chair seat in the base of a washing enclosure. The transfer apparatus has a chair support member including a chair support track section that can be positioned in the washing enclosure base, a bridge portion with a bridge track section that is movably mounted to the chair support member. The transfer apparatus includes a lock system usable to secure the bridge portion in an in-use position and engaged with the wheelchair. A first lock inhibits rotational motion of the bridge portion. The first lock includes a retractable locking member that is biased to an extended, locking position. A second lock is usable to prevent longitudinal separation of the bridge portion and the wheelchair. The first and second lock can be automatically engaged when the bridge portion is moved to the in-use position.

26 Claims, 39 Drawing Sheets

(52) U.S. Cl.
CPC ..... *A61G 7/1034* (2013.01); *A61G 7/1046* (2013.01); *A61G 7/1059* (2013.01)

(58) Field of Classification Search
USPC ..... 4/560.1
See application file for complete search history.

(56) References Cited

U.S. PATENT DOCUMENTS

| | | | | |
|---|---|---|---|---|
| 5,517,704 | A | 5/1996 | Dagostino et al. | |
| D573,861 | S | 7/2008 | Hammer et al. | |
| 7,448,097 | B2 | 11/2008 | Cancian | |
| 7,506,385 | B2 | 3/2009 | Werschmidt | |
| D611,715 | S | 3/2010 | Werschmidt | |
| 7,690,055 | B2 | 4/2010 | Hammer et al. | |
| 10,368,699 | B2 * | 8/2019 | Hart | A61G 7/1034 |
| 2008/0265548 | A1 | 10/2008 | Hammer et al. | |
| 2011/0258771 | A1 | 10/2011 | Hammer et al. | |
| 2012/0013102 | A1 | 1/2012 | Gao | |

* cited by examiner

BATH TRANSFER CHAIR

CROSS-REFERENCE TO RELATED APPLICATION

This application is a continuation-in-part of U.S. application Ser. No. 15/465,887 filed Mar. 22, 2017, the entirety of which is hereby incorporated herein by reference.

FIELD OF THE INVENTION

This disclosure relates generally to an apparatus for transferring a person between a wheelchair and a bathtub or shower enclosure. The apparatus may include one or more of a bridging section which is deployable to provide a continuous track for transfer between a wheelchair and a bathtub or shower enclosure, a blocking mechanism to prevent a chair portion of a wheelchair moving when the bridging section is not secured in place, a bridge locking mechanism to secure the bridging section in place and a position control mechanism for wheelchairs, and more specifically to systems and apparatuses for adjusting the position of a chair seat and/or chair back of a wheelchair.

BACKGROUND

Various types of personal support chairs are known, including manual wheelchairs, automatic wheelchairs, and shower chairs.

Wheelchairs with fixed relationships between the chair seat and chair back are known. Frequently, the chair seat and chair back may be fixed in position and unable to be adjusted easily. Wheelchairs that allow the chair seat or chair back to be adjusted may often move the chair seat and chair back completely independently from one another or move the chair seat and chair back as a fixed unit.

Shower chairs are known that can support individuals while being showered. Transferring a person to a shower can be difficult, particularly when they have limited mobility. Bath transfer apparatuses are known that allow a chair seat to move from a wheelchair to a base in a shower. These bath transfer apparatus typically have multiple components that are assembled to provide the transfer apparatus each time a person needs to be transferred into and out of the shower.

SUMMARY

The following introduction is provided to introduce the reader to the more detailed description to follow and not to limit or define any claimed or as yet unclaimed invention. One or more inventions may reside in any combination or sub-combination of the elements or process steps disclosed in any part of this document including its claims and figures.

In accordance with a first aspect of this disclosure, a tilting mechanism for a chair enables the seat and chair back to recline concurrently (e.g., by use of a single actuator) wherein the chair back may recline at a greater rate than the seat. Concurrent tracking of the chair back and the seat may also reduce or limit the extent to which an individual's center of gravity is shifted as the chair back and chair seat are inclined. This may provide stability to the support chair in which a person is seated.

A track path along which the seat is trackable may be provided. This may allow the seat to transition between an upright sitting position and a reclined position. The chair back may be concurrently trackable as the seat tracks along the track path to allow the chair back to move between a first position when the seat is in the upright sitting position and a second inclined position when the seat is in the reclined position. By having a chair back that tracks between different positions concurrently with the seat, the position of both the seat and chair back may be adjusted simultaneously.

In accordance with the first aspect, there is provided a tilting mechanism for a chair having a seat frame, a seat and a chair back, the tilting mechanism comprising:

(a) a track path along which the seat is trackeable between an upright sitting position and a reclined position whereby an inclination of the seat from a horizontal axis increases as the seat moves from the upright sitting position to the reclined position; and, (b) the chair back is concurrently trackeable as the seat tracks along the track path wherein the chair back is moveable between a first position when the seat is in the upright sitting position and a second inclined position when the seat is in the reclined position whereby an inclination of the chair back from a vertical axis increases as the seat moves from the upright sitting position to the reclined position, whereby the inclination of the chair back increases at a greater rate than the inclination of the seat as the seat moves between the upright sitting position and the reclined position.

In some embodiments, the tilting mechanism may further comprise an actuator operable to enable the seat to move between the upright sitting position and the reclined position and the chair back to move between the first and second positions. A single actuator may allow an operator to easily adjust the position of the seat and chair back. For example, this may allow the operator to actuate the actuator with one hand while guiding the chair back and/or seat to a desired inclination.

In some embodiments, the tilting mechanism may further comprise a locking member that is moveable between a locked position in which the seat and the chair back are secured in position and an unlocked position in which the seat and chair back are moveable upon actuation of the actuator. An operator may actuate the actuator to move the locking member to the unlocked position when the position of the chair back and seat are being adjusted, and then release the actuator the move the locking member to the locked position to secure the desired position of the chair back and seat.

In some embodiments, the tilting mechanism may further comprise a second locking member that is movable between the locked position and the unlocked position upon actuation of the actuator, wherein the first locking member and second locking member are positioned on opposing sides of the chair. The tilting mechanism may include track paths on either side of the seat. The seat may track along each track path as the seat moves from the upright sitting position to the reclined position. Each of these track paths may have a corresponding locking member that is movable between the locked position and the unlocked position. In some embodiments, the actuator may be operable to move both the first locking member and the second locking member between the locked position and the unlocked position upon actuation.

In some embodiments, the locking member may comprise a telescoping cylinder comprising a telescoping rod and a cylinder housing into which the telescoping rod is slideably receivable.

In some embodiments, the seat may be drivingly connected to the chair back whereby tracking of the seat along the track path from the upright sitting position to the reclined position drives the chair back from the first position to the second inclined position.

In some embodiments the seat may be drivingly connected to the chair back, the chair back reclines about a first pivot axis, and the chair back and seat are mechanically coupled at a point offset from the first pivot axis.

In some embodiments, the tilting mechanism may further comprise a telescoping cylinder which is connected to the chair back at a location forward of the first pivot axis. In some embodiments, the telescoping cylinder is moveably mounted to the chair back.

In some embodiments the telescoping cylinder may be moveably mounted to the chair back, the telescoping cylinder comprises a telescoping rod and a cylinder housing into which the telescoping rod is slideably receivable and one of the telescoping rod and the cylinder housing is moveably mounted to the chair back and the other of the telescoping rod and the cylinder housing is mountable to the seat frame. In some such embodiments, the track path may comprise a generally curved track section having a front portion located at a position defining the reclined position of the seat and a rearward portion defining the upright sitting position of the seat, wherein the front portion is at a raised elevation compared to the rearward portion In some embodiments one of the telescoping rod and the cylinder housing may be moveably mounted to the chair back, and the other of the telescoping rod and the cylinder housing may be moveably mountable to the seat frame.

In some embodiments one of the telescoping rod and the cylinder housing may be moveably mounted to the chair back, and the other of the telescoping rod and the cylinder housing is mountable to the track path. In some such embodiments, the track path may comprise a generally curved track section having a front portion located at a position defining the reclined position of the seat and a rearward portion defining the upright sitting position of the seat, wherein the front portion is at a raised elevation compared to the rearward portion.

In some embodiments, the track path may comprise a generally curved track section having a front portion located at a position defining the reclined position of the seat and a rearward portion defining the upright sitting position of the seat, wherein the front portion is at a raised elevation compared to the rearward portion.

In some embodiments, in the reclined position, the seat may be at an angle of 15° from the horizontal axis and a center of gravity of a person seated in the chair translates forward up to 5 inches as the seat moves from the upright sitting position to the reclined position. In some embodiments, in the second inclined position the chair back may be at an angle of about 45° from the vertical axis.

In accordance with this aspect of the disclosure, there is also provided a tiltable chair. The tiltable chair may include a seat frame, a seat and a chair back. The seat frame may include a track path and the seat may be trackable along the track path between an upright sitting position and a reclined position. An inclination of the seat from a vertical axis may increase as the seat moves from the upright sitting position to the reclined position. The chair back may be moveably mounted to the seat frame. The chair back may be trackable as the seat tracks along the track path to move between a first position wherein the seat is in the upright sitting position and a second inclined position wherein the seat is in the reclined position. As a result, an inclination of the chair back from the vertical axis may increase as the seat moves from the upright sitting position to the reclined position. The inclination of the chair back may increase at a greater rate than the inclination of the seat as the seat moves between the upright sitting position and the reclined position.

In accordance with this embodiment, there is provided a tiltable chair comprising:

(a) a seat frame comprising a track path;

(b) a seat trackeable along the track path between an upright sitting position and a reclined position whereby an inclination of the seat from a horizontal axis increases as the seat moves from the upright sitting position to the reclined position; and (c) a chair back moveably mounted to the seat frame, the chair back being concurrently trackeable as the seat tracks along the track path wherein the chair back is moveable between a first position when the seat is in the upright sitting position and a second inclined position when the seat is in the reclined position whereby an inclination of the chair back from a vertical axis increases as the seat moves from the upright sitting position to the reclined position, whereby the inclination of the chair back increases at a greater rate than the inclination of the seat as the seat moves between the upright sitting position and the reclined position.

In some embodiments, the tiltable chair may further comprise an actuator operable to enable the seat to move between the upright sitting position and the reclined position and the chair back to move between the first and second positions.

In some embodiments, the seat may be drivingly connected to the chair back whereby tracking of the seat along the track path from the upright sitting position to the reclined position drives the chair back from the first position to the second inclined position.

In some embodiments, the chair back may recline about a first pivot axis, and the chair back and seat are mechanically coupled at a point offset from the first pivot axis.

In some embodiments, the tiltable chair may further comprise a telescoping cylinder wherein a first portion of the telescoping cylinder is moveably mounted to the chair back at a location forward of the first pivot axis and a second portion of the telescoping cylinder is moveably mounted to the seat frame.

In some embodiments, the telescoping cylinder may comprise a telescoping rod and a cylinder housing into which the telescoping rod is slideably receivable and one of the telescoping rod and the cylinder housing is moveably mounted to the chair back and the other of the telescoping rod and the cylinder housing is mounted to the seat frame.

In some embodiments, the track path may comprise a generally curved track section having a front portion located at a position defining the reclined position of the seat and a rearward portion defining the upright sitting position of the seat, wherein the front portion is at a raised elevation compared to the rearward portion.

In accordance with another aspect of this disclosure, a transfer apparatus to transfer a chair portion of a wheelchair between a base of the wheelchair and a chair support member, which may be selectively located in a bathtub or shower when required, comprises a bridge portion that is provided with the chair support member and is deployable from a storage position in which it is attached to the chair support member. An advantage of this design is that the bridge portion may be stored as part of the chair support member. As a result, the bridge portion cannot be lost during storage of the chair support member as it is part thereof.

In accordance with another aspect of this disclosure, there is provided a transfer apparatus for receiving a chair seat of a wheelchair and supporting the chair seat in a base of a washing enclosure, the transfer apparatus comprising:

(a) a chair support member positionable in the base, the chair support member having an upper end having a chair support track section; and, (b) a bridge portion having a bridge track section, the bridge portion movably mounted to the chair support member and operable between a storage position and an in-use position in which the bridge portion is engaged with the wheelchair and the bridge track section is aligned with the chair support track section, whereby the chair seat is translatable along the bridge track section to the chair support track section when the bridge portion is in the in-use position and engaged with the wheelchair.

In some embodiments, the bridge portion may be pivotally mounted to the chair support member.

In some embodiments, in the storage position, the bridge portion may overlie the chair support member.

In some embodiments the bridge portion may be pivotally mounted to the chair support member and, in the storage position, the bridge portion may overly the chair support member.

In some embodiments, in the storage position, the bridge portion may be positioned on the upper end of the chair support member.

In some embodiments, the bridge portion may further comprise a chair engagement member that is mateable with a corresponding bridge engagement member provided on the wheelchair.

In some embodiments, the chair engagement member may be lockably engageable to the bridge engagement member.

In some embodiments, the bridge portion may have an inner end moveably mounted to the chair support member and an outer end spaced from the inner end and the chair engagement member may be provided on the outer end.

In some embodiments, the bridge engagement member may include a blocking member that is moveable between a raised position in which the blocking member is raised preventing the chair seat from translating along the bridge track section when the chair seat is on the wheelchair and a lowered position in which the blocking member is recessed enabling the chair seat to translate along the bridge track section; and the blocking member is moved to the lowered position when the chair engagement member mates with the bridge engagement member.

In some embodiments, the blocking member may be biased to the raised position.

In some embodiments, the transfer apparatus may further comprise a locking member lockably securing the bridge portion to the wheelchair wherein, when the bridge portion is in the in-use position and the locking member is in a locked position, the locking member may be recessed whereby the chair seat is translatable along the bridge track section to the chair support track section without engaging the locking member.

In some embodiments, the bridge portion may have an inner end moveably mounted to the chair support member and an outer end spaced from the inner end and the locking member is provided on the outer end.

In some embodiments, the transfer apparatus may further comprise a locking member lockably securing the bridge portion to the wheelchair wherein, when the bridge portion is in the in-use position and the locking member is in a locked position, the locking member may be automatically moved to an unlocked position when the chair seat is translated from the bridge track section to the wheelchair.

In some embodiments, the transfer apparatus may further comprise a locking member, wherein as the bridge portion is moved to the in-use position and engaged with the wheelchair, the locking member may be automatically locked whereby the bridge portion is secured to the wheelchair.

In some embodiments, the transfer apparatus may further comprise a blocking member, wherein as the bridge portion is moved to the in-use position and engaged with the wheelchair, the blocking member may be automatically recessed whereby the chair seat is translatable along the bridge track section.

In accordance with this aspect of the disclosure, there is also provided a transfer apparatus comprising:

(a) a wheelchair comprising a chair seat translatable on a wheelchair track section of a wheelchair base;

(b) a chair support member positionable in a base of a washing enclosure, the chair support member having an upper end having a chair support track section; and, (c) a bridge portion having a bridge track section, the bridge portion movably mounted to the chair support member and operable between a storage position and an in-use position in which the bridge portion is engaged with the wheelchair and the bridge track section is aligned with both the chair support track section and the wheelchair track section, whereby the chair seat is translatable from the wheelchair base along the bridge track section to the chair support track section when the bridge portion is in the in-use position and engaged with the wheelchair.

In some embodiments, the bridge portion may be pivotally mounted to the chair support member.

In some embodiments, in the storage position, the bridge portion may overlie the chair support member.

In some embodiments the bridge portion may further comprise a chair engagement member that is mateable with a corresponding bridge engagement member provided on the wheelchair.

In some embodiments, the chair engagement member may be lockably engageable to the bridge engagement member.

In some embodiments, the bridge portion may have an inner end moveably mounted to the chair support member and an outer end spaced from the inner end and the chair engagement member may be provided on the outer end.

In some embodiments, the bridge engagement member may include a blocking member and the blocking member may be moveable between a raised position preventing the chair seat from translating between the wheelchair track section and the bridge track section and a lowered position in which the blocking member is recessed enabling the chair seat to translate along the bridge track section.

In some embodiments, the blocking member may be moved from the raised position to the lowered position when the chair engagement member mates with the bridge engagement member.

In some embodiments, the blocking member may be biased to the raised position.

In some embodiments, the transfer apparatus may further comprise a locking member lockably securing the bridge portion to the wheelchair wherein, when the bridge portion is in the in-use position and the locking member is in a locked position, the locking member is recessed whereby the chair seat is translatable from the wheelchair along the bridge track section to the chair support track section without engaging the locking member.

In some embodiments, the bridge portion may have an inner end moveably mounted to the chair support member and an outer end spaced from the inner end and the locking member is provided on the outer end.

In some embodiments, the transfer apparatus may further comprise a locking member lockably securing the bridge portion to the wheelchair wherein, when the bridge portion is in the in-use position and the locking member is in a locked position, the locking member may be automatically moved to an unlocked position when the chair seat is translated from the bridge track section to the wheelchair.

In some embodiments, the transfer apparatus may further comprise a blocking member, wherein as the bridge portion is moved to the in-use position and engaged with the wheelchair, the blocking member is automatically recessed whereby the chair seat is translatable along the bridge track section.

In accordance with another aspect of this disclosure, a transfer apparatus to transfer a chair portion of a wheelchair between from a base of the wheelchair to a chair support member, which may be selectively located in a bathtub or shower when required, includes a bridge portion that is provided with the chair support member and is deployable from a detached position in which it is attached to the chair support member. The transfer apparatus includes a locking system with a retractable locking member provided on the bridge portion that is receivable by a recess provided on the wheelchair. The locking system inhibits rotational motion of the bridge portion to the detached position when the locking member and recess are engaged. The locking member is biased to its extended, locked, position by a biasing member. An advantage of this design is that the bridge portion may be easily attached to the wheelchair without a user having to manually engage the locking system. As a result, securing the bridge portion to the wheelchair may be simplified.

In accordance with this aspect of the disclosure, there is provided a transfer apparatus comprising:

a) a wheelchair comprising a chair seat translatable on a wheelchair track section of a wheelchair base, wherein the wheelchair track section extends in a longitudinal direction between a first section end and a second section end;

b) a chair support member positionable in a base of a washing enclosure, the chair support member having a chair support track section;

c) a bridge portion having a bridge track section that extends in a longitudinal direction between a third section end and a fourth section end, wherein the bridge portion is rotatably mounted to the chair support member for movement between a detached position and an in-use position, wherein in the in-use position the bridge portion is engaged with the wheelchair, the second section end is aligned with the third section end and the bridge track section is aligned with the chair support track section, whereby the chair seat is translatable from the wheelchair base along the bridge track section to the chair support track section when the bridge portion is in the in-use position and engaged with the wheelchair; and d) a first lock that is adjustable between a locked position and an unlocked position, the first lock comprising a retractable locking member provided on the bridge portion and operable between an extended position and a retracted position, a receiving recess provided on the wheelchair and shaped to receive the retractable locking member, and a biasing member that biases the retractable locking member to the extended position, wherein when the bridge portion is in the in-use position and engaged with the wheelchair and the first lock is in the locked position, the retractable locking member is positioned in the extended position and positioned in the recess whereby the first lock inhibits rotational motion of the bridge portion to the detached position.

In some embodiments, when the bridge portion is moved to the in-use position and engaged with the wheelchair, the first lock may be automatically adjusted to the locked position whereby the rotational motion of the bridge portion is automatically inhibited.

In some embodiments, when the retractable locking member is in the retracted position the retractable locking member may be moved relative to the extended position in the longitudinal direction towards the fourth section end; and as the bridge portion is moved from the detached position to the in-use position, the retractable locking member may initially engage the wheelchair and be driven from the extended position towards the retracted position by engagement with the wheelchair, and subsequently upon the retractable locking member aligning with the receiving recess, the biasing member may automatically extend the retractable locking member into the receiving recess.

In some embodiments, the retractable locking member may be movably mounted to the bridge track section for movement in the longitudinal direction between the extended position and the retracted position.

In some embodiments, a mounting unit may movably mounts the retractable locking member to the bridge track section, the mounting unit may include: a mounting slot that extends in the longitudinal direction; a support member that is received within the mounting slot; where the mounting slot defines a longitudinal translation path for the support member, and the support member moves along the longitudinal translation path as the retractable locking member moves between the extended position and the retracted position.

In some embodiments, the mounting unit may include a housing; the slot may be defined by the housing; the support member is fixed to the bridge track section; and the biasing member is enclosed within the housing and biased against the support member thereby biasing the retractable locking member to the extended position.

In some embodiments, the transfer apparatus may include a second lock, the second lock including a first engagement member provided on the wheelchair and a second engagement member provided on the bridge portion, where the first and second engagement members are lockingly engageable when the bridge portion is in the in-use position where, when the first and second engagement members are lockingly engaged, the first and second engagement members inhibit separation of the bridge portion and the wheelchair in the longitudinal direction.

In some embodiments, the first engagement member may include a slot; and the second engagement member may include a second locking member that is rotatably receivable in the slot.

In some embodiments, a release member may be operable to adjust the lock from the locked position to the unlocked position, where the release member is manually operated.

In some embodiments, the release member may be operable to transition the retractable locking member from the extended position to the retracted position; and when the retractable locking member is in the retracted position, the release member may be operable to move the bridge portion to the detached position.

In some embodiments, a release member may be rotationally drivingly connected to the retractable locking member, the release member may be rotatable between a locked position in which the retractable locking member is in the extended position and an unlocked position in which the retractable locking member is in the retracted position, where the release member is manually operated.

In some embodiments, the release member may include a handle usable to move the bridge portion between the detached position and the in-use position.

In some embodiments, the wheelchair track section may include first and second parallel wheelchair track elements; the bridge track section may include first and second parallel bridge track elements, where the first parallel bridge track element aligns with the first parallel wheelchair track element and defines a first pair of combined track elements and the second parallel bridge track element aligns with the second parallel wheelchair track element and defines a second pair of combined track elements; where the first lock comprises a first lock unit that is configured to secure the first pair of combined track elements, and a second lock unit that is configured to secure the second pair of combined track elements.

In some embodiments, a release member may be operable to concurrently unlock the first lock unit and the second lock unit.

In accordance with this aspect of this disclosure, the locking system may include a first lock that inhibits rotational motion of the bridge portion to the detached position and a second lock that inhibits separation of the bridge portion and the wheelchair in the longitudinal direction.

In accordance with this aspect of the disclosure, there is provided a transfer apparatus for a chair seat of a wheelchair, the transfer apparatus comprising:

a) a wheelchair comprising a chair seat translatable on a wheelchair track section of a wheelchair base, wherein the wheelchair track section extends in a longitudinal direction between a first section end and a second section end;

b) a chair support member positionable in a base of a washing enclosure, the chair support member having a chair support track section;

c) a bridge portion having a bridge track section that extends in a longitudinal direction between a third section end and a fourth section end, wherein the bridge portion is rotatably mounted to the chair support member for movement between a detached position and an in-use position, wherein in the in-use position the bridge portion is engaged with the wheelchair, the second section end is aligned with the third section end and the bridge track section is aligned with the chair support track section, whereby the chair seat is translatable from the wheelchair base along the bridge track section to the chair support track section when the bridge portion is in the in-use position and engaged with the wheelchair;

d) a first lock that is adjustable between a locked position and an unlocked position, wherein, in the locked position, the first lock inhibits rotational motion of the bridge portion to the detached position; and, e) a second lock that is adjustable between a locked position and an unlocked position, wherein, in the locked position, the second lock inhibits separation of the bridge portion and the wheelchair in the longitudinal direction.

In some embodiments, when the bridge portion is moved to the in-use position and engaged with the wheelchair, the first lock may be automatically adjusted to the locked position and the second lock may be automatically adjusted to the locked position, whereby the bridge portion is secured to the wheelchair.

In some embodiments, the first lock may include: a retractable locking member provided on the bridge portion and operable between an extended position and a retracted position; a receiving recess provided on the wheelchair, where the receiving recess is shaped to receive the retractable locking member; and when the bridge portion is in the in-use position and engaged with the wheelchair and the first lock is in the locked position, the retractable locking member may be positioned in the extended position and positioned in the recess whereby the first lock inhibits rotational motion of the bridge portion to the detached position.

In some embodiments, the first lock may include a biasing member that biases the retractable locking member to the extended position.

In some embodiments, when the retractable locking member is in the retracted position the retractable locking member may be moved relative to the extended position in the longitudinal direction towards the fourth section end; and as the bridge portion is moved from the detached position to the in-use position, the retractable locking member may initially engage the wheelchair and be driven from the extended position towards the retracted position by engagement with the wheelchair, and subsequently upon the retractable locking member aligning with the receiving recess, the biasing member may automatically extend the retractable locking member into the receiving recess.

In some embodiments, the retractable locking member may be movably mounted to the bridge track section for movement in the longitudinal direction between the extended position and the retracted position.

In some embodiments, the second lock may include a first engagement member provided on the wheelchair and a second engagement member provided on the bridge portion, where the first and second engagement members are lockingly engageable when the bridge portion is in the in-use position where, when the first and second engagement members are lockingly engaged, the first and second engagement members inhibit separation of the bridge portion and the wheelchair in the longitudinal direction.

In some embodiments, the first engagement member may include a slot; and the second engagement member may include a second locking member that is rotatably receivable in the slot.

In some embodiments, a release member may be operable to adjust the first lock from the locked position to the unlocked position, where the release member is manually operated.

In some embodiments, the release member may be operable to transition the retractable locking member from the extended position to the retracted position; and when the retractable locking member is in the retracted position, the release member may be operable to move the bridge portion to the detached position.

In some embodiments, a release member may be rotationally drivingly connected to the retractable locking member, the release member may be rotatable between a locked position in which the retractable locking member is in the extended position and an unlocked position in which the retractable locking member is in the retracted position, where the release member is manually operated.

In some embodiments, the release member may include a handle usable to move the bridge portion between the detached position and the in-use position.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which:

FIG. 10 is a side partial perspective view of the wheelchair of FIG. 1B showing the coupling between the actuator and a locking member of the tilting mechanism in accordance with one embodiment;

Figure 1A:
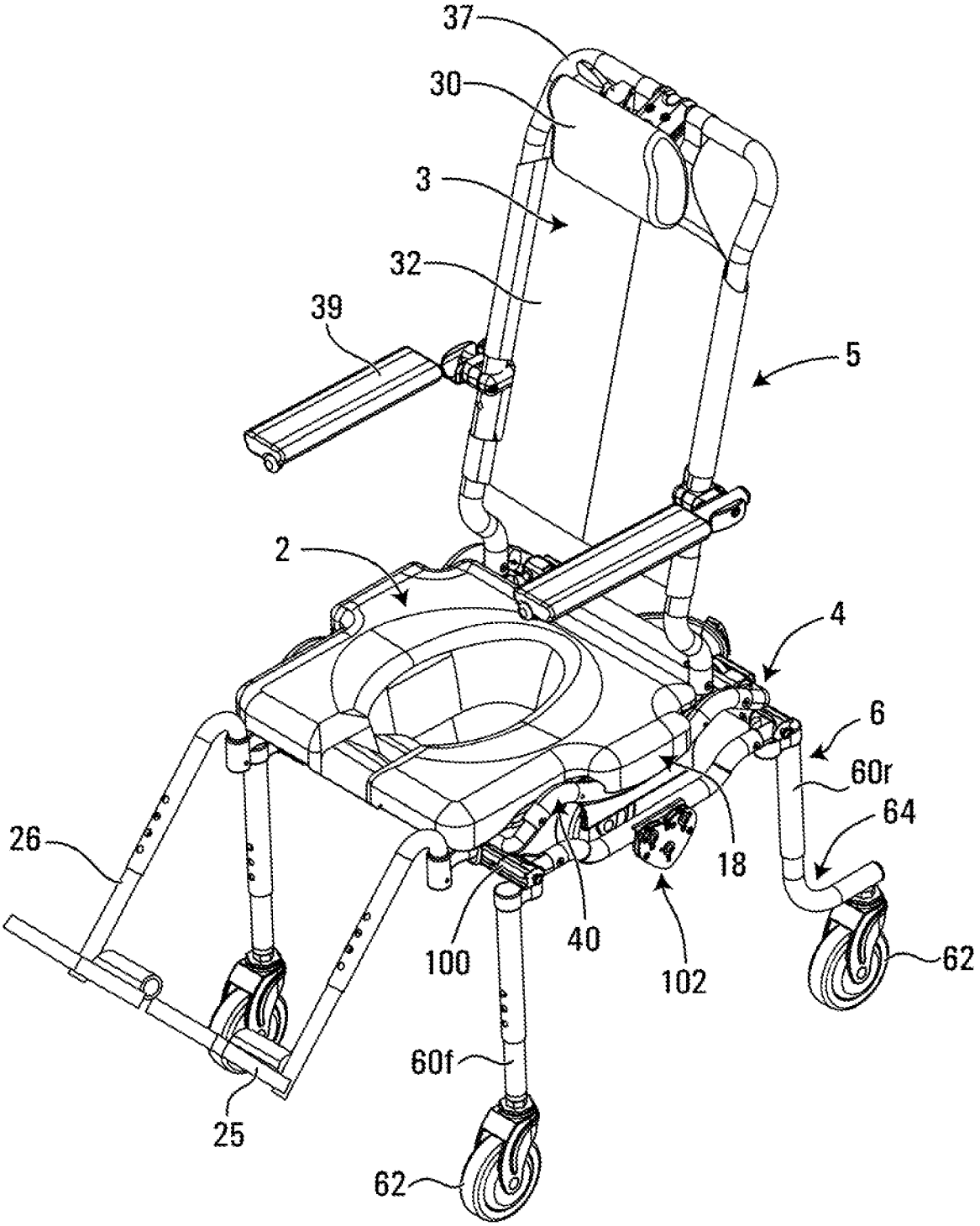
FIG. 1A is a perspective view of a wheelchair having a tiltable chair seat and chair back in an upright position in accordance with one embodiment.
Figure 1B:
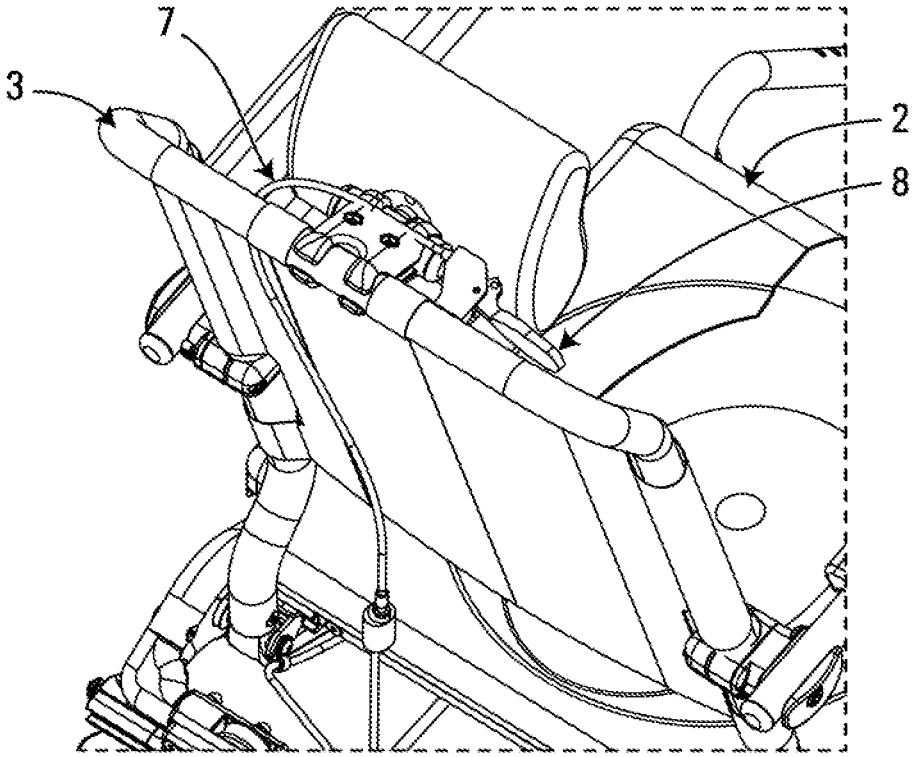
FIG. 1B is a partial perspective view from above of a wheelchair having a tiltable chair seat and chair back showing an actuator for a tilting mechanism in accordance with one embodiment.
Figure 1C:
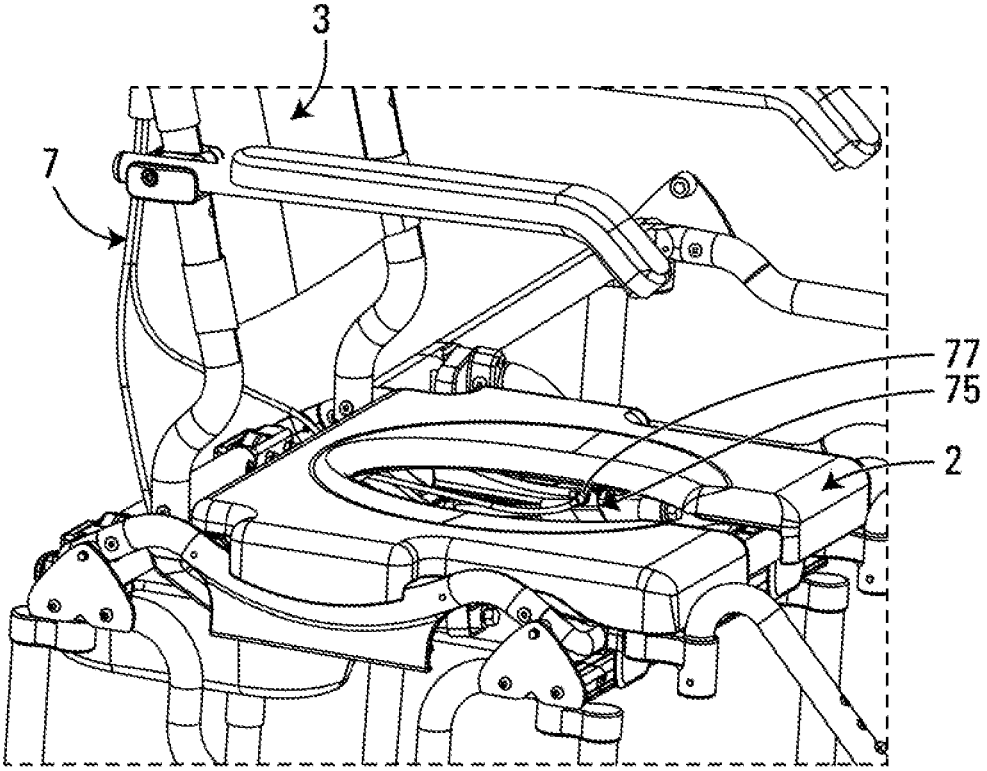
Figure 2:
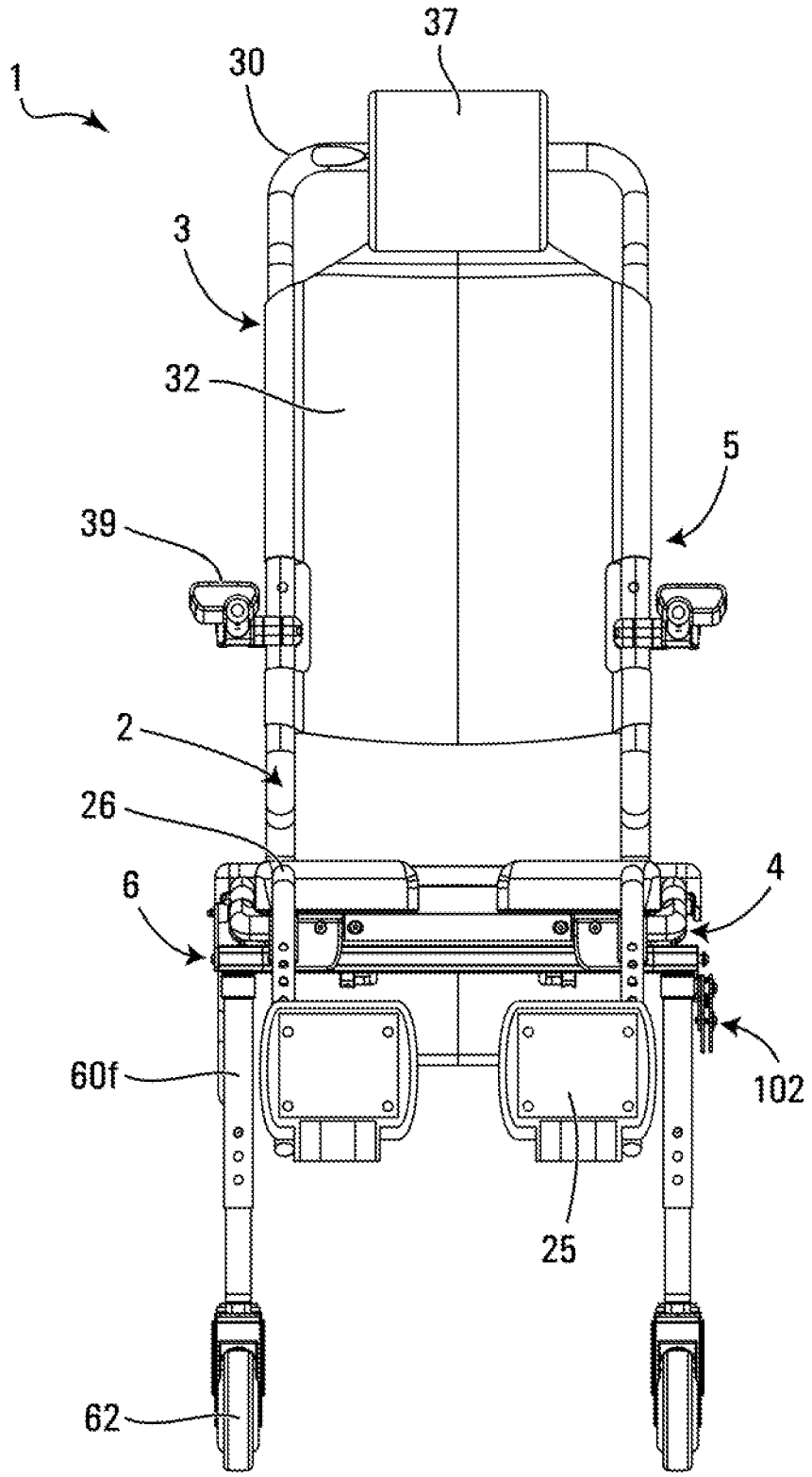
FIG. 2 is a front view of the wheelchair of FIG. 1 with the chair seat and chair back in the upright position.
Figure 3:
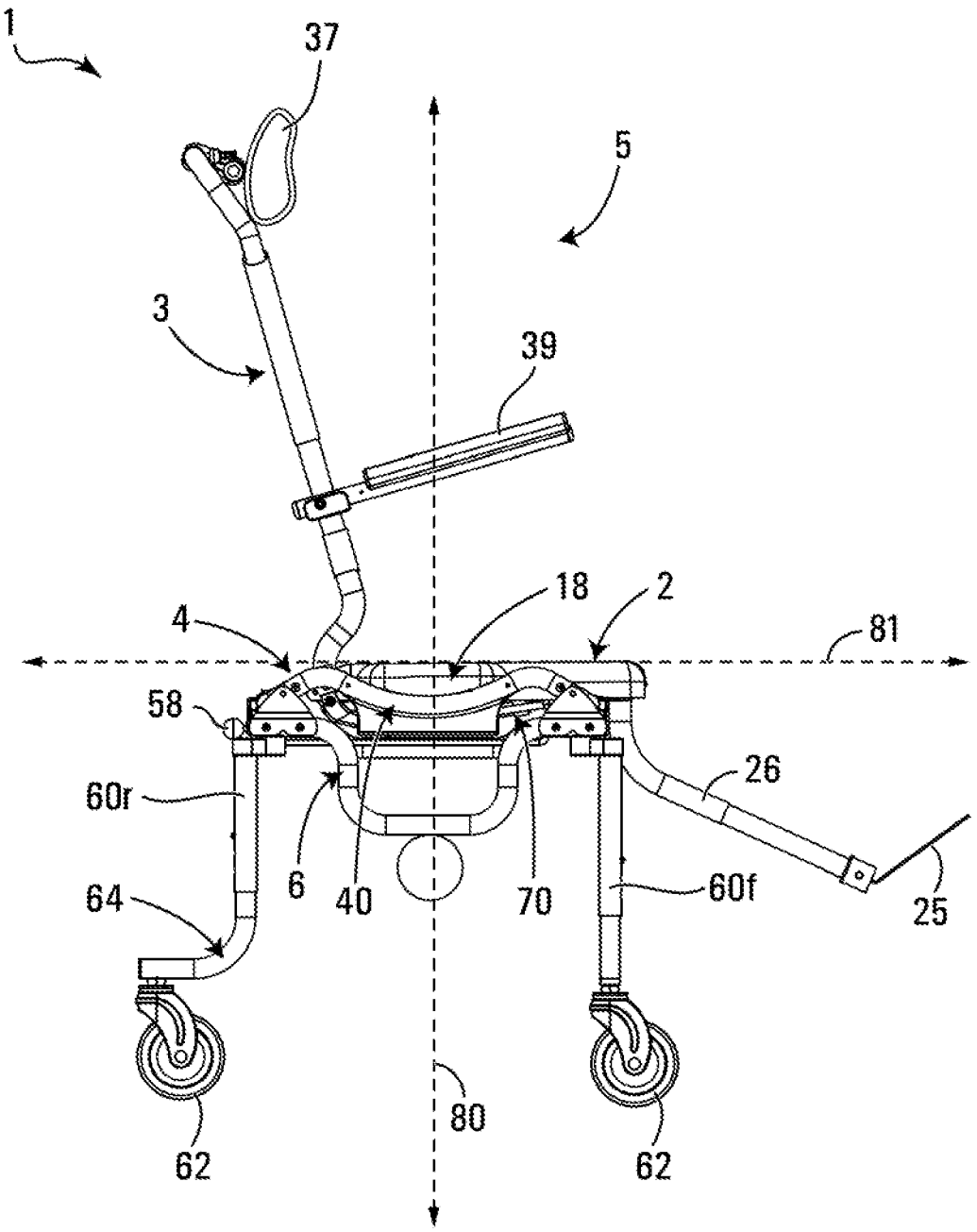
FIG. 3 is a side view of the wheelchair of FIG. 1 with the chair seat and chair back in the upright position.

The drawings included herewith are for illustrating various examples of articles, methods, and apparatuses of the teaching of the present specification and are not intended to limit the scope of what is taught in any way.

DESCRIPTION OF EXAMPLE EMBODIMENTS

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising," and variations thereof mean "including but not limited to," unless expressly specified otherwise. A listing of items does not imply that any or all of the items are mutually exclusive, unless expressly specified otherwise. The terms "a," "an," and "the" mean "one or more," unless expressly specified otherwise.

The terms "front", "rear", "left" and "right" are generally described herein from the perspective of a person seated in a chair seat.

In the examples discussed herein, a tilting mechanism used to adjust the position of a chair seat and chair back may be associated with any suitable type of support chair, such as a wheelchair, bathing support chair or other chair for supporting a person who may have reduced or limited mobility such as an elderly, injured or disabled person. Similarly, a transfer apparatus described in examples herein may be associated with any suitable type of support chair such as a wheelchair or bathing support chair.

General Description of a Support Chair

The following is a general description of a support chair which may be used with any one or more aspects of this disclosure.

Referring to FIGS. 1-13, wheelchair 1 comprises a support chair 5 and a wheelchair base 6. The support chair 5 comprises a chair seat 2, chair back 3 and seat frame 4. The support chair 5 and wheelchair base 6 may be used to support a person requiring assistance with personal mobility or functions.

In examples described herein, the wheelchair 1 may assist with the bathing of elderly, injured or disabled individuals by facilitating the transfer of such individuals into and out of washing enclosures. Accordingly, in such embodiments as exemplified herein, the support chair 5 is moveable away from (e.g., laterally translatable with respect to) the wheelchair base 6 to a support provided in a washing location (e.g., a shower or a bathtub) so that wheelchair 1 may not only be used to move a person, but to also assist a person in performing various activities such as showering and/or bathing.

Alternatively, or additionally, in examples described herein the support chair 5 may include a tilting mechanism that may assist with bathing or other activities such as getting dressed or getting a haircut by allowing the inclination of the chair seat 2 and chair back 3 to be concurrently adjusted. In some examples, such a tilting mechanism may also allow different rates of adjustment for the chair seat 2 and chair back 3.

It will also be appreciated that, in some other embodiments, the wheelchair may not be used to assist a person to shower and, in such embodiments, the wheelchair 1 may only use the reclining feature disclosed herein. In such alternate embodiments, the support chair need not be moveable away from the wheelchair base 6 but may be of a standard design.

Figure 11:
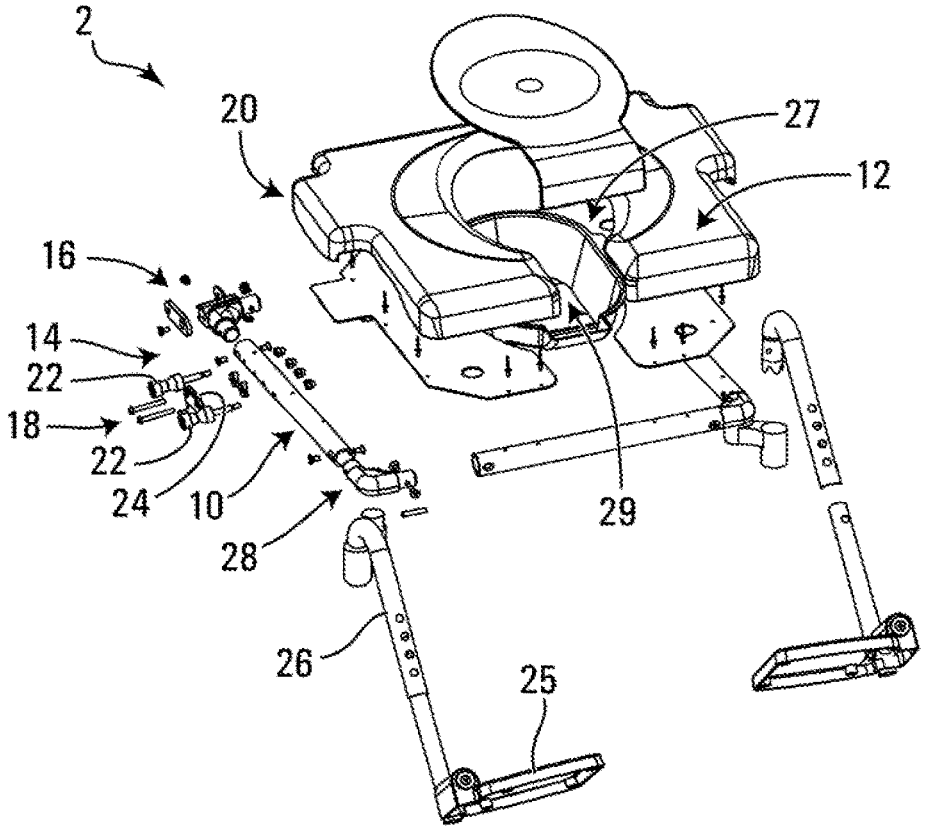
FIG. 11 is an exploded perspective view of an example chair seat for the wheelchair of FIG. 1 in accordance with one embodiment.

The chair seat 2 may include multiple components such as chair base 10 and seat portion 12. The chair base 10 and seat portion 12 may be manufactured separately and then assembled (as illustrated by FIG. 11). Alternatively, the chair base 10 and seat portion 12 may be manufactured as single piece.

The seat portion 12 may provide a sitting surface for a person using support chair 5. If the support chair 5 is not used to assist in bathing or showering, then, for example, a seat cushion or the like may be provided (e.g., removably mounted to, fixed to, etc.) on seat portion 12 (not shown). In such an embodiment, any seat cushion known in the seating arts may be so used. The sitting surface of seat portion 12 may be manufactured of various materials including plastic and/or fabric upholstery. The sitting surface may include an anti-microbial treatment. This may reduce or prevent the spread of bacteria between users and other operators of chair 1. For example, the sitting surface may include a padded upholstery surface with an anti-microbial treatment.

The chair base 10 may provide structural support for the seat portion 12. In general, the chair base 10 and seat portion 12 are fixed to one another. The chair base 10 may provide mounting components for connecting the chair seat 2 to other components of the support chair 5 and/or wheelchair base 6.

Optionally, the support chair may include leg rests 26. Any leg rests known in the wheelchair art may be used and may be provided at any location on wheelchair 1. The leg rests may be fixed to wheelchair 1 or may be removably mounted thereto. As exemplified, the front portion 28 of the chair base 10 may include leg rest mounts that receive the leg rests 26. The leg rests 26 can then be removably mounted to the support chair by the leg rest mounts. Alternatively, leg rests 26 may be fixedly mounted to the support chair 5.

In different embodiments, the leg rests 26 may be mounted to the chair base 10, seat frame 4 or wheelchair base 6. The leg rests 26 may be movably mounted to the support chair 5. In such embodiments, the leg rests 26 may be adjusted to facilitate operation of the support chair 5, to facilitate getting into and out of the support chair 5, or for comfort.

In some embodiments, the leg rests 26 may also include foot rests 25. In such embodiments, any foot rests known in the wheelchair arts may be used. In some examples, the foot rests 25 may be movably mounted (e.g. pivotally) to the leg rests 26. Alternatively, the foot rests 25 may be fixed in position with respect to the leg rests 26.

In some embodiments, the chair seat 2 may include a seat opening 27 as shown in FIGS. 1A and 11. The seat opening 27 allows a person seated in the support chair 5 to relieve themselves while seated on chair seat 2. For example, the support chair 5 may provide a support (e.g., a support surface) for receiving a bedpan 29 below the opening 27. The bedpan 29 can be aligned below the seat opening 27 to receive waste from a person seated on chair seat 2. Any bedpan known to a person skilled in the bedpan arts can be used for bedpan 29. In different examples, the bedpan 29 may be supported by the chair seat 2, seat frame 4 and/or wheelchair base 6. In other embodiments, the seat opening 27 and/or bedpan 29 may be omitted.

Figure 12:
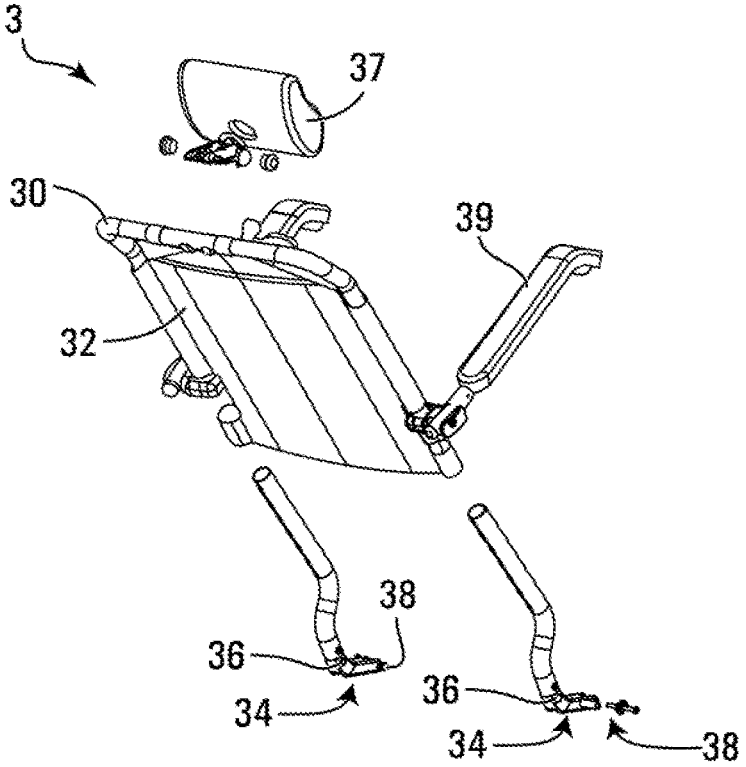
FIG. 12 is an exploded perspective view of an example chair back for the wheelchair of FIG. 1 in accordance with one embodiment.
Figure 13:
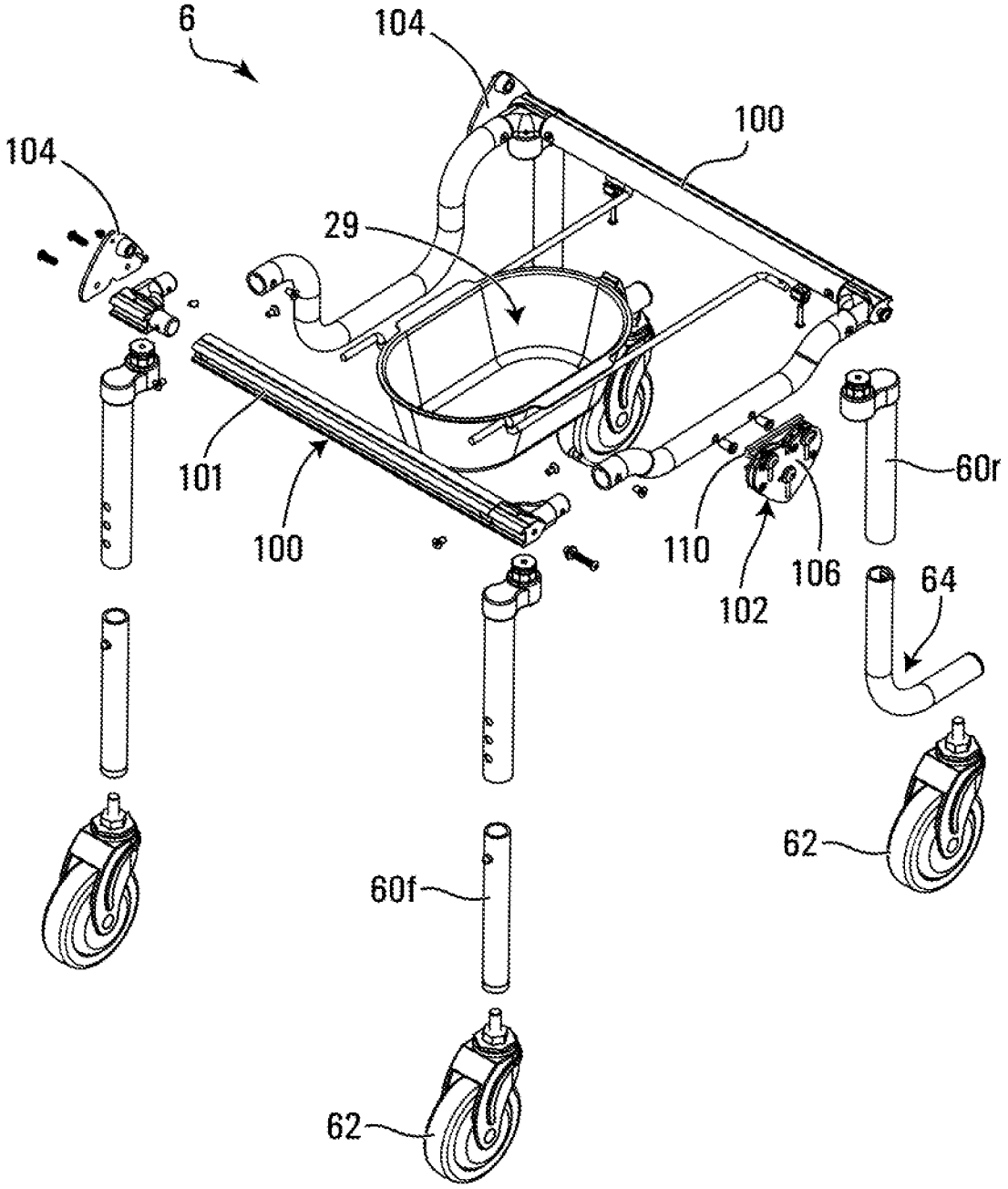
FIG. 13 is an exploded perspective view of a wheelchair base in accordance with one embodiment.

The chair back 3 supports the upper body of a person seated in the support chair 5. In some embodiments, the chair back 3 may include a chair back frame 30 and chair back rest 32 as shown in FIG. 12. The chair back frame 30 and chair back rest 32 may be separately manufactured and then assembled as chair back 3. Alternatively, an integral chair back 3 may be used.

The chair back frame 30 may be manufactured of various metals such as steel or aluminum. Alternatively, the chair back frame 30 may be manufactured using plastics or other suitable materials known in the seating arts. The chair back rest 32 may manufactured of various materials including plastics and/or fabric upholstery or other suitable materials known in the seating arts. The chair back rest 32 may also include an anti-microbial treatment on its surface.

If the support chair 5 is not used to assist in bathing or showering, then, for example, a backrest cushion or the like may be provided (e.g., removably mounted to, fixed to, etc.) on the chair back 3 (not shown). In such an embodiment, any seat cushion known in the seating arts may be so used.

In some embodiments, the chair back 3 may include arm rests 39 as exemplified in FIGS. 1A and 12. The arm rests 39 support the arms of a person seated in support chair 5. In such embodiments, any arm rests known in the wheelchair arts may be so used. The arm rests 39 may be movably connected to the support chair. For example, the arm rests 39 may be pivotally connected to the chair back 3. The arm rests 39 may then be adjusted for comfort, to facilitate operation of the support chair 5, and/or to facilitate getting into and out of the support chair 5. Alternatively, the arm rests 39 may be secured relative to the chair back 3. Additionally or alternatively, the arm rests 39 may be detachably attached to chair back 3.

In some embodiments, the chair back 3 may include a head rest 37 as shown in FIGS. 1A and 12. The head rest 37 supports the head of a person seated in wheelchair 1. In some examples, the head rest 37 may be cushioned. For example, if the support chair 5 is not used to assist in bathing or showering then head rest 37 may include a fabric cushion or the like.

In some examples, the head rest 37 may be movably connected to the support chair. For example, the head rest 37 may be pivotally connected to the chair back 3. This can allow the position of the head rest 37 to be adjusted. Alternatively, the heat rest 37 may be fixed in place.

In some examples, the head rest 37 may be detachable from the support chair. For example, if the support chair 5 is used to assist in bathing or showering, the head rest 37 may be removed to facilitate showering. Alternatively, the head rest 37 may not be removable from the support chair 5. In general, any head rest known in the seating arts may be used for head rest 37. Alternatively, head rest 37 may be omitted in some examples.

The seat frame 4 supports the chair seat 2 and chair back 3. The seat frame 4 connects or mounts the chair seat 2 and chair back 3 to other components of a wheelchair or bath transfer apparatus, such as wheelchair base 6 or chair support member 150.

In some embodiments, the chair seat 2, chair back 3 and seat frame 4 may be provided as a unitary support chair 5. For example, in embodiments where the support chair 5 does not recline (or where the chair seat 2 and chair back 3 recline at the same rate), the chair seat 2, chair back 3 and seat frame 4 may be integral. Alternatively, the chair seat 2, chair back 3 and seat frame 4 may be manufactured separately and attached to form the support chair 5.

Figure 14:
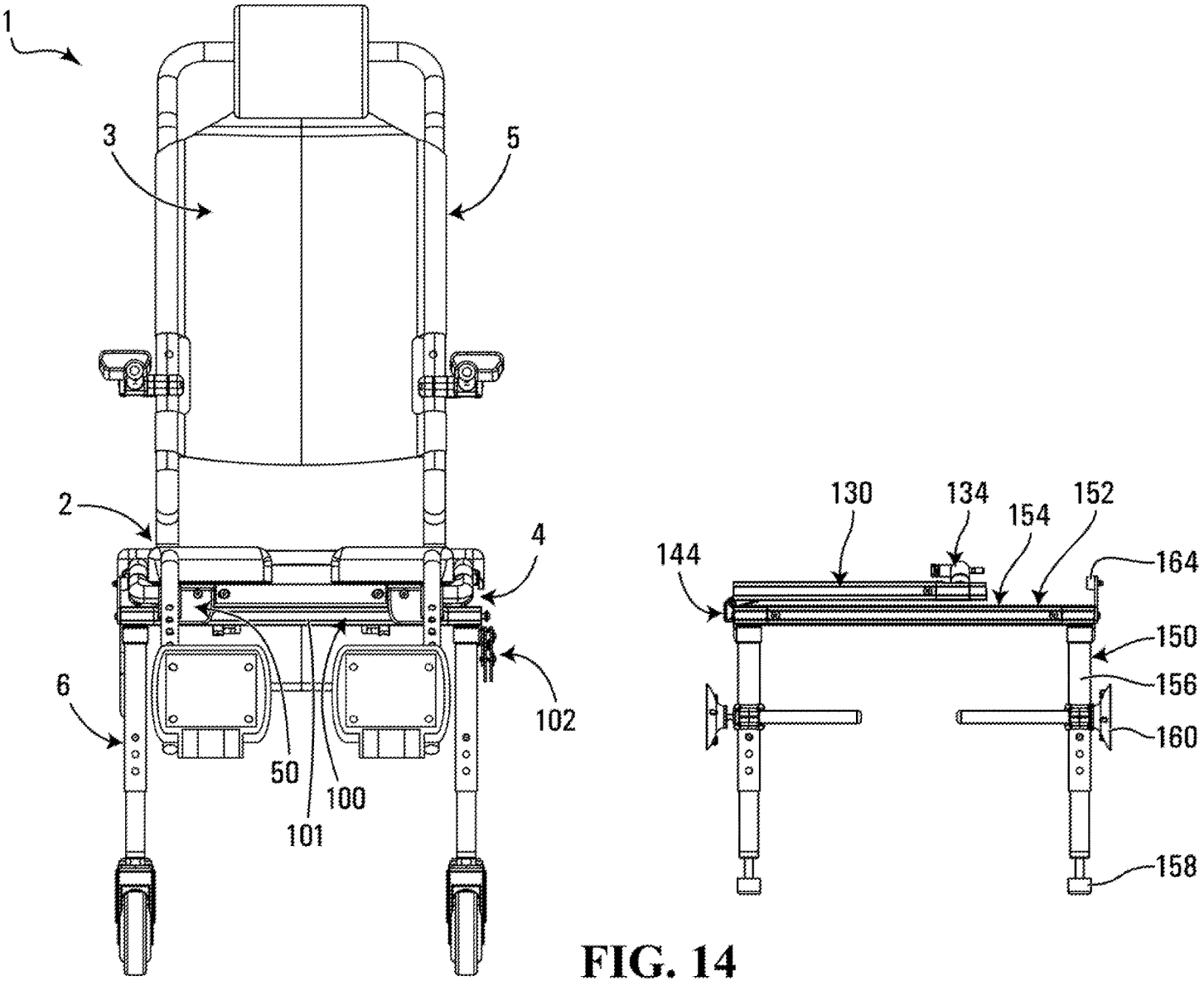
FIG. 14 is a front view of a wheelchair and a chair support member and bridge portion member of a bath transfer apparatus with the bridge portion member in a storage position in accordance with one embodiment.

The seat frame 4 can be mounted to wheelchair base 6 as exemplified in FIGS. 1A and 14 for example. In examples where the wheelchair 1 is used to assist with bathing or showering, the seat frame 4 can be moveably mounted to the wheelchair base to allow the support chair 5 to move away from (e.g., laterally translatable with respect to) the wheelchair base 6. Alternatively, in some other embodiments where the wheelchair 1 is not be used to assist a person to shower, the seat frame 4 may be fixed to the wheelchair base 6.

The wheelchair base 6 may be of any design known in the wheelchair arts. As exemplified, wheelchair base 6 includes front legs 60*f* and rear legs 60*r*. Each of the legs 60 has a corresponding wheel 62. When the support chair 5 is mounted on the wheelchair base 6, the support chair 5 can be maneuvered by rolling the wheelchair base 6 using wheels 62. As a skilled reader will appreciated, the wheels 62 may be implemented using any wheels known in the wheelchair arts.

In some examples, the wheels 62 may include locking mechanisms to prevent the wheels 62 from rolling. The locking mechanisms may be used to maintained the wheelchair 1 in a fixed position, for instance to align the wheelchair 1 with a bath transfer apparatus. Alternatively, locking mechanisms may be omitted.

In the example illustrated by FIGS. 1A and 14, the wheelchair base 6 may be moved manually. Alternatively, a wheelchair 1 may include motorized controls to facilitate movement of the wheelchair 1 e.g. by a person seated in chair seat 2. Any suitable manual or motorized controls configuration known in the wheelchair arts can be used to control movement of the wheelchair base 6.

In the example shown in FIG. 1A, the rear legs 60*r* are curved to position the rear wheels rearwardly of the seat. The curved portion 64 of the rear legs 60*r* may provide additional stability to the wheelchair 1, for example if the chair seat 2 and chair back 3 are reclined while mounted on the wheelchair base 6. Alternatively, the rear legs 60*r* may not be curved. This may reduce costs and facilitate manufacturing of the wheelchair base 6 as the same leg design may be used for the front legs 60*f* and rear legs 60*r*.

In general, support chair 5 may be substantially symmetrical between the left and right sides. That is, many components present on one side of the support chair 5 and its constituent parts are also present on the other side of the support chair 5. In the example illustrated, the chair seat 2 and chair back 3 are both substantially symmetrical between their left and right sides. In some embodiments, the seat frame 4 may also be substantially symmetrical between its left and rights sides. For example, in some embodiments where the support chair 5 is not moveable away from the wheelchair base 6, the support chair 5 can be symmetrical between its left and right sides.

Tilting Mechanism for a Chair

The following is a general description of a tilting mechanism for a chair having a seat, a seat frame and a chair back and other features set out herein that may be used by itself or in combination with one or more embodiments disclosed herein, including a transfer apparatus for a chair seat of a wheelchair or other support chair. The following description contains various features of a tilting mechanism for a chair having a seat frame, a seat and a chair back that may be used individually or in any combination or sub-combination.

In accordance with this aspect, which is exemplified in FIGS. 1-13, the tilting mechanism may enable the seat 2 and chair back 3 to recline concurrently (e.g., by use of a single actuator 8) wherein the chair back 3 may recline at a greater rate than the seat 2. An advantage of such a mechanism is that the extent to which an individual's center of gravity is shifted as the chair back 3 and chair seat 2 are inclined may be reduced and may remain in substantially the same position. This may reduce the effort required to recline or raise a person seated in the chair thereby enabling a single person, or a person having less strength, to recline a person or raise the person to an upright position. Further, this may provide enhanced stability to the support chair 5 in which a person is seated.

As exemplified in FIGS. 1-13, the tilting mechanism includes a track path 40. The track path 40 defines a motion path along which the chair seat 2 is trackable. Assuming that the distance between the portions of the chair seat 2 that contact the track path 40 and the track path remains constant (e.g., the chair seat includes rollers that remain on the track path), then the inclination of the search will be adjusted based on the profile of the track path 40. Accordingly, the track path 40 may define the range of motion of the chair seat 2 as the chair seat travels in the forward and rearward directions.

The chair seat 2 may track between an upright sitting position (shown, for example, in FIGS. 1-4 and 19) and a reclined position (shown, for example, in FIGS. 7-9 and 21). The upright sitting position may provide a stable and comfortable sitting position for normal use of the support chair 5, such as moving a person in the wheelchair 1, or otherwise sitting in the support chair 5 for instance to read or interact with others. The inclination of a person seated in the chair seat 2 may be adjusted for comfort while sitting. For example, the chair seat 2 may be positioned in various partially upright positions, such as the partially inclined position shown in FIGS. 5 and 6.

The reclined position may support the lower body of the person seated on chair seat 2 while engaging in activities that may be easier when the person is reclined, such as bathing or showering, shaving or getting a haircut.

In some examples, the angle of inclination 83 between the chair seat 2 and a horizontal axis 81 may be minimized in the upright sitting position. For example, the chair seat 2 may be substantially horizontal in the upright sitting position (i.e. the angle of inclination 83 is equal to 0°).

Alternatively, the angle of inclination 83 between the chair seat 2 and the horizontal axis 81 in the upright sitting position may vary while still providing a substantially flat sitting surface. For example, the angle of inclination 83 may include small deviations from a flat surface such as +/−2° from 0°.

In the reclined position, the angle of inclination 83 between the chair seat 2 and a horizontal axis 81 may be increased. For example, the chair seat 2 may recline to an angle 83 between about 10° and 30° from the horizontal axis 81 in the reclined position and optionally about 15 degrees.

In some examples, the chair seat 2 may also be movable to a forwardly inclined position (not shown). For example, the chair seat 2 may track along the track path 40 rearward of the rear portion 44 and increase its angle of incline in the direction opposite to that of the reclined position (i.e. have the chair seat 2 and/or chair back 3 tipped or inclined forward). This may facilitate a person getting out of the chair seat 2. In some examples, the chair seat 2 may be adjustable to a forwardly inclined position of 10° or greater.

In the example illustrated, the track path 40 is defined by seat frame 4 (see FIGS. 3-10C). Alternatively, the track path 40 may be defined by wheelchair base 6. For example, in some embodiments the support chair 5 need not be moveable away from the wheelchair base 6. In such embodiments, the seat frame 4 and wheelchair base 6 may be combined and the track path 40 can be defined by the wheelchair base 6.

Alternatively, the track path 40 may be defined by another chair support base on which the support chair 5 may be mounted, such as chair support member 150. For example, if the support chair 5 is used primarily as a shower or bath chair, the track path 40 may be defined by a chair support member 150 positioned in the base 170 of a washing enclosure.

In embodiments described herein using a tilting mechanism, the chair seat 2 is movably mounted to the track path 40. The track path 40 defines at least a portion of the range of motion for the chair seat 2. For example, the track path 40 can define the forward/rearward range of motion for the chair seat 2. The chair seat 2 tracks along the track path 40, for example by sliding or translating. The chair seat 2 can thus move forward and rearward with respect to a base defining track path 40, such as the seat frame 4.

Figure 10A:
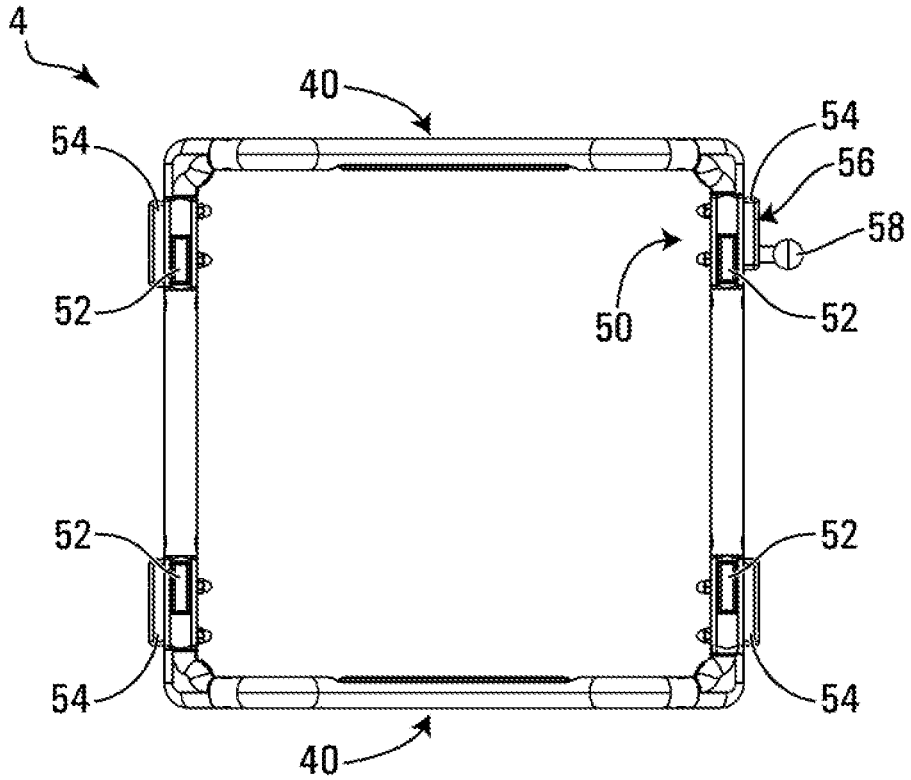
FIG. 10A is a top plan view of an example seat frame for the wheelchair of FIG. 1 in accordance with one embodiment.
Figure 10B:
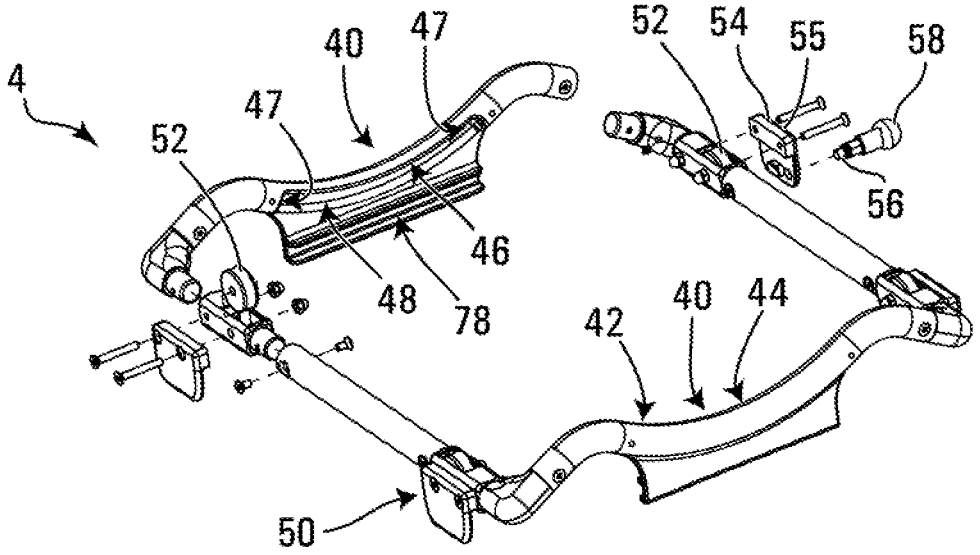
FIG. 10B is an exploded perspective view of the seat frame of FIG. 10A.
Figure 10C:
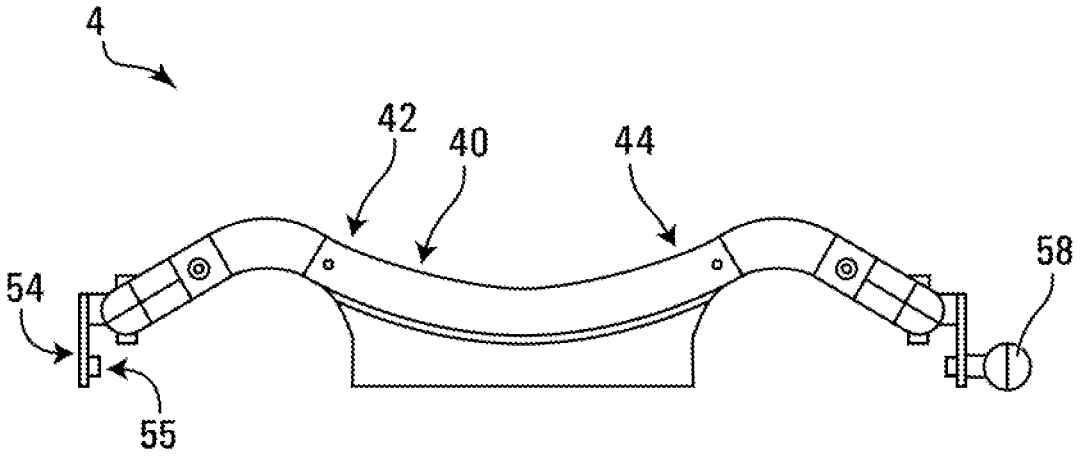
FIG. 10C is a side view of the seat frame of FIG. 10A.
Figure 10D:
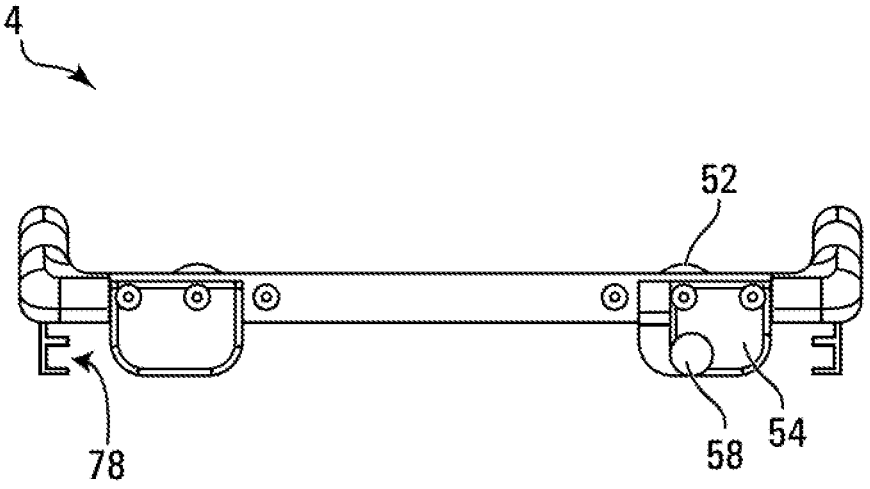
FIG. 10D is a rear view of the seat frame of FIG. 10A.

In the example shown, the track path 40 has a front portion 42 and rear portion 44 between which the chair seat 2 is movable (see, for example, FIG. 10C). In some examples, the chair seat 2 may be movable along the seat frame 4 forward of the front portion 42 or rearward of the rear portion 44. Alternatively, the range of motion of the chair seat 2 may be limited to movement between the front portion 42 and rear portion 44.

If the track path has a profile that varies in the vertical direction, then as the chair seat 2 translates along the track path 40, the inclination of the chair seat 2 is concurrently adjusted. The range of inclination of the chair seat 2 as it tracks along the track path 40 may be adjusted by varying the profile of the track path 40. Accordingly, in some examples, the track path 40 may be shaped (or have shaped sections) to cause the chair seat 2 to incline in a desired rate and to a desired angle as it translates along the track path 40. For example, the track path 40 can include a generally curved track section as shown in FIG. 10C. As the chair seat 2 translates along the curved track section the slope of the track path 40 changes. The angle of inclination 83 of the chair seat 2 may thus be defined by the slope of the track path 40 at the position of the chair seat 2 along the track path 40.

Alternatively, the track path 40 may include multiple sections each having a defined angular inclination or slope. Thus, as the chair seat 2 tracks within a section the angle of inclination 83 may not be changed. However, when the chair seat 2 moved between angled sections, the angle of inclination 83 can be adjusted.

Optionally, the track path 40 may have a central portion that is concave in shape. As exemplified in FIG. 10C, the front portion 42 is at a raised elevation with respect to the rear portion 44. Thus, as the chair seat 2 translates rearward along the track path 40 (between front portion 42 and rear portion 44), the inclination of the chair seat 2 from the horizontal axis 81 decreases (i.e. the inclination of the chair seat 2 moves towards or to a horizontal position). Similarly, as the chair seat 2 translates forward along the track path 40 (between rear portion 44 and front portion 42), the inclination of the chair seat 2 from the horizontal axis 81 increases (i.e. the chair seat 2 tilts rearward). An advantage of this design is that as the back of a person reclines, moving the chair seat forwardly may partially or fully counter the centre of gravity of the person seated in the chair moving rearwardly.

In embodiments where the inclination of the chair seat 2 is defined by the slope of the track path 40, the angle of inclination 83 of chair seat 2 may not be identical to the slope of the track path 40 at the current position of the chair seat 2. For example, the chair seat 2 may have an angular offset with respect to the slope of the track path 40. For instance, the upright sitting position of chair seat 2 may have a slight rearward inclination. This may be more comfortable for a person seated in chair seat 2 and may prevent a person from slipping forward off the chair seat 2.

Alternatively, the inclination of the chair seat 2 may not be defined by the slope of the track path 40. For example, the chair seat 2 may pivot or rotate with respect to the seat frame 4 as it tracks along the track path 40. This may allow a flat track path 40 to be used to facilitate retro-fitting of wheelchair bases 6 or chair support members 150 with flat upper surfaces.

In some embodiments, the slope of the track path 40 may partially define the inclination of the chair seat 2. In such embodiments, the chair seat 2 may rotate with respect to the seat frame 4 as it moves along the track path 40 while also having its angle of inclination 83 adjusted as a result of the slope of track path 40.

In the example illustrated, the chair seat 2 includes a seat frame mount 18. The seat frame mount 18 is used to mount the chair seat 2 to the track path 40 (e.g. to seat frame 4). The seat frame mount 18 includes one or more translation members that are movably mountable to the track path 40 so as to be trackable along the track path. The translation members are movable along the track path 40 to allow the chair seat 2 to track between the upright sitting position and the reclined position.

As exemplified in FIG. 11, the seat frame mount 18 can be provided by the chair base 10. The chair seat 2 may also include a housing for the seat frame mount 18, such as the mount housing 20 provided, e.g., by seat portion 12. The mount housing 20 may cover and partially enclose the frame mount 18 when the chair seat 2 is assembled. This may protect the seat frame mount 18 from dirt or debris.

In the example illustrated, the track path 40 is generally curved shape. The inclination of the seat frame mount 18 can be defined by the slope of the track path 40 at the current position of the seat frame mount 18. Thus, the inclination of the chair seat 2 may change with the slope of the track path 40 as the seat frame mount 18 moves along the track path 40.

Where the seat frame mount 18 includes a plurality of translation members (e.g., front and rear translation members), the angle of inclination of the chair seat 2 may be defined by the slope of a tangent line between the front and rear translation members of seat frame mount 18. In the example seat frame mount 18 illustrated by FIG. 11, two translation members 22 are provided on each side of the chair seat 2. Accordingly, the angle of inclination of the chair seat 2 can be defined by the slope of a tangent line between the translation member 22.

Alternatively, the angle of inclination can be defined by the slope of the track path 40 and a mounting angle between the chair seat 2 and the track path 40 at a flat portion of the track path 40. For example, the chair seat 2 may have an angular offset with respect to the track path 40.

In some examples, the chair seat 2 and seat frame mount 18 can have a fixed angular relationship (e.g., the chair seat 2 may be secured to the seat frame mount 18 at a fixed angular relationship). The angle of inclination of the chair seat 2 may thus be defined by the angle of inclination of the seat frame mount 18. Accordingly, as the inclination of the seat frame mount 18 changes, the inclination of the chair seat 2 changes accordingly.

Alternatively, the chair seat 2 may be rotatable with respect to the seat frame mount 18. For example, the chair seat 2 may be connected to seat frame mount 18 by a hinge. As the seat frame mount 18 is translated forward or rearward, the chair seat 2 may pivot with respect to the seat frame mount 18. Movement of the seat frame mount 18 along the track path 40 may drive pivoting of the chair seat 2. Thus, a flat track path 40 can be used while still enabling the chair seat to change inclination as it tracks along the track path 40. This may allow a flat seat frame 4, wheelchair base 6 or chair support member 150 to be retro-fitted to define the track path 40.

In the example illustrated by FIG. 11, a seat frame mount 18 and corresponding translation members are provided on both sides (left and right) of the chair seat 2. This may balance the chair seat 2 as it tracks along the track path 40 (i.e. minimizing twisting of the chair seat 2).

In some examples, the translation members of seat frame mount 18 may include one or more rollers. As shown in the example of FIG. 11, the seat frame mount 18 includes a pair of rollers 22. The rollers 22 can be mounted on the track path 40 of the seat frame 4. The rollers 22 can roll forward and rearward along track path 40 to allow the chair seat 2 to track along the track path 40.

Alternatively, the translation members of seat frame mount 18 may be slideable along the track path 40. For example, the seat frame 4 may define an inner track below the track path 40. The seat frame mount 18 may sit on the track path 40 with one or more arms extending below the track path to the inner track. Each arm may have a flanged end received in the inner track. The seat frame mount 18 may then slide along the track path 40 with the extending arms guided by the inner track.

In the example illustrated, the track path 40 has an inner lip 46 that defines the inner track path 48 (see FIG. 10B). The flanged arm of a seat frame mount 18 may be movable along the inner track path 48.

Additionally or alternatively, the seat frame mount 18 may also include one or more securement members 24 to secure the chair seat 2 to the seat frame 4 as it tracks along the track path 40. The securement members 24 may securably mount the seat frame mount 18 to the track path 40. In the example illustrated, the securement member 24 includes a retainer bracket (see FIG. 11). The retainer bracket 24 is received by the inner track path 48 with rollers 22 sitting on top of the track path 40 (see e.g. FIGS. 9 and 20).

In some cases, the track path 40 may be shaped or provided with a member to limit the range of forward and rearward motion of the chair seat 2. For example, the inner lip 46 may be shaped to provide an inner track stop 47 at either end of the inner track path 48 as shown in FIG. 10B. The seat frame mount 18 can then be blocked from moving along the track path 40 past the inner track stops 47.

As the chair seat 2 is moved along the track path 40 (e.g. as the rollers 22 move along the track path 40), the securing member 24 is also moved along the inner track path 48. As the securing member 24 reaches an end 47 of the inner track path 48, the inner lip 46 engages the securing member 24. This can prevent the chair seat 2 from moving off the track path 40.

In some examples, the inner track stops 47 can be aligned with the front portion 42 and rear portion 44 of the track path 40. This can prevent the chair seat 2 from moving forward of the front portion 42 or rearward of the rear portion 44.

Alternatively, the inner track stops 47 may be positioned elsewhere to define the range of motion of the chair seat 2 as desired for a particular implementation. For example, the inner track stops 47 shown in FIG. 10B permits the chair seat 2 to translate rearward of the rear portion 44.

In other embodiments, the inner track stops 47 may be omitted. For example, blocking members may be provided on the upper surface of the track path 40. The blocking members can be positioned to define the range of motion of the chair seat 2 along the track path 40. Alternatively, the motion of the chair seat 2 may be controlled by locking members provided by the chair seat 2.

In the example illustrated, the front portion 42 of the track path 40 is located at a position defining the reclined position of the chair seat 2. The rear portion 44 of the track path 40 is located at a position defining the upright sitting position of the chair seat 2. As the chair seat 2 tracks along the track path 40 between the front portion 42 and the rear portion 44, the inclination of the chair seat 2 changes between the upright sitting position and the reclined position.

The chair back 3 can be concurrently trackeable as the seat 2 tracks along the track path 40. The chair back 3 and seat 2 may be connected (directly or indirectly) so that the chair back 3 and seat 2 track concurrently. The inclination of the chair back may change at the same rate as the chair seat (e.g., the chair back 3 may be fixed in position with respect to the chair seat 2) or the inclination of the chair back may change at the different rate (e.g., faster rate) than the chair seat.

The search and chair back may be secured together by any means known in the chair arts. As exemplified, the seat 2 and chair back 3 may have mating connector portions used to connect the seat 2 and chair back 3 directly. For example, the rear portion 14 of chair base 10 may include one or more connector portions 16. The connector portions 16 can be provided on the rear portion 14 of both sides (left and right) of the chair seat 2 as shown in FIG. 11. Similarly, the lower portion 34 of the chair back 3 may include corresponding connector portions 36. The connector portions 36 can be provided on the chair back frame 30 on both sides of chair back 3 as shown in FIG. 12. The connector portions 16 and 36 can engage one another to define a connector 35 attaching the chair seat 2 to the chair back 3.

Figure 4:
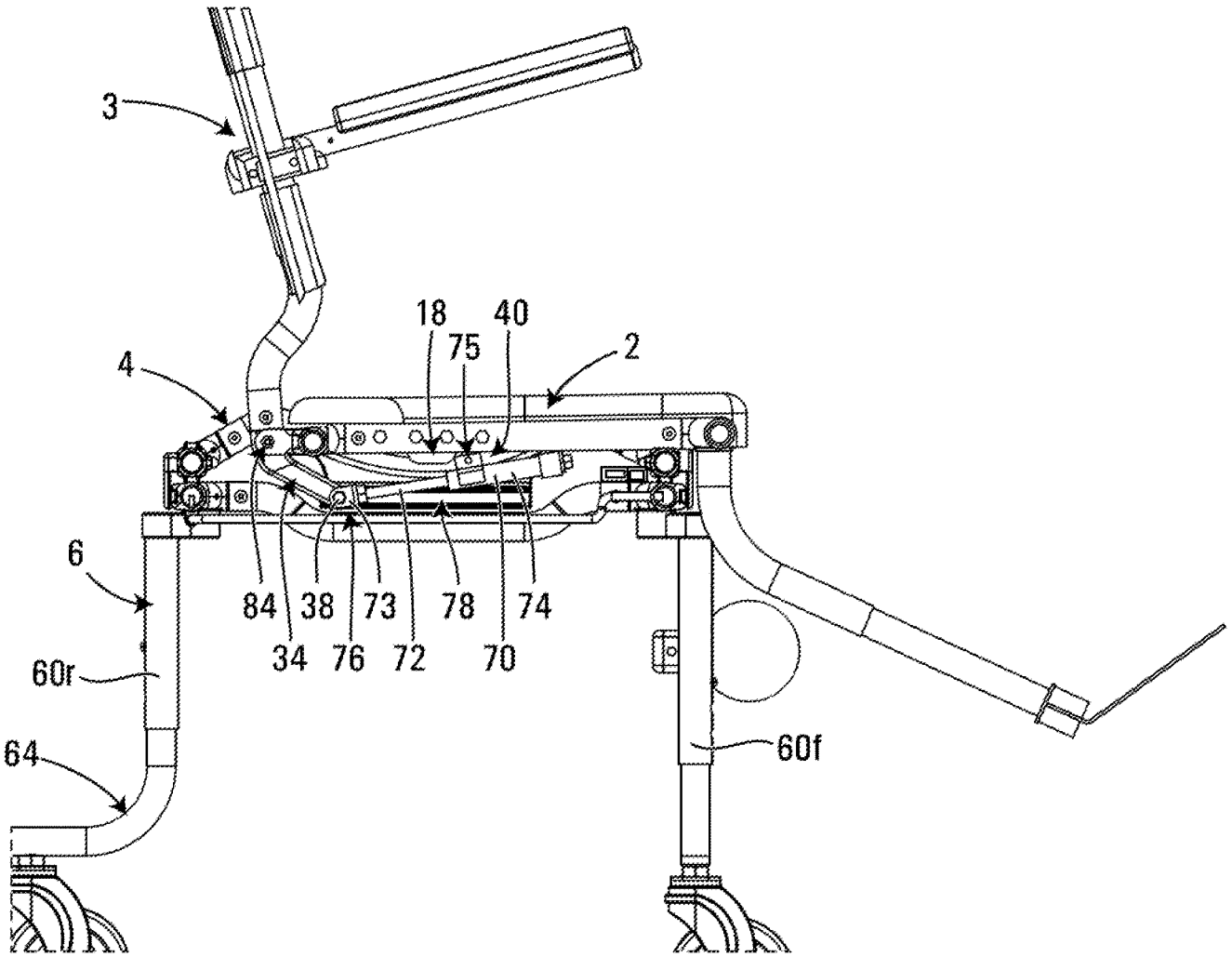
FIG. 4 is a partial cut-away side view of the wheelchair of FIG. 3 with the side frame and chair back on the near side omitted and the chair seat and chair back in the upright position.
Figure 5:
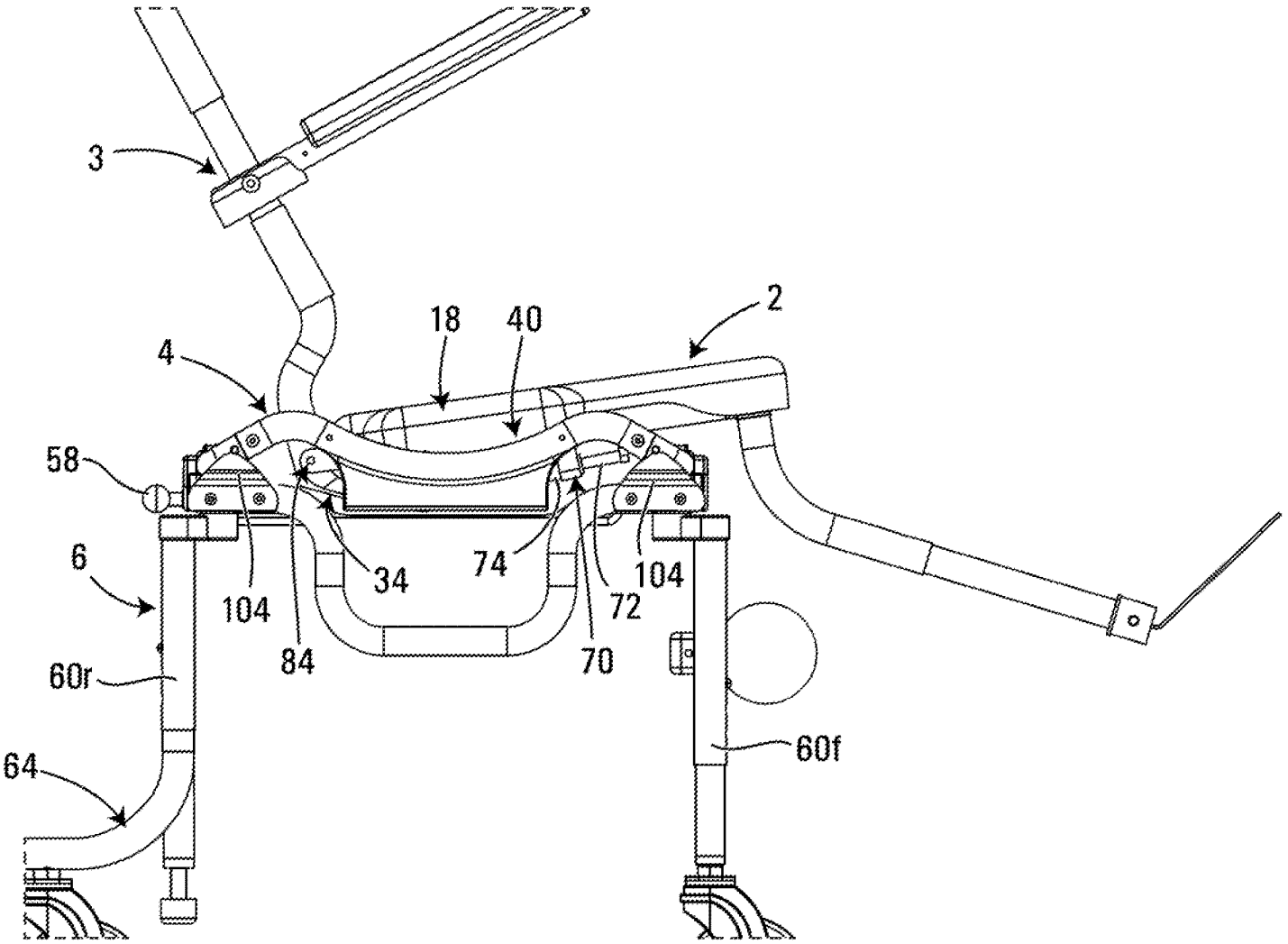
FIG. 5 is a partial side view of the wheelchair of FIG. 1 with the chair seat and chair back in a partially inclined position.
Figure 6:
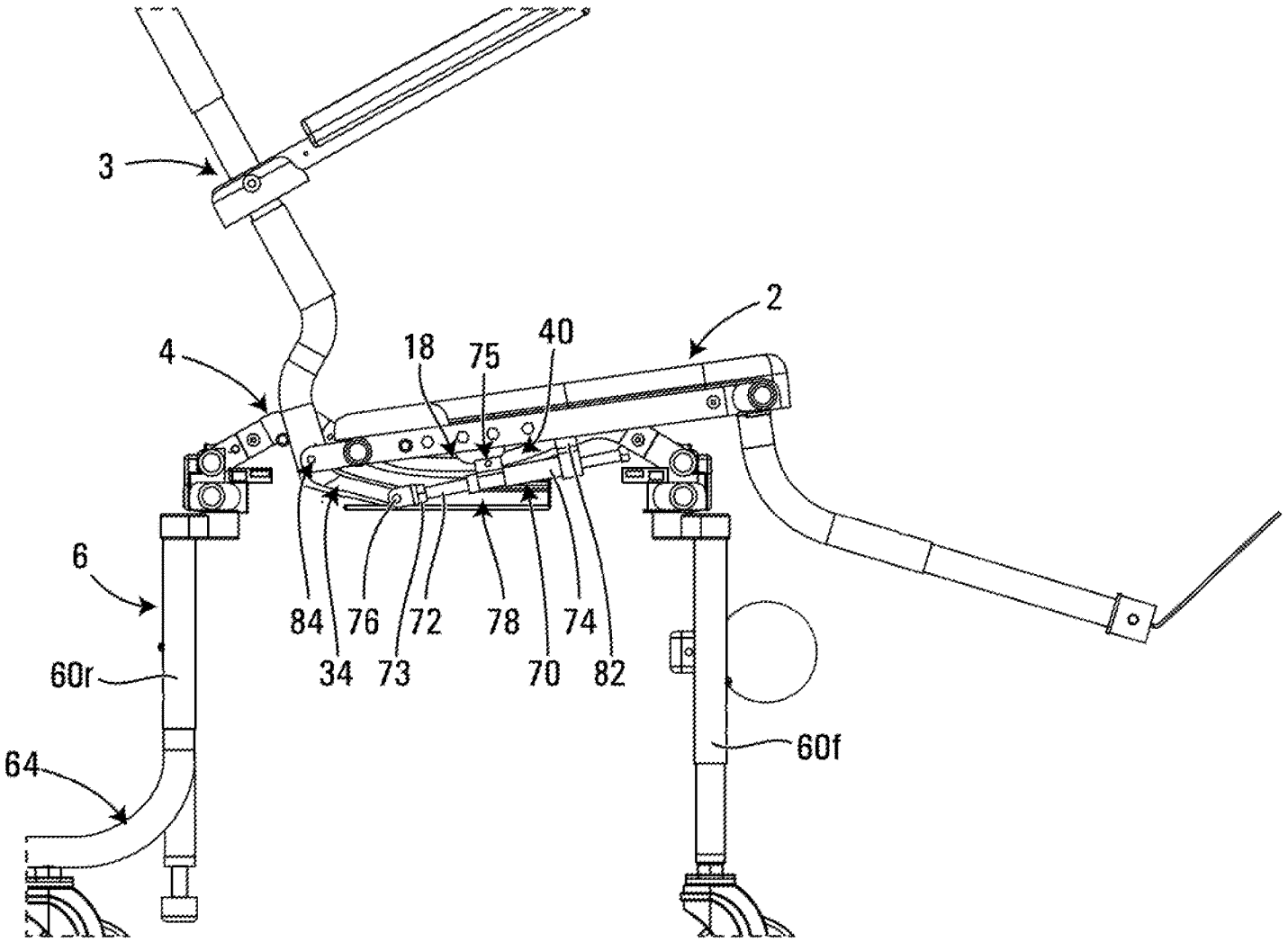
FIG. 6 is a partial cut-away side view of the wheelchair of FIG. 5 with the side frame and chair back on the near side omitted and the chair seat and chair back in the partially inclined position.
Figure 7:
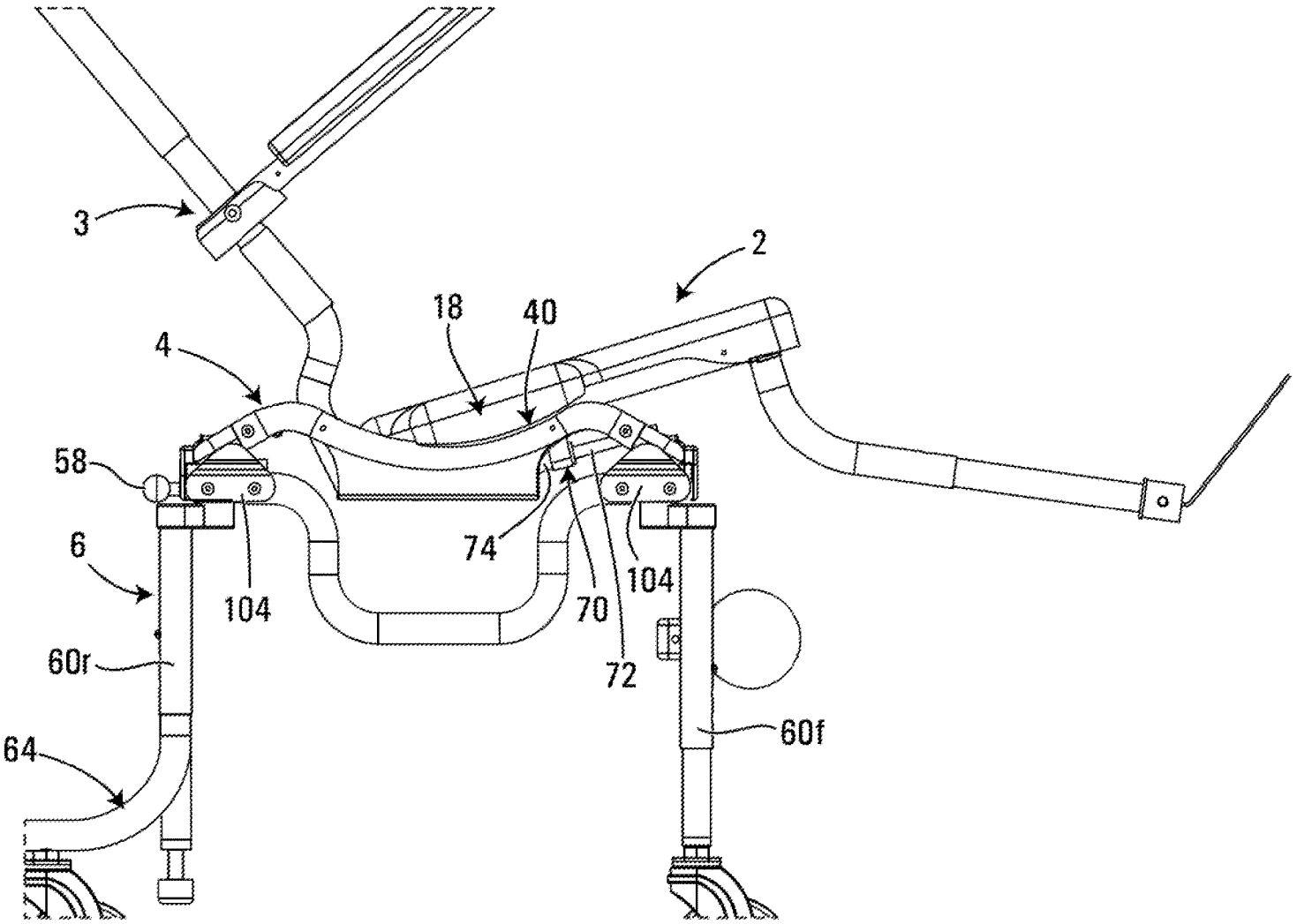
FIG. 7 is a partial side view of the wheelchair of FIG. 1 with the chair seat and chair back in a fully inclined position.
Figure 8:
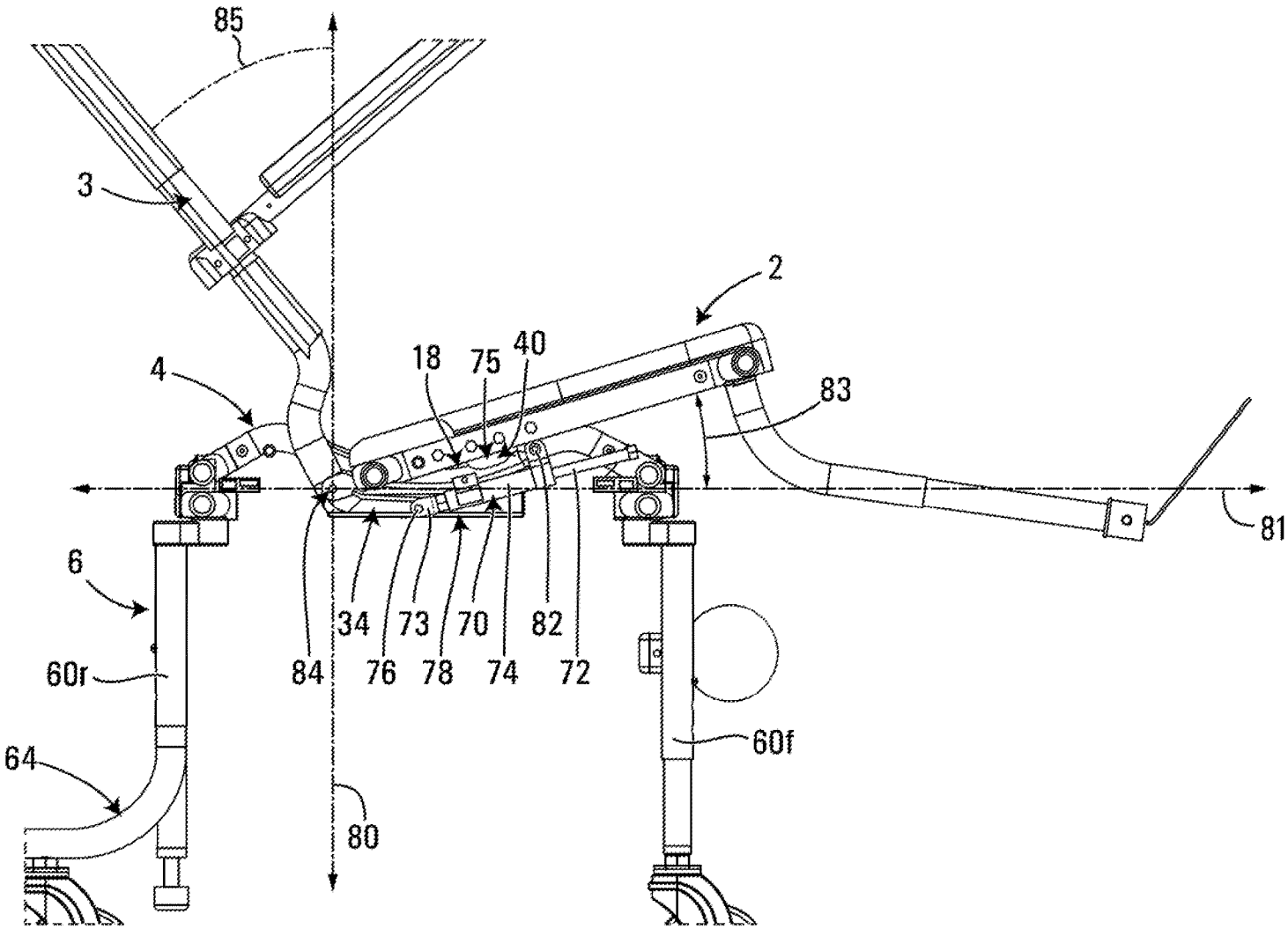
FIG. 8 is a partial cut-away side view of the wheelchair of FIG. 7 with the side frame and chair back on the near side omitted and the chair seat and chair back in the fully inclined position.
Figure 9:
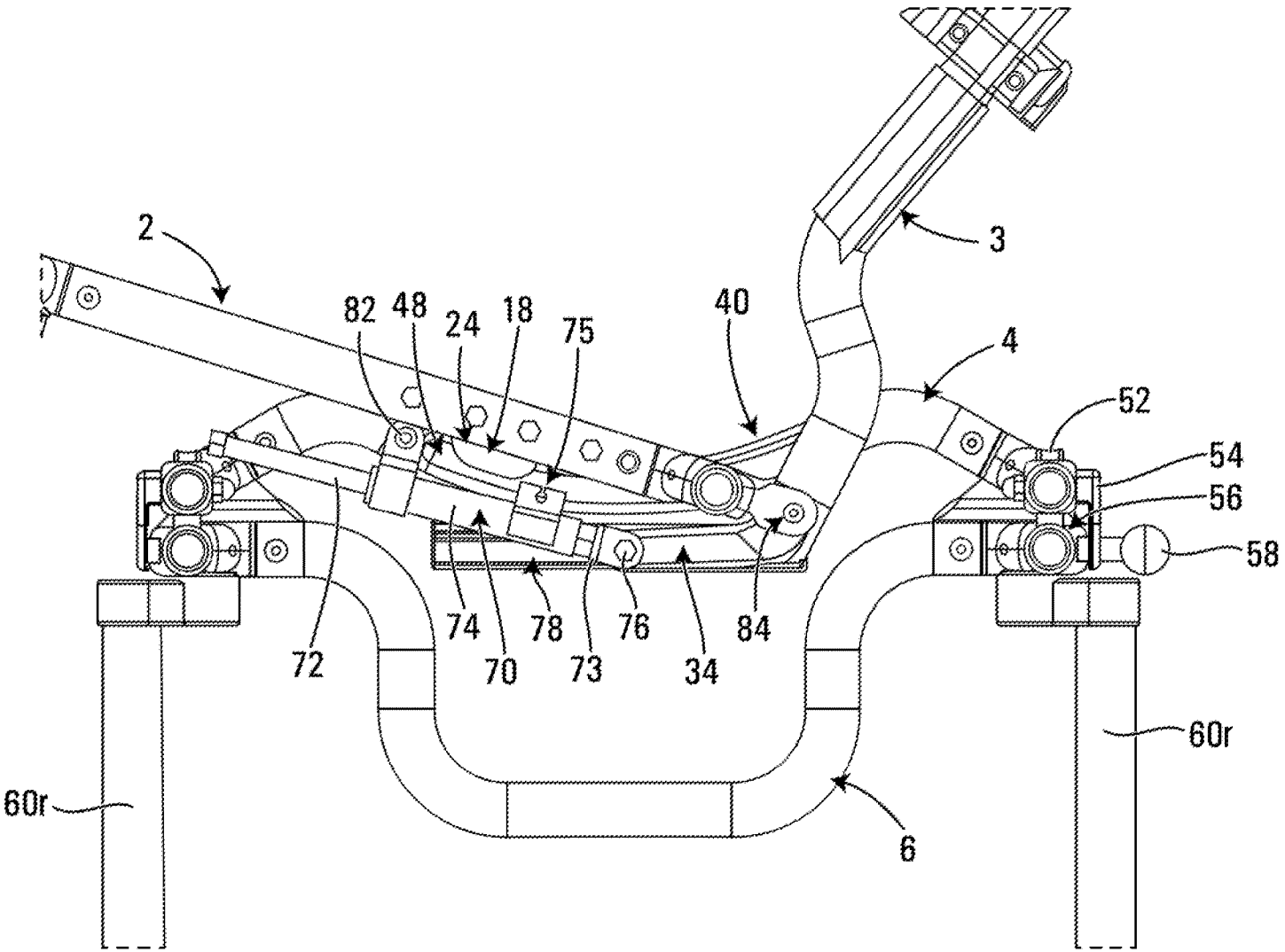
FIG. 9 is a partial cut-away side view of the opposite side of the wheelchair of FIG. 7 with the side frame and chair back on the near side omitted and the chair seat and chair back in the fully inclined position.

The mating connector portions 16 and 36 may define a hinged connector 84 between the chair seat 2 and the chair back 3 (see FIG. 4). For instance, one of the connector portions 16 and 36 may include a hinge pin while the other of the connector portions 16 and 36 may include a knuckle shaped to receive the hinge pin. The hinged connector 84 can allow the chair seat 2 and chair back 3 to rotate with respect to one another. This can allow the chair seat 2 and chair back 3 to change inclination at different rates. In some examples, this may also allow the chair seat 2 and chair back 3 to recline independently.

Alternatively, in other embodiments where the chair seat 2 and chair back 3 are not reclined at different rates (or do not recline at all), the connector portions 16 and 36 may define a fixed connection between the chair seat 2 and chair back 3. Additionally or alternatively, in such embodiments the chair seat 2 and chair back 3 may be formed integrally.

Alternatively, in some embodiments the chair seat 2 and chair back 3 may not be directly connected. For example, the chair seat 2 and chair back 3 may each be connected to the seat frame 4 or wheelchair base 6 without being directly connected to one another.

As exemplified, the chair seat 2 is mounted to the track path 40 on seat frame 4. In some examples, the chair back 3 may also be connected to the seat frame 4. For example, the lower portion 34 of the chair back 3 can include a seat frame connector 38 on either side of the chair back 3 (see FIG. 12). The seat frame connector 38 may have an arm or pin that is received in a chair back tracking path 78 defined by seat frame 4 (see FIG. 4 for example). The tracking path 78 defines a guided path in which the seat frame connector 38 is movable. The seat frame connector 38 may also provide a rotatable or hinged connection between the chair back 3 and the seat frame 4. As the seat frame connector 38 moves along the tracking path 78, the chair back 3 can rotate with respect to the seat frame 4.

The seat frame connector 38 can track along the tracking path 78 as the chair seat 2 tracks along the track path 40. Accordingly, the chair back 3 may track concurrently with the chair seat 2. The chair back 3 can track between a first position when the seat is in the upright sitting position (as shown, for example, in FIGS. 1-4 and 19) and a second inclined position when the seat is in the reclined position (as shown, for example, in FIGS. 7-9 and 21).

In the upright position, the chair back 3 may support the upper body (and head) of a person seated in the chair seat 2 in a substantially upright position (e.g. substantially vertical position). The upright position may provide a comfortable position for sitting in chair seat 2 that may facilitate reading, interacting with others, and eating for example.

In the second inclined position, the chair back 3 can support the upper body (and possible head) of a person seated in the chair seat 2 in a rearwardly inclined position (i.e. with the person facing at least partially upward). This may facilitate assisted activities such as bathing or showering, shaving or getting a haircut.

As the chair back 3 moves between the first position and the second inclined position (i.e. as the seat moves from the upright sitting position to the reclined position), an inclination 85 of the chair back 3 from a vertical axis 80 increases. The inclination 85 of the chair back 3 can be increased at a greater rate than the inclination 83 of the seat 2 as the seat 2 moves between the upright sitting position and the reclined position. This can provide a reclined position that facilitates bathing or showering, while still providing stable support for the person seated in the chair seat 2.

The chair seat 2 can be drivingly connected to the chair back 3. Tracking of the seat 2 along the track path 40 from the upright sitting position to the reclined position can thus drive the chair back 3 from the first position to the second inclined position. For instance, the connector portions 16 on the chair seat 2 may drive (e.g. pull) the corresponding connector portions 36 of the chair back 3 forward as the chair seat 2 moved forward on the track path 40. Similarly, tracking of the chair back 3 may drive tracking of the seat 2 along the track path 40.

Drivingly connecting the chair seat 2 and chair back 3 may ensure that the chair seat 2 and chair back 3 track together (i.e. substantially concurrently). This can make it easier to control tracking of the chair seat 2 and chair back 3, for example, if a combined locking or actuation mechanism may be used for both the chair seat 2 and chair back 3.

As mentioned, the chair seat 2 and chair back 3 may be hingedly connected. Accordingly, the chair seat 2 and chair back 3 may pivot or rotate with respect to one another as they move along their respective track paths 40 and 78.

In some examples, the chair back 3 may track along path 78 at a rate substantially similar to the rate at which the chair seat 2 moves along the track path 40. In the example illustrated, the path 78 is straight while the track path 40 has a generally curved shape (see FIG. 10B). As a result, the chair back 3 may translate forward/rearward more rapidly than the chair seat 2 when each is moving along its respective track path at the same rate (i.e. because a portion of the movement vector of the chair seat 2 is in the vertical direction). As a result, the chair back 3 may rotate with respect to the chair seat 2 such that its inclination changes more rapidly with respect to a horizontal or vertical axis.

The chair back 3 may pivot about a pivot axis that is offset from the connector 35 between the chair back 3 and chair seat 2. For example, the seat frame connector 38 may track forward along the path 78 at a faster rate than the connector 35 tracks forward. The lower portion 34 of the chair back 3 may thus be pulled forward by the seat frame connector 38 along the path 78, and the connector 38 may move forward relative to chair back connector portion 36 thereby rotating the chair back 3.

In some examples, the tilting mechanism may also include one or more locking members 75. The locking members 75 may move between a locked position and an unlocked position. In the locked position, the locking members 75 may secure the seat 2 and chair back 3 in position and prevent the chair seat 2 and chair back 3 from moving along the track path 40 and path 78 respectively. In the unlocked position, the seat 2 and chair back 3 are no longer secured in position by the locking members 75. Thus, the seat 2 and chair back 3 may be moveable.

In some examples, the locking members 75 may be biased to the locked position. This may prevent the support chair 5 from reclining unexpectedly. Alternatively, the locking members 75 may not be biased, but rather can be set to either the locked or unlocked position as desired.

One or more locking members 75 may be positioned on one or both sides (i.e. left and/or right) of the chair seat 2 and chair back 3. This may ensure that the chair seat 2 and chair back 3 remain aligned with their respective track paths.

In the example illustrated, the locking members 75 on each side include a telescoping cylinder 70 (see FIG. 4 for example). It will be appreciated that a cylinder 70 may be provided only on one side. The telescoping cylinder 70 is movably connected to the seat frame 4 by connector 82. In some examples, the telescoping cylinder 70 may be connected to the track path 40. Alternatively, the telescoping cylinder 70 may be connected to the seat frame 4 elsewhere, such as forward of the track path 40. The telescoping cylinder 70 can also be connected to the chair back 3. For example, the telescoping cylinder can be connected to seat frame connector 38 as shown in FIG. 4.

In the example illustrated, the telescoping cylinder 70 includes a rod 72 and a cylinder housing 74. The base 73 of the cylinder 70 is connected to connector 38 at the end of rod 72. The base 73 and connector 38 may provide a hinged connection between the chair back 3 and the cylinder 70. The cylinder housing 74, in turn, is connected to the seat frame 4. Alternatively, the cylinder housing 74 may be connected to the chair back 3 with the rod 72 connected to the seat frame 4.

The rod 72 is receivable in the cylinder housing 74. The base 73 of the rod 72 can also be movably received by path 78. Thus, as the connector 36 of the chair back 3 moves along the path 78, the base 73 is also moved along the path 78. This can cause the rod 71 to slide into and out of the cylinder housing 74.

As the chair back 3 moves forward and rearward along the track path 78, the rod 72 moves into and out of the cylinder housing 74. When the locking member 75 is in the locked position, the telescoping cylinder 70 can prevent the rod 72 from moving within the guided track 78. This then prevents the chair back 3 from moving along track path 78, because base 73 is prevented from moving along the track path 78. In turn, the chair back 3 can prevent the chair seat 2 from moving along the track path 40 because the chair back 3 and chair seat 2 are drivingly connected by mating connector portions 16 and 36.

Alternatively, the locking members 75 may lock the chair seat 2 in position on the track path 40. The chair seat 2 may then prevent the chair back 3 from moving because of the driving connection between the seat 2 and chair back 3. For example, the locking members 75 may include one or more clamping members to clamp the seat 2 to the track path 40. For example, one or more securing members 24 or flanged arms extending from seat frame mount 24 may be clampable to the inner lip 46 of the track path 40.

Alternatively, the locking members 75 may lock both the seat 2 and chair back 3 in place directly. For example, separate seat locking members and chair back locking members may be used to lock the chair seat 2 and chair back 3 respectively. Separate locking members may be used in some embodiments where the chair seat 2 and chair back 3 are not drivingly connected to one another. Alternatively, combined or interconnected locking members may be used to ensure that the chair seat 2 and chair back 3 are trackable concurrently even if they are not drivingly connected together.

The tilting mechanism may also include one or more actuators 8. The actuator(s) 8 may be used to control tracking of the seat 2 and chair back 3. In some examples, the actuator(s) 8 may be actuated to enable tracking of the seat 2 along the track path 40. Additionally or alternatively, the actuator(s) 8 may be actuated to enable tracking of the chair back 3 along the track path 78. Accordingly, actuation of actuator 8 may enable the seat 2 to move between the upright sitting position and the reclined position and the chair back 3 to move between the first and second positions.

In the example illustrated (see FIGS. 1B and 10), a single actuator 8 can be actuated to enable the seat 2 and the chair back 3 to move. The actuator 8 may be coupled to both sides (left and right) of the support chair to concurrently enable movement of the chair seat 2 and chair back 3 on both sides if each side has a locking member 75. This may facilitate adjusting the inclination of the support chair 5, because an individual can use one hand to actuate actuator 8 while using the other hand to adjust the position of the seat 2 or chair back 3. This may also prevent twisting of the support chair 5, by ensuring that both sides of the support chair 5 are inclined together.

The actuator 8 may be coupled to the locking members 75. Actuation of the actuator 8 may cause the locking member 75 to move from the locked position to the unlocked position. This can enable the seat 2 and chair back 3 to move upon actuation of the actuator 8.

In the example illustrated, the actuator 8 operates mechanically (e.g., a bowden cable) to control the locking members 75. The actuator 8 includes an actuation line 7 connected to the locking member 75. When the actuator 8 is actuated, the actuation line 7 moves the locking member 75 to the unlocked position.

Alternatively, the actuator 8 may be of any other suitable configuration, including, for example a configuration in which the actuator is hydraulic, mechanical or electrical.

One or more locking members 75 may be provided on each side of the support chair 5. A single actuator 8 may be used to control all of the locking members 75 substantially simultaneously. In the example illustrated, actuation line 7 is split (see FIG. 10) to both sides of the support chair 5 so that actuation of actuator 8 can operate on locking members 75 on both sides of support chair 5. This may ensure that operation of the tilting mechanism is balanced, by ensuring both sides are enabled to tilt at the same time.

Seat Transfer Apparatus

The following is a general description of a transfer apparatus for a chair seat of a wheelchair and/or other support chair and other features set out herein that may be used by itself or in combination with one or more embodiments disclosed herein, including a tilting mechanism for a chair. The following description contains various features of a transfer apparatus for a chair seat which may be used individually or in any combination or sub-combination.

Referring to FIGS. 14-29, a transfer apparatus is provided that includes a chair support member 150 and a bridge portion 130. The transfer apparatus permits the seat 2 of a support chair 5 (or wheelchair 1) to be moved between wheelchair base 6 and the chair support member 150, which may be positioned in the base of a washing enclosure 170 (see FIGS. 19 and 21). The transfer apparatus thereby facilitates transferring a person into and out of a washing enclosure 170 while they are seated on the chair seat 2.

The bridge portion 130 is provided as part of chair support member 150 and may be fixed thereto (i.e., it may be designed so as to remain with the chair support member 150 when chair support member 150 is not in use). An advantage of this design is that the transfer member is stored with the chair support member 150 and may not be lost.

Figure 15:
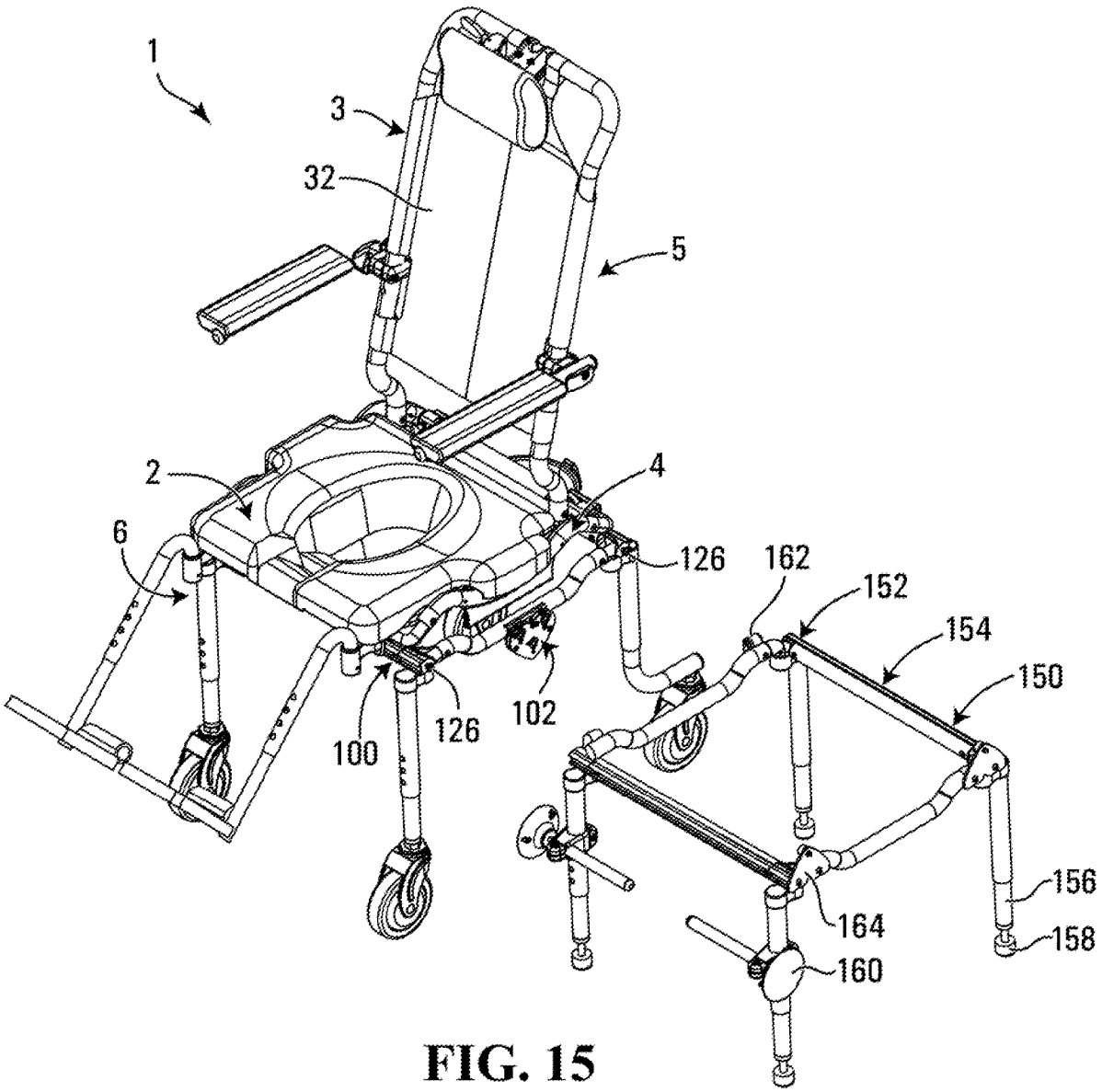
FIG. 15 is a perspective view of the wheelchair, chair support member and bridge portion member of FIG. 14 with the bridge portion member in the storage position.
Figure 16:
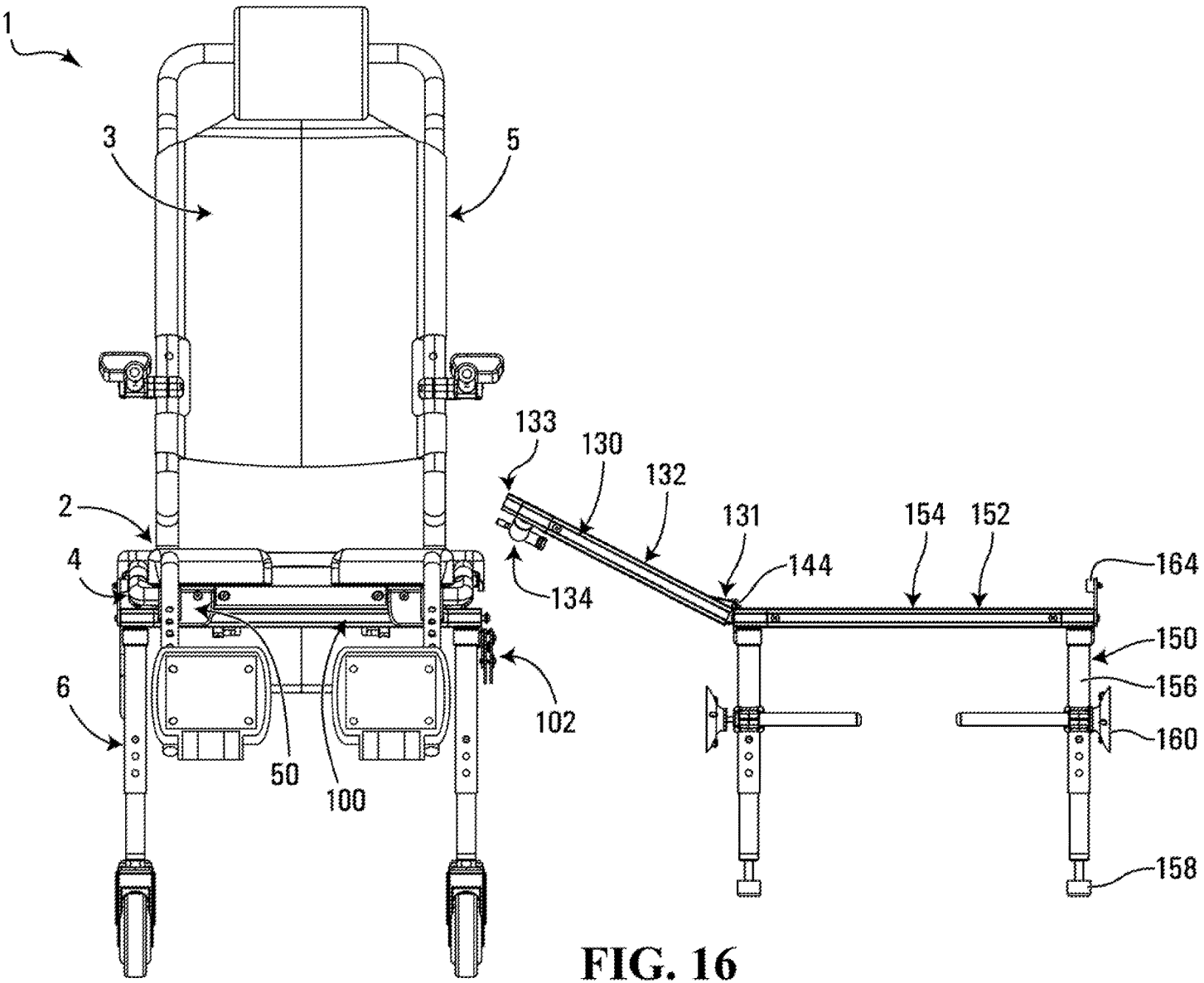
FIG. 16 is a front view of the wheelchair, chair support member and bridge portion member of FIG. 14 with the bridge portion member transitioning between the storage position and an in-use position in accordance with one embodiment.

The bridge portion 130 may be deployable from an in use position, in which the bridge portion 130 provides a bridge between the wheelchair base 6 and the chair support member 150 (see for example FIGS. 17 and 18) and a storage position, in which the bridge portion 130 may be positioned within the footprint of the chair support member 150 (see for example FIG. 15). For example, the bridge portion 130 may overlie or underlie the top of the bridge portion 130 in the storage position to thereby not increase the footprint of the chair support member 150 when in the storage position.

A wheelchair may use the reclining feature disclosed herein in combination with the seat transfer apparatus. Alternately, a wheelchair may use only the seat transfer apparatus disclosed herein. In either case, the chair seat 2 alone or in combination with other members provide an assembly that is translatable along the bridge portion 130. Accordingly, as described previously, the chair seat 2 may be mounted to a seat frame 4. For example, the chair seat 2 may be movably mounted to the seat frame 4 using seat frame mount 18. Alternatively, the seat frame mount 18 may be fixedly mounted to the seat frame 4. Alternatively, the chair seat 2 and seat frame 4 may be combined to provide an integral chair seat and seat frame for the support chair 5. This may be the case in which the chair seat 2 does not recline with respect to the seat frame 4. In any such case, an assembly which includes the chair seat may be provided with mounting portions 50. As exemplified, the seat frame 4 is provided with mounting portions 50. The mounting portions 50 can be used to mount the support chair 5 to support members, such as a wheelchair base 6 and/or a chair support member 150.

The support chair mounting portions 50 provide a movable mounting for the support chair 5. This may allow the support chair 5 to be moveable away from (e.g., laterally translatable with respect to) the wheelchair base 6 and moveable towards a chair support member 150 positioned in the base 170 of a washing enclosure such as a bath or shower enclosure. This may also allow the support chair 5 to be moveable away from (e.g., laterally translatable with respect to) the chair support member 150 and towards the wheelchair base 6.

Figure 18:
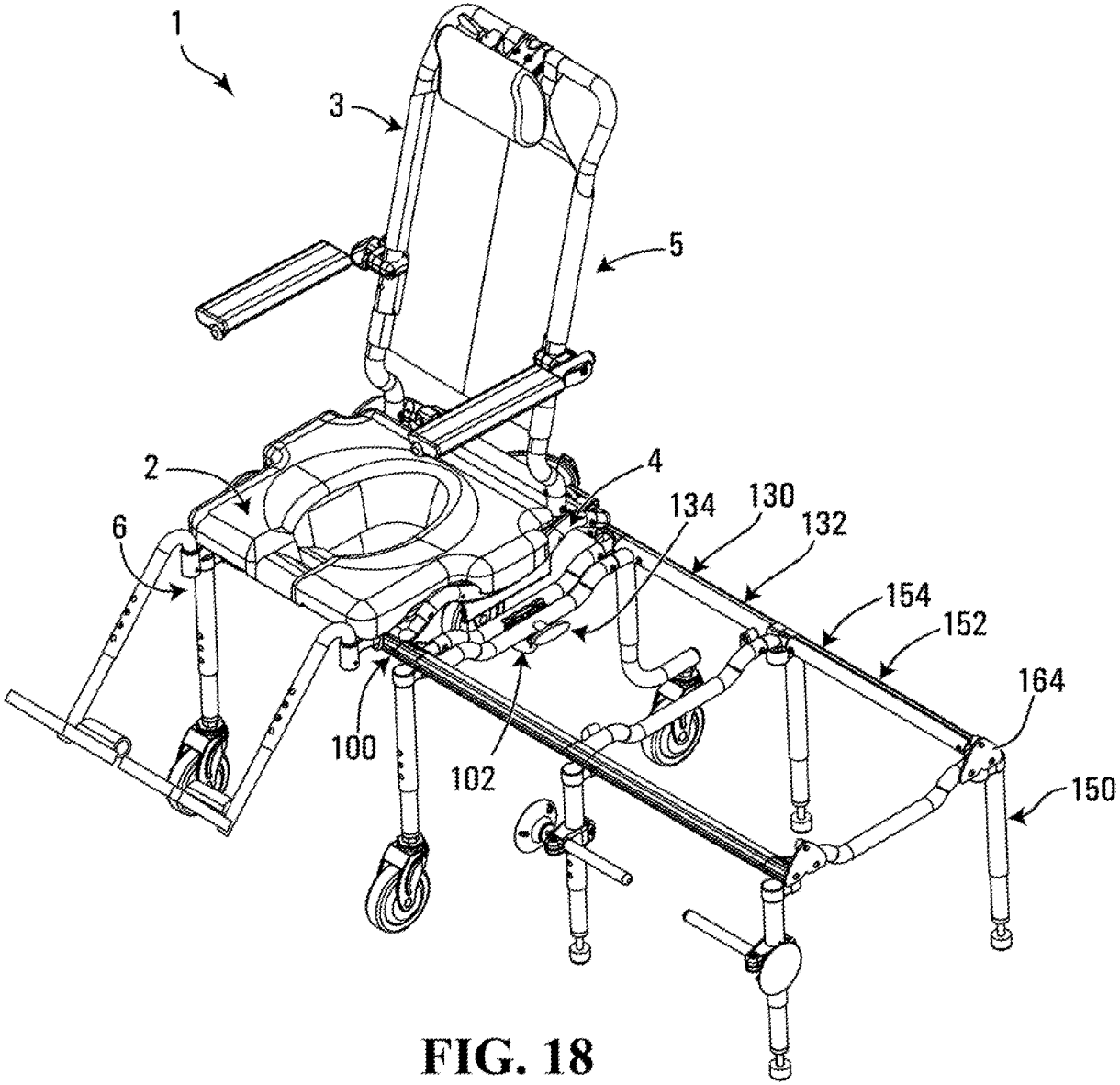
FIG. 18 is a perspective view of the wheelchair, chair support member and bridge portion member of FIG. 14 with the bridge portion member in the in-use position and a chair seat supported by the wheelchair base and the seat back in an upright position.

The support members (e.g. wheelchair base 6, bridge portion 130, and chair support member 150) may each have a track section and, therefore when connected together as exemplified in FIG. 18, provide a track along which the translation members are movable. The track accordingly defines the range and direction of motion of the translation members (e.g. lateral movement with respect to the base support member). Accordingly, the wheelchair base 6 can include a wheelchair track section 100.

The wheelchair base 6 may also include barrier or blocking members 104 and 106. The blocking members 104 and 106 may provide a barrier that prevents the seat frame 4 from sliding off the wheelchair track section 100. For example, as the seat frame 4 moves along the wheelchair track section the blocking members 104/106 can engage the seat frame 4 and prevent it from moving past the blocking members 104/106. The blocking members 104/106 can prevent unwanted movement of the chair seat 2 away from the wheelchair base 6, such as when the bridge portion 130 is not securely mounted to the wheelchair 1.

The blocking members 104 and 106 may be movable from a blocking position to a transfer position in which the blocking members are positioned so as to allow the seat frame 4 to move laterally away from the wheelchair base 6, for example to transfer the chair seat 2 to a chair support member 150.

The bridge portion 130 of the transfer apparatus can be connected to the wheelchair base 6 on which the chair seat 2 is mountable. The bridge portion 130 includes a bridge track section 132. The bridge track section 132 may be generally similar to the wheelchair track section 100. The bridge track section 132 provides a surface along which the chair seat 2 is translatable. The bridge portion 130 can be used to transfer the chair seat 2 between the wheelchair base 6 and the chair support member 150. The bridge track section 132 can provide a connecting bridge between the wheelchair base 6 and a chair support member 150. The chair seat 2 can be transferred between the wheelchair base 6 and the chair support member 150 using the bridge track section 132.

The chair support member 150 can include a chair support track section 154. As shown in the example illustrated, the chair support track section 154 can be positioned on the upper end 152 of the chair support member 150. The chair support track section 154 may allow the chair seat 2 to be transitioned to and from (e.g. laterally translated with respect to) the chair support member 150.

The bridge portion 130 and chair support member 150 can be connected to each other to define a transfer apparatus. For example, the bridge portion 130 and chair support member 150 can be secured to one another. This may provide a transfer apparatus that does not need to be assembled from multiple separate pieces each time a chair seat 2 is transferred to the chair support member 150.

The bridge portion 130 can be movably mounted to the chair support member 150. This can allow the bridge portion 130 to move between a storage position (shown in FIG. 14) and an in-use position (shown in FIGS. 17-21). The in-use position allows the bridge portion 130 to connect the chair support member 150 to a wheelchair base 6. The storage position may provide a reduced profile for the transfer apparatus thereby facilitating storage.

In the example illustrated, the bridge portion 130 is pivotally mounted to the chair support member 150 by hinge 144. This may allow the bridge portion 130 to easily transfer between the in-use position and the storage position (see, for example, FIG. 16).

In the in-use position, the bridge track section 132 and chair support track section 154 can be aligned. The bridge track section 132 extends from the chair support track section 154 and defines a continuous transfer apparatus track section when the bridge portion 130 is in the in-use position. This continuous track section may allow a chair seat 2 to translate along the bridge track section 132 to the chair support track section 154. Accordingly, the chair seat 2 can be transitioned to and from the chair support member 150 using the bridge track section 132.

In the in-use position, the bridge portion 130 may extend outward from the chair support member 150. The bridge portion 130 may then be engageable with a wheelchair base 6 to allow a chair seat 2 to be transferred between the wheelchair base 6 and the chair support member 150. The bridge portion 130 may engage the wheelchair base 6 with the bridge track section 132 aligned with the wheelchair track section 100 and the chair support member 150. This can allow the chair seat 2 to translate from the wheelchair base 6 to the chair support member 150 using a continuous track (see, for example, FIGS. 17-21).

The inner end 131 of the bridge portion 130 can be mounted to the chair support member 150. In the in-use position, the inner end 131 of the bridge portion 130 may be proximate the chair support member 150. The opposing outer end 133 of the bridge portion 130 may be distal from the chair support member 150. The outer end 133 of the bridge portion 130 may then be engageable with the wheelchair base 6 to allow the chair seat 2 to be transferred between the wheelchair base 6 and the chair support member 150.

In the storage position, the bridge portion 130 and chair support member 150 may be arranged to facilitate storage of the transfer apparatus. For example, the bridge portion 130 may be positioned on the upper end 152 of the chair support member 150 in the storage position. This may allow the bridge portion 130 and chair support member 150 to be easily stored while remaining secured to one another.

In some examples, the bridge portion 130 may overlie the chair support member 150 in the storage portion (see FIG. 14). This may reduce the profile of the transfer apparatus, and in turn reduce the space required for storage.

In some examples, the bridge portion 130 may have a profile that is contained within the profile of the chair support member 150 when in the storage position (see FIG. 14). In such embodiments, the bridge portion 130 may not extend beyond the sides of the chair support member 150 when in the storage position.

For example, the transfer apparatus may be left in the storage position within the base 170 of a washing enclosure. When a person needs to be transferred into the washing enclosure, the bridge portion 130 can be moved to the in-use position. The bridge portion 130 may then extend out from the washing enclosure. This may allow the transfer apparatus to be stored fully contained within the washing enclosure while assembled to simplify the process of setting up the transfer apparatus each time a person needs to be transferred to the washing enclosure.

Alternatively, the bridge portion 130 may partially overhang the chair support member 150 in the storage position. For example, the bridge portion 130 may overlie the chair support member 150 with the outer end 133 of the bridge portion 130 extending beyond the profile of the chair support member 150. This may provide a longer bridge portion 130 that can be engaged with a wheelchair base 6 positioned further away the chair support member 150.

The transfer apparatus may also include one or more engagement members. The engagement members can be used to engage the bridge portion 130 and wheelchair base 6. In some examples, the engagement members may also prevent the chair seat 2 from moving along the track when the wheelchair 1 and bridge portion 130 are not engaged.

As exemplified, in the in-use position, the bridge portion 130 and wheelchair base 6 are engaged such that the wheelchair track section 100 and bridge track section 132 are aligned. The engagement members can be configured to align the wheelchair track section 100 and the bridge track section 132 when they are engaged or only be engageable when the wheelchair track section 100 and the bridge track section 132 are aligned.

The wheelchair base 6 may include one or more bridge engagement portions (one or more bridge engagement members 102). The bridge portion 130 may also include one or more corresponding chair engagement portions. The bridge engagement portions can be engaged with the chair engagement portions (one or more chair engagement members 134) to engage the bridge portion 130 with the wheelchair base 6. The bridge engagement member 102 and chair engagement member 134 may be any mateable connectors and may be lockingly securable together. When secured together, the bridge engagement member 102 and chair engagement member 134 secure the bridge portion 130 with the wheelchair 1.

For example, the bride engagement member 102 and chair engagement member 134 can be shaped to engage one another automatically as the bridge portion 130 rotates from the storage position to the in-use position with the bridge track section 132 aligned with the wheelchair track section 100. This may facilitate engaging the bridge portion 130 and wheelchair base 6 by providing a simple mechanism for aligning the track sections.

The chair engagement member(s) 134 can be positioned on the outer end 133 of the bridge portion 130. This can allow the bridge to fully extend from the chair support member 150 when engaging the wheelchair base 6.

Figure 23A:
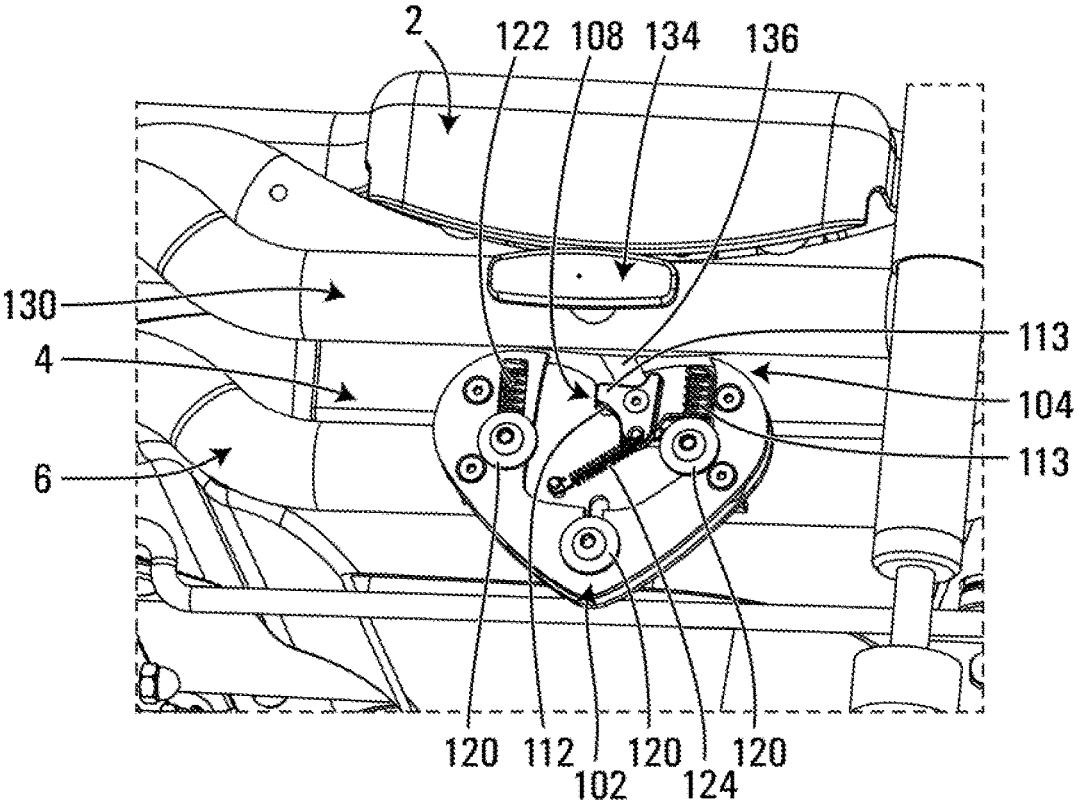
FIG. 23A is a partial perspective side view from below of the wheelchair, and bridge portion member of FIG. 14 showing a bridge engagement member mounted on the wheelchair with the blocking member in the raised position and a chair engagement member on the bridge portion member.
Figure 23B:
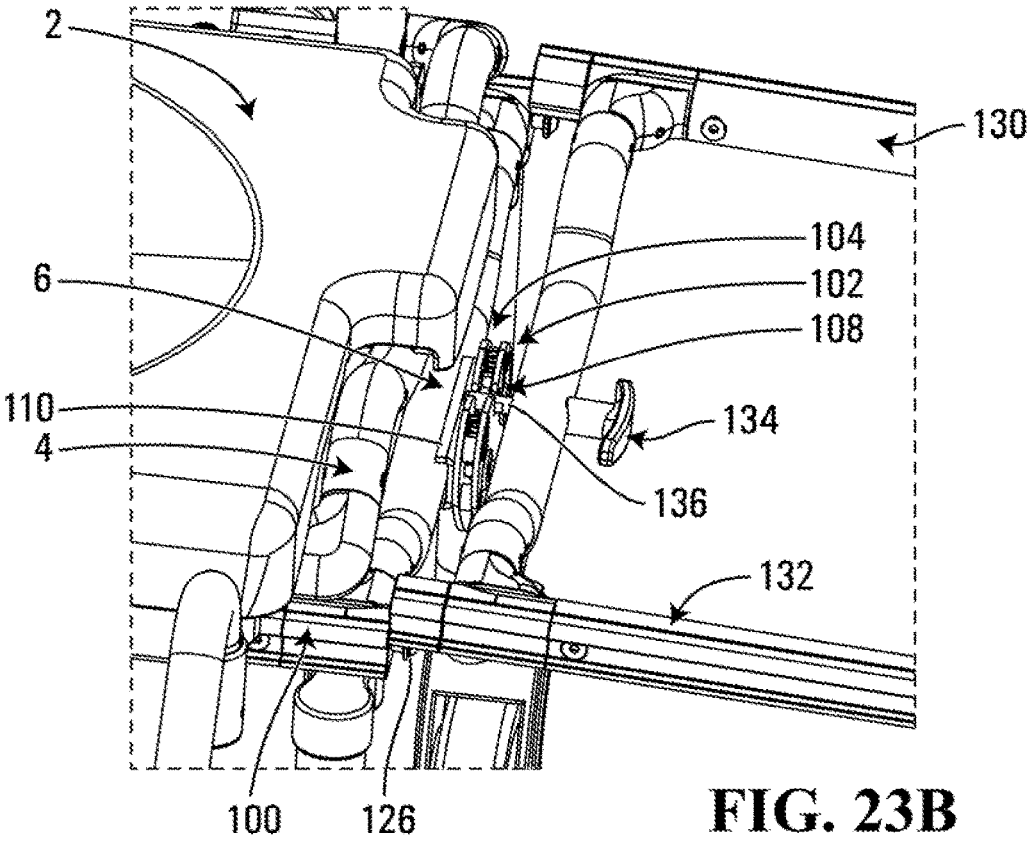
FIG. 23B is a partial perspective view from above of the wheelchair, and bridge portion member of FIG. 14 showing the chair engagement member on the bridge portion engaging with the bridge engagement member mounted on the wheelchair with the blocking member in a partially lowered position.

In the example illustrated, the chair engagement member 134 includes an arm 136 (see FIGS. 23A and 23B). The arm 136 extends out from the outer end 133 of the bridge portion 130. The bridge engagement member 102 includes a corresponding receiving portion 108. The receiving portion 108 is shaped to receive the arm 136 when the bridge portion 130 engages the wheelchair base 6. The arm 136 and receiving portion 108 are positioned so that the wheelchair track section 100 and bridge track section 132 are aligned when the arm 136 is received in receiving portion 108.

Alternatively, the bridge engagement members 102 may include an arm that is receivable by the chair engagement member 134.

Alternatively, the chair engagement members 102 may include a downwardly extending arm that extends downward from the outer end 133 when in the in-use position. In such embodiments, the bridge engagement member 134 may be provided as a hole or recess in the wheelchair base 6 shaped to receive the downwardly extending arm. For example, the downwardly extending arm may be a pin that is received by a pinhole in the wheelchair base 6. This pin and corresponding pinhole may be used to align the bridge portion 130 and wheelchair base 6, e.g. by preventing the bridge portion 130 from lying flat unless the pin and pinhole are aligned.

Additionally or alternatively, the transfer apparatus may include one or more track alignment members. The track alignment members can align the wheelchair track section 100 and bridge track section 132 when the bridge portion 130 engages the wheelchair base 6.

The track alignment members can include chair track alignment members 126 and bridge track alignment members 138. The chair track alignment members 126 may be provided on the wheelchair base 6. The bridge track alignment members 138 can be provided on the bridge portion 130. The chair track alignment members 126 and bridge track alignment members 138 can be mateable connectors. The chair track alignment members 126 and bridge track alignment members 138 can be positioned such that when they are mated, the wheelchair track section 100 and bridge track section 132 are aligned to form a continuous track.

For example, the chair track alignment members 126 may be positioned below and in-line with the wheelchair track section 100. The bridge track alignment members 138 may also be positioned below and in-line with the bridge track section 132. As in the example illustrated, the chair track alignment members 126 extend outward beyond the end of the wheelchair track section 100 in the direction of the track length (see FIGS. 15 and 23B).

Figure 17:
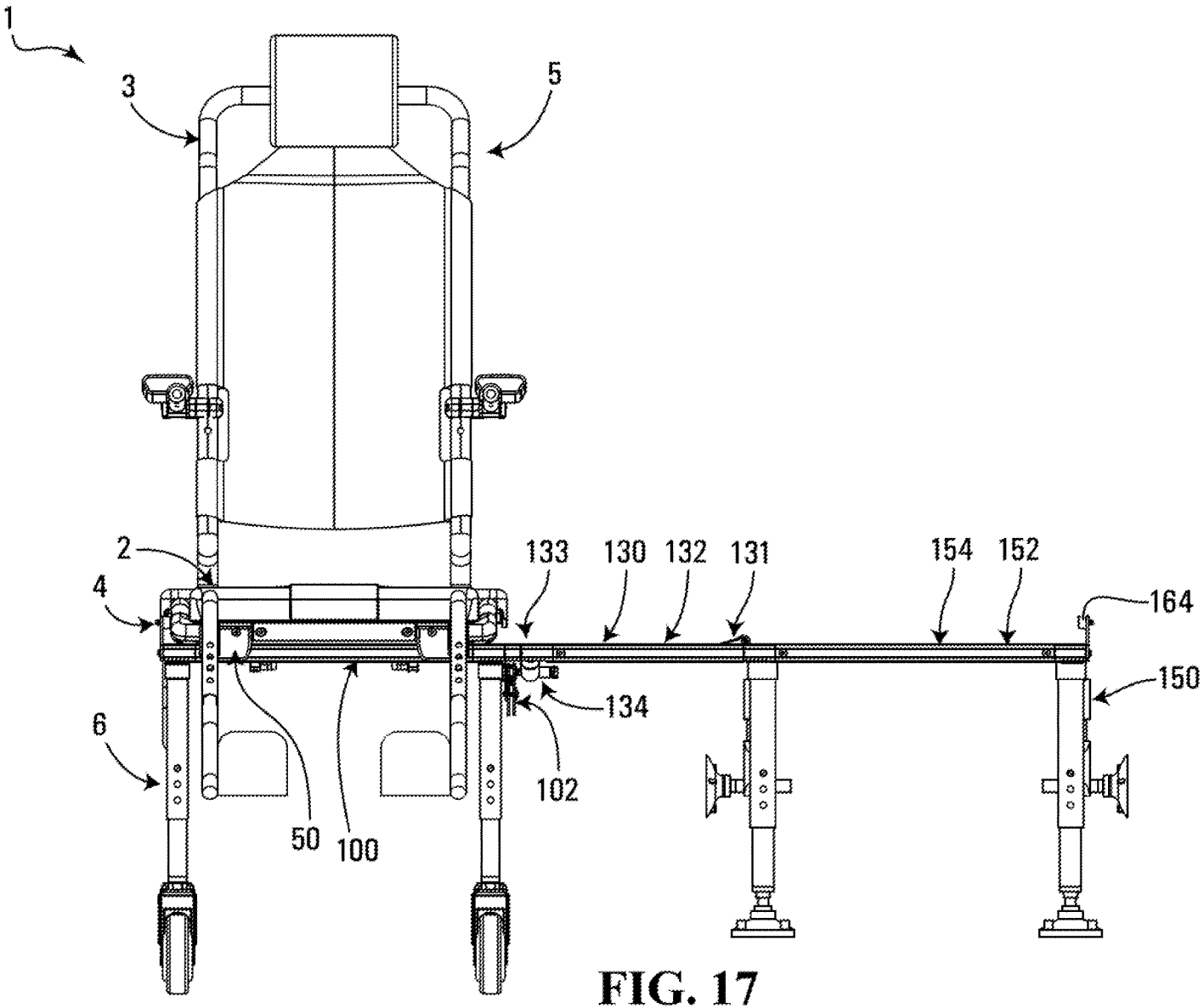
FIG. 17 is a front view of the wheelchair, chair support member and bridge portion member of FIG. 14 with the bridge portion member in the in-use position.
Figure 28:
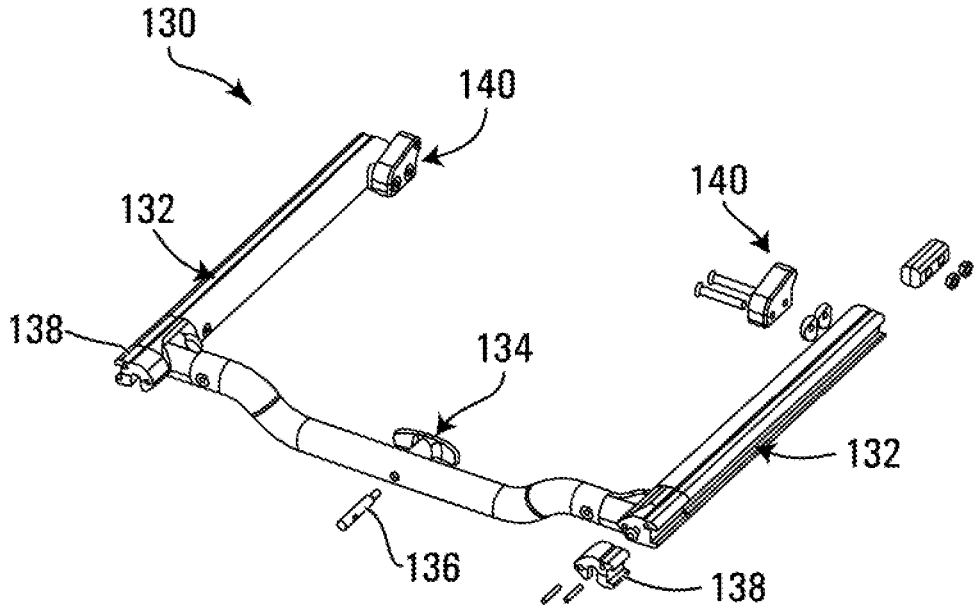
FIG. 28 is an exploded perspective view of a bridge portion member for a bath transfer apparatus in accordance with one embodiment.
Figure 29:
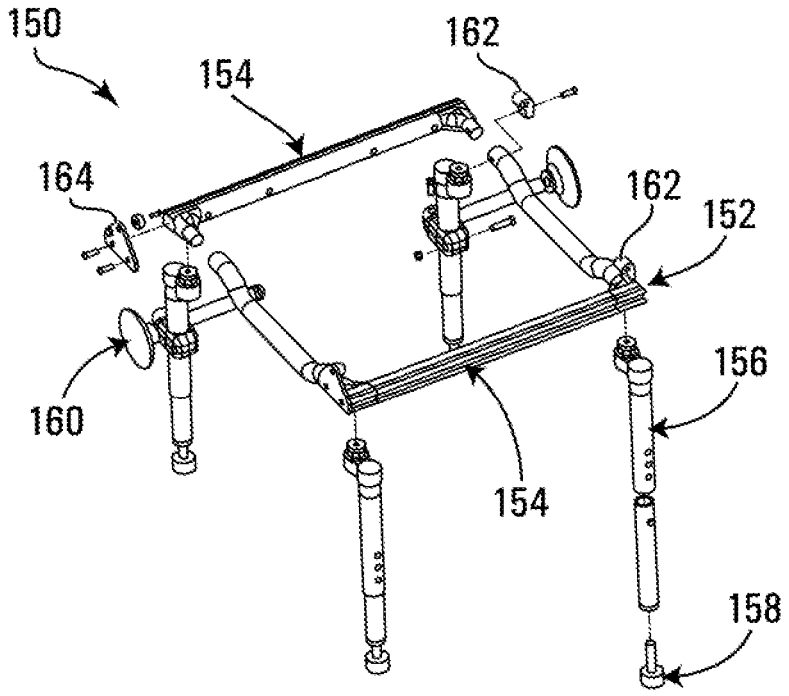
FIG. 29 is an exploded perspective view of a chair support member for a bath transfer apparatus in accordance with one embodiment.
Figure 30:
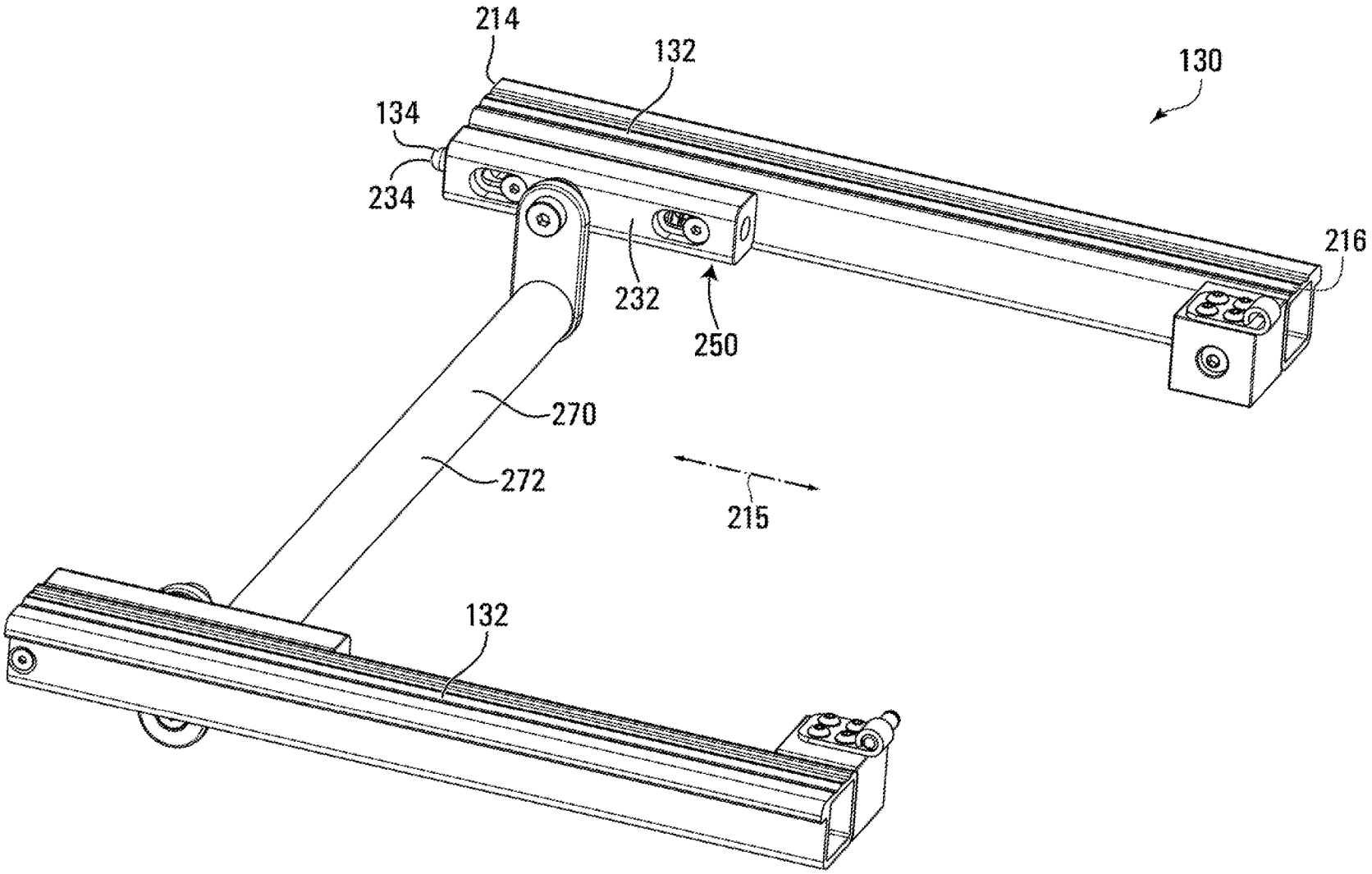
FIG. 30 is top perspective view of a bridge portion member for a bath transfer apparatus in accordance with one embodiment.
Figure 31:
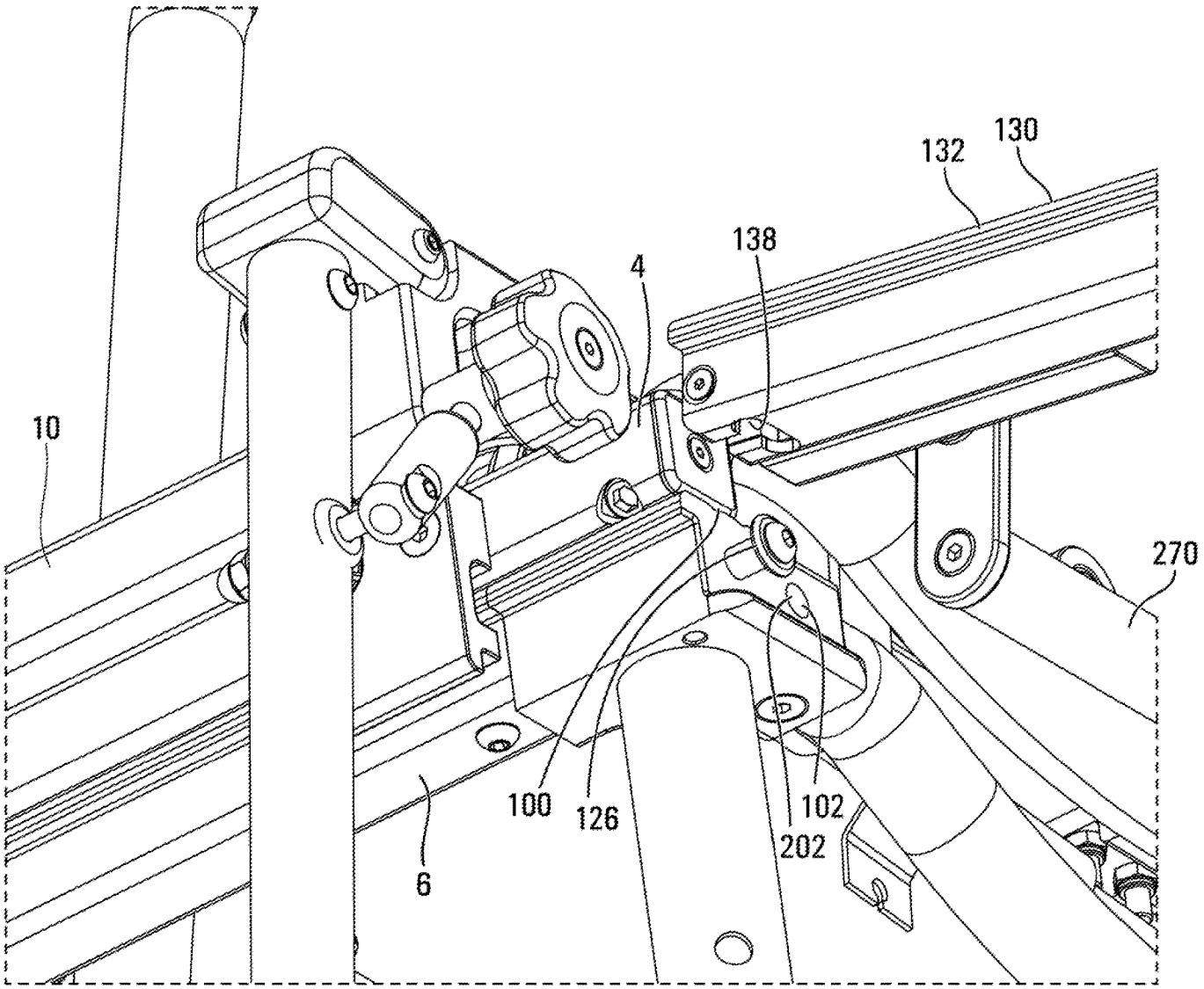
FIG. 31 is a bottom perspective view of a wheelchair and the bridge portion member of FIG. 30 with the bridge portion member transitioning between the storage position and an in-use position in accordance with one embodiment.

As shown in FIG. 28, the bridge track alignment members 138 can be shaped to receive the chair track alignment members 126 with the bridge track section 132 extending over the chair track alignment members 126 to meet the wheelchair track section 100 (see FIG. 17). This may facilitate aligning the bridge track section 132 and wheelchair track section 100 as the bridge portion rotates from the storage position to the in-use position.

Alternatively, the bridge track alignment members 138 may extend outward below the bridge track section 132 and be received by a corresponding chair track alignment members 124 that extend out from the wheelchair track section 100.

In some examples, the bridge engagement member 102 and chair engagement member 134 may be lockably engageable. For example, the receiving portion 108 may include a latch that secures the chair engagement member 134 and bridge engagement member 102. A user may need to manually release the latch to disengage the chair engagement member 134 and bridge engagement member 102. This may ensure that the wheelchair base 6 and bridge portion 130 remain engaged as the chair seat 2 is transitioned between the wheelchair base 6 and the chair support member 150. This may also ensure that the wheelchair base 6 and bridge portion 130 do not disengage before the chair seat 2 transitions from the wheelchair track section 100 to the bridge track section 132.

The transfer apparatus may include one or more bridge locking members that lockably secure the bridge portion 130 to the wheelchair base 6. When the bridge portion 130 is in the in-use position and engaged with the wheelchair base 6 and the locking members are in a locked position, the lock can be recessed to allow the chair seat 2 to translate along the bridge track section 132 to the chair support track section 154 without engaging the locking member.

The locking members may be provided on the outer end 133 of the bridge portion 130. For example, the locking member may be provided by the chair engagement member 134 or alignment members 138. Alternatively, the locking member may be provided by the wheelchair base 6, for example as part of bridge engagement member 102 or alignment members 126.

In some examples, as the bridge portion 130 engages the wheelchair base 6, the locking members can be automatically locked. For example, the chair engagement member 132 engaging with the bridge engagement member 102 may cause the locking member to transition to the locked position. Alternatively, mating of the alignment members 126 and 138 may cause the locking member to transition to the locked position.

In some examples, when the bridge portion 130 is engaged with the wheelchair base 6 and the locking member is in the locked position, the locking member can be automatically moved to an unlocked position when the chair seat 2 is translated from the bridge track section 132 to the wheelchair track section 102. For example, the chair seat 2 may include a release arm that engages the locking member as it transitions to the wheelchair track section 102 to transition the locking member from the locked position to the unlocked position. The release arm may engage a latch provided by the locking member and transition the locking member to the unlocked position.

Alternatively, the bridge engagement member 102 and chair engagement member 134 need not be lockably engaged. For example, the weight of the chair seat 2 (as well as the person seated therein) as it translates along the bridge track section 132 may maintain the bridge portion 130 in the in-use position. In some examples, the bridge portion 130 may be maintained in the in-use position by its own weight.

In some examples, the transfer apparatus may include one or more barrier member or blocking members 104 that can prevent the chair seat 2 from moving off the wheelchair track section 100. The blocking members 104 may block the chair seat 2 from translating off the wheelchair track section 100.

Figure 20:
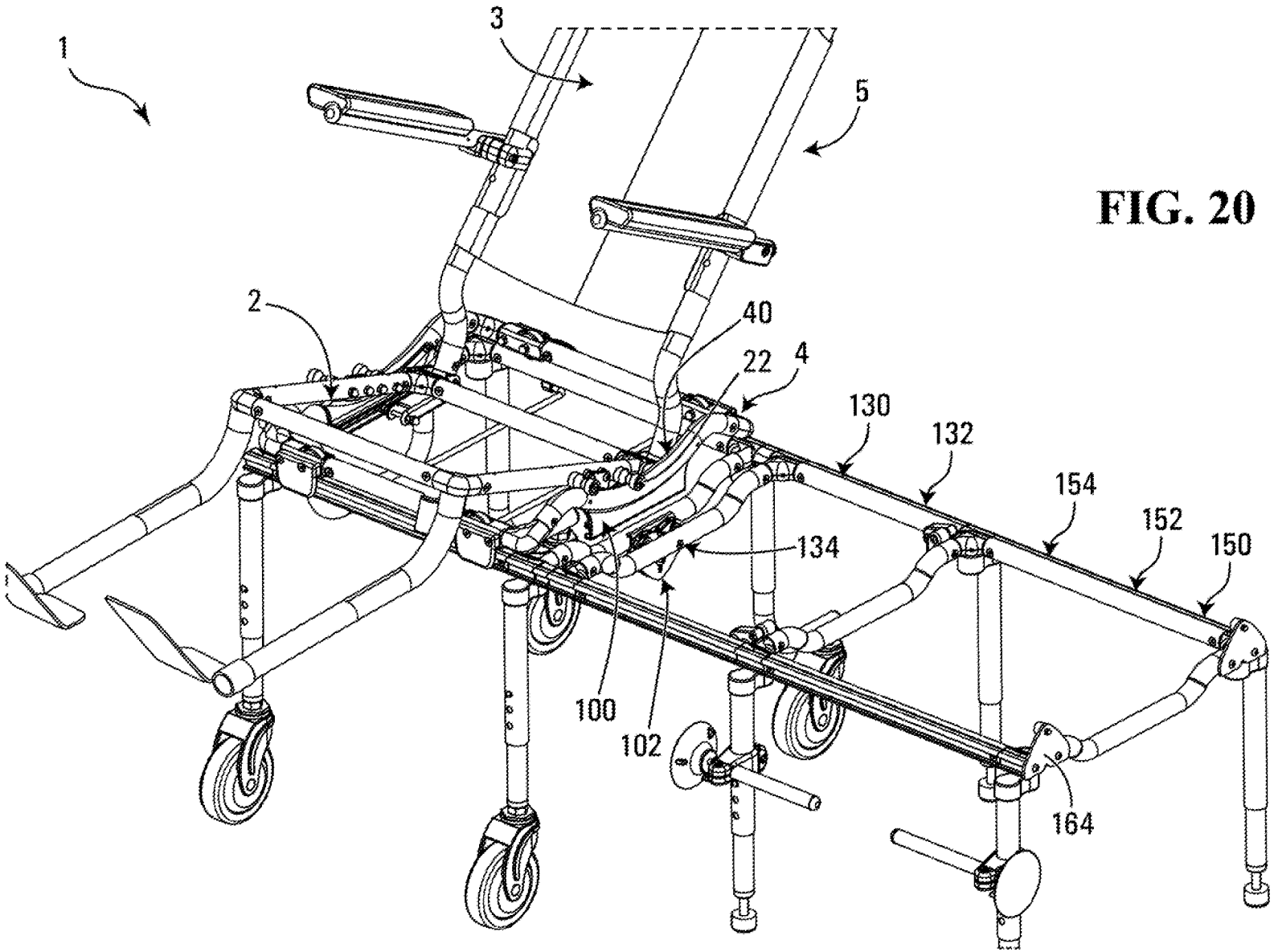
FIG. 20 is a partial perspective view of the wheelchair, chair support member and bridge portion member of FIG. 14 with the bridge portion member in the in-use position and the chair seat supported by the wheelchair and the seat and seat back in a fully inclined position in accordance with one embodiment.
Figure 24:
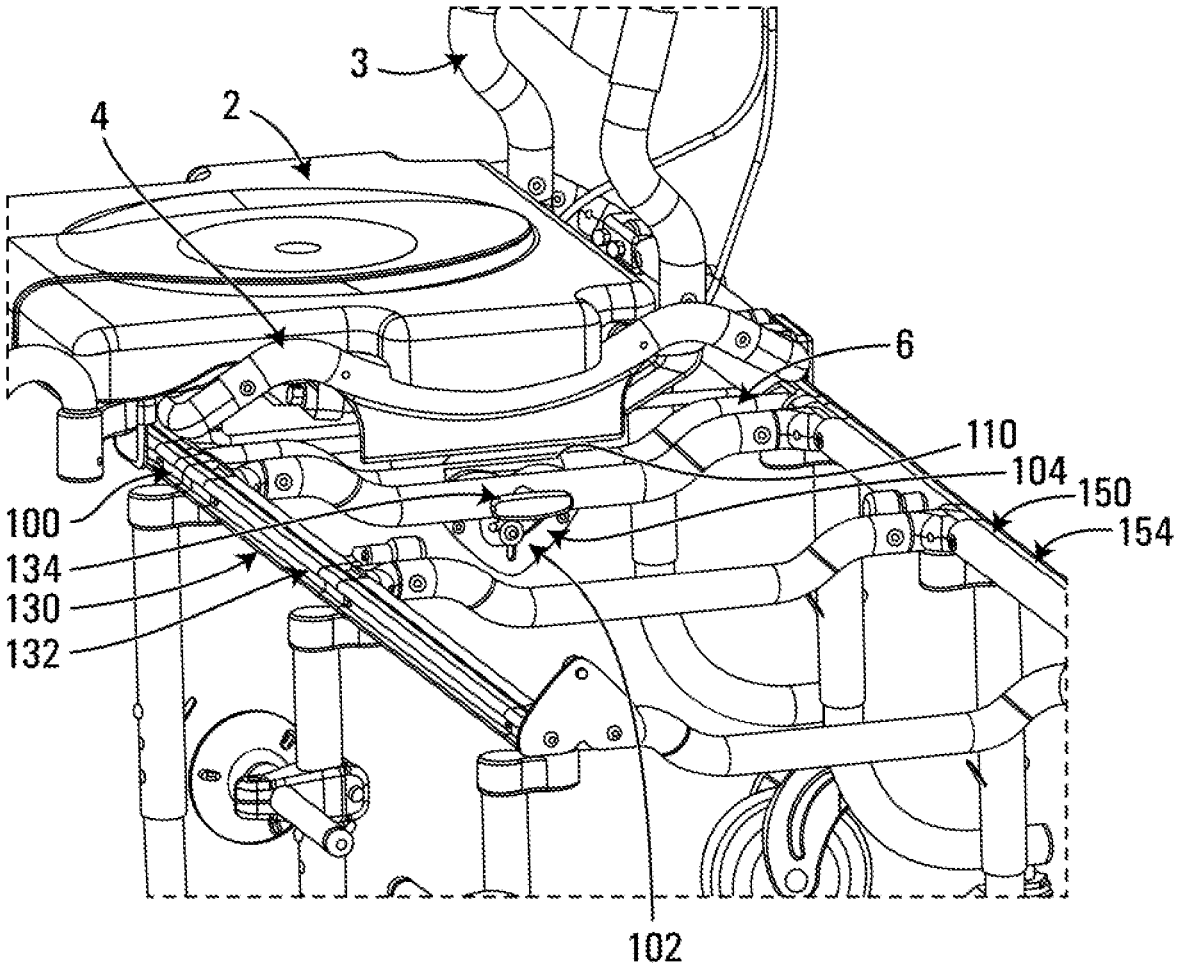
FIG. 24 is a partial side perspective view from above of the wheelchair, chair support member and bridge portion member of FIG. 14 showing the chair engagement member engaged with the bridge engagement member with the blocking member in the lowered position.
Figure 25:
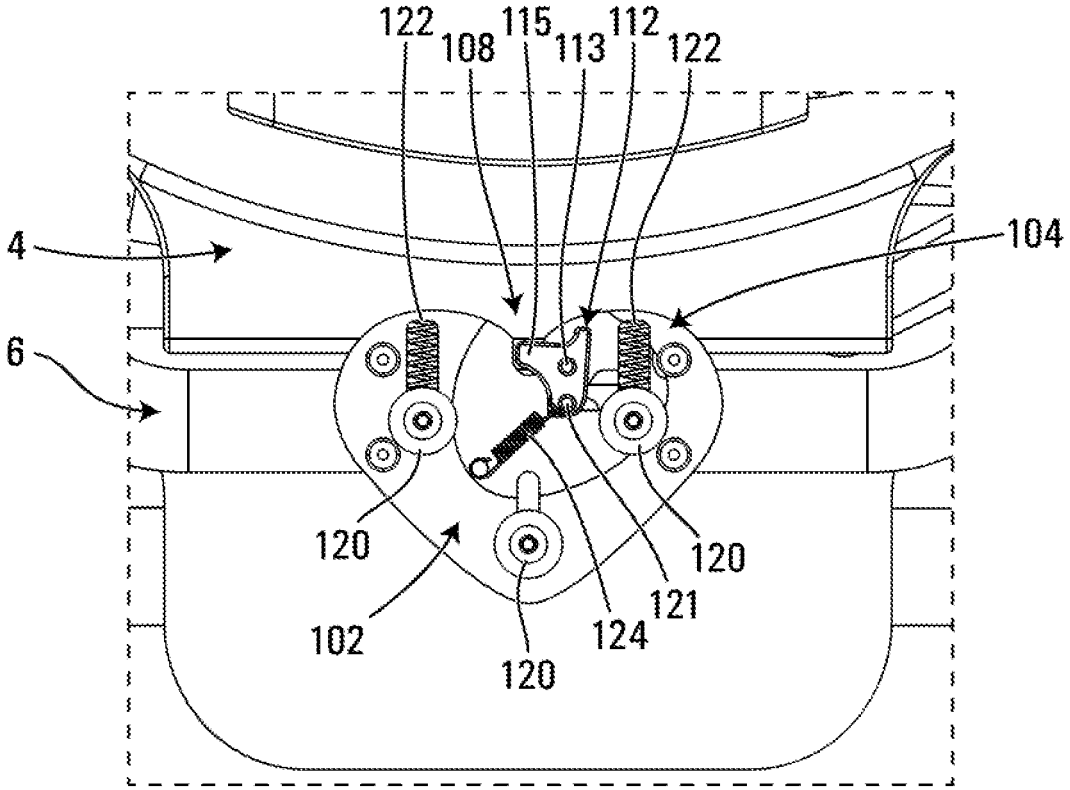
FIG. 25 is an isolation view of the bridge engagement member mounted on the wheelchair of FIG. 14 with the blocking member in a raised position in accordance with one embodiment.
Figure 26:
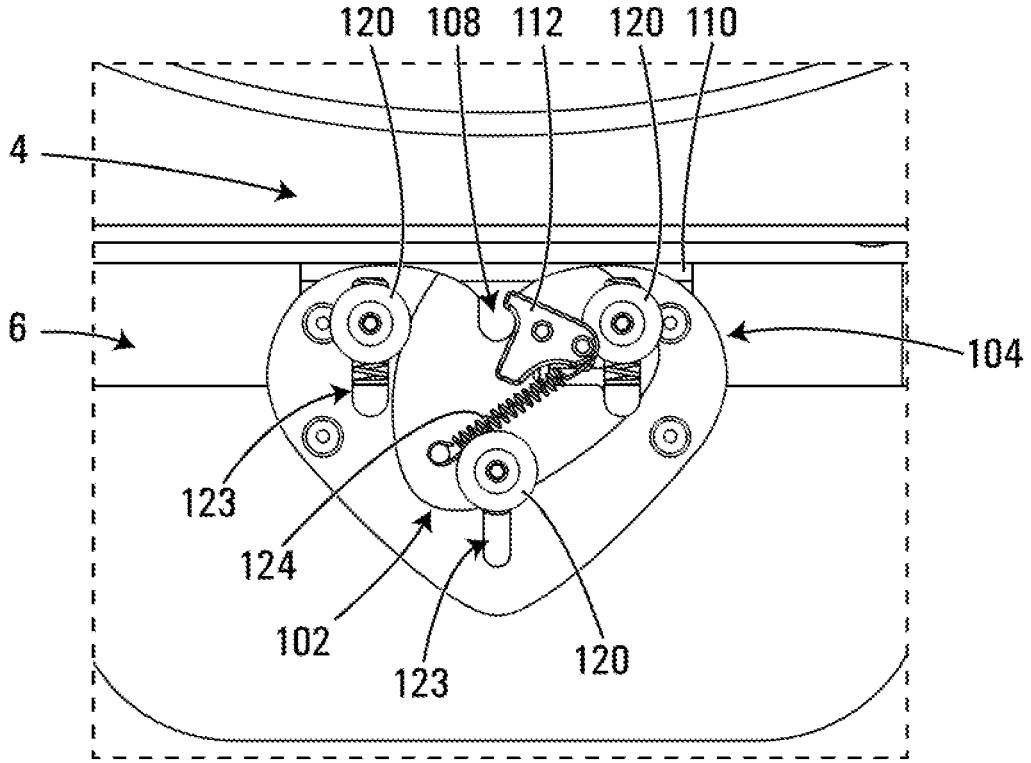
FIG. 26 is an isolation view of the bridge engagement member mounted on the wheelchair of FIG. 14 with the blocking member in the lowered position in accordance with one embodiment.
Figure 27:
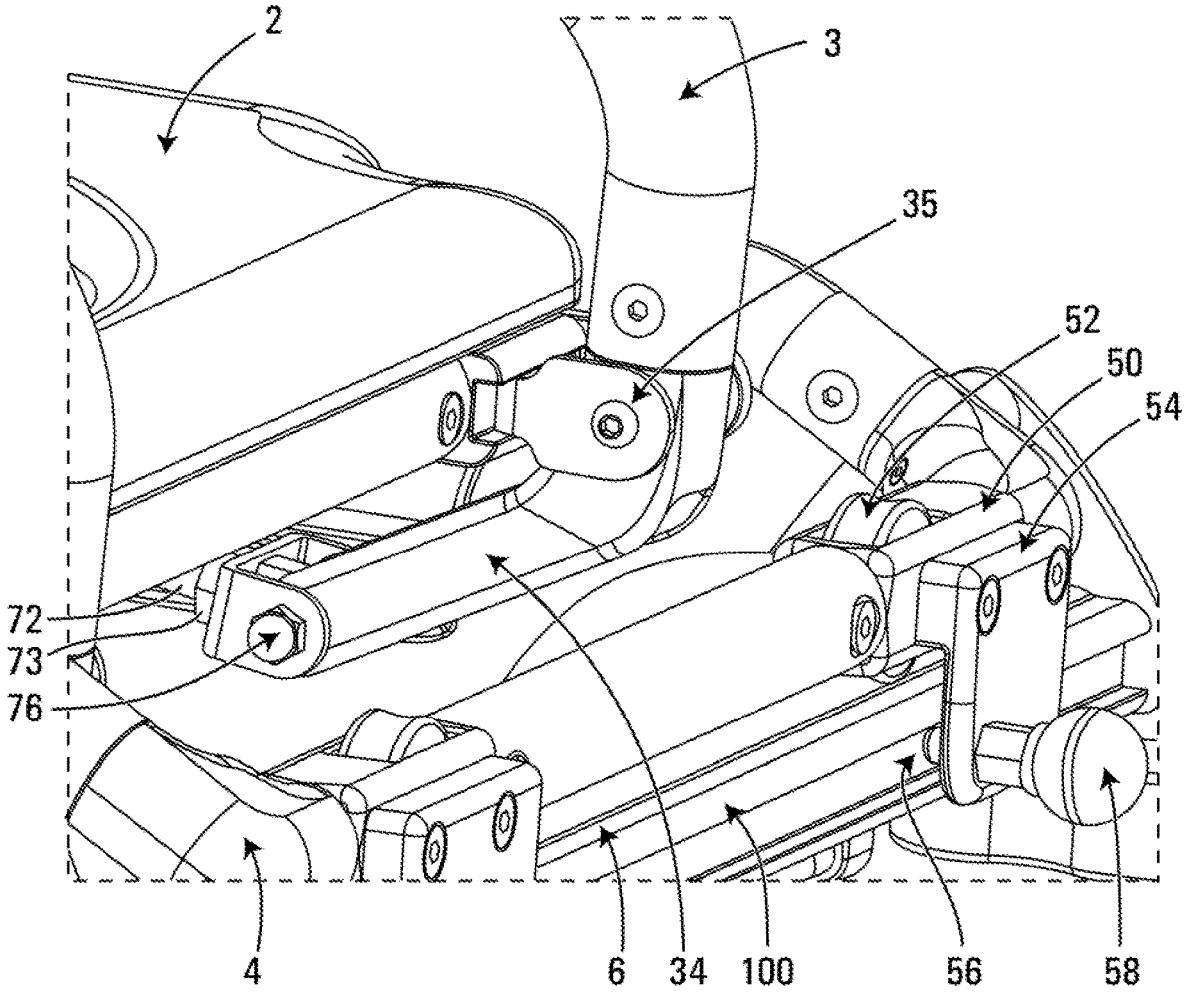
FIG. 27 is a partial perspective view of the wheelchair of FIG. 14 showing a track release member.

The blocking members 104 may be movable between a raised position (shown in FIGS. 22A, 22B, and 25) and a lowered position (shown in FIGS. 20, 24 and 26). In the raised position, the blocking members 104 can define a barrier that may prevent the chair seat 2 from translating off the wheelchair track section 102. In general, in the raised position the blocking member 104 may also prevent the chair seat 2 from transitioning between the wheelchair track section 102 and the bridge track section 132. In the lowered position, the blocking member 104 may be recessed. The blocking member 104 may then permit the chair seat 2 to translate along the bridge track section 132.

In some examples, the blocking member 104 can be moved from the raised position to the lowered position automatically as the bridge portion 130 engages the wheelchair base 6. As the bridge portion 130 is moved to the in-use position and engaged with the wheelchair base 6, the blocking member 104 can be automatically recessed. As a result, the chair seat 2 can be translated along the bridge track section 132 when the bridge portion engages the wheelchair base 6.

For example, the blocking member 104 may be caused to move from the raised position to the lowered position by the chair engagement member 102 engaging with the bridge engagement member 132. The bridge engagement member 132 may push the blocking member 104 to the lowered position as it engages with the chair engagement member 102.

In the example illustrated, the blocking member 104 is provided by the bridge engagement member 102 (see FIGS. 22-26). Alternatively, the blocking member 104 may be independent of the bridge engagement member 102. For example, the blocking member 104 may be provided by the wheelchair base 6.

Figure 22A:
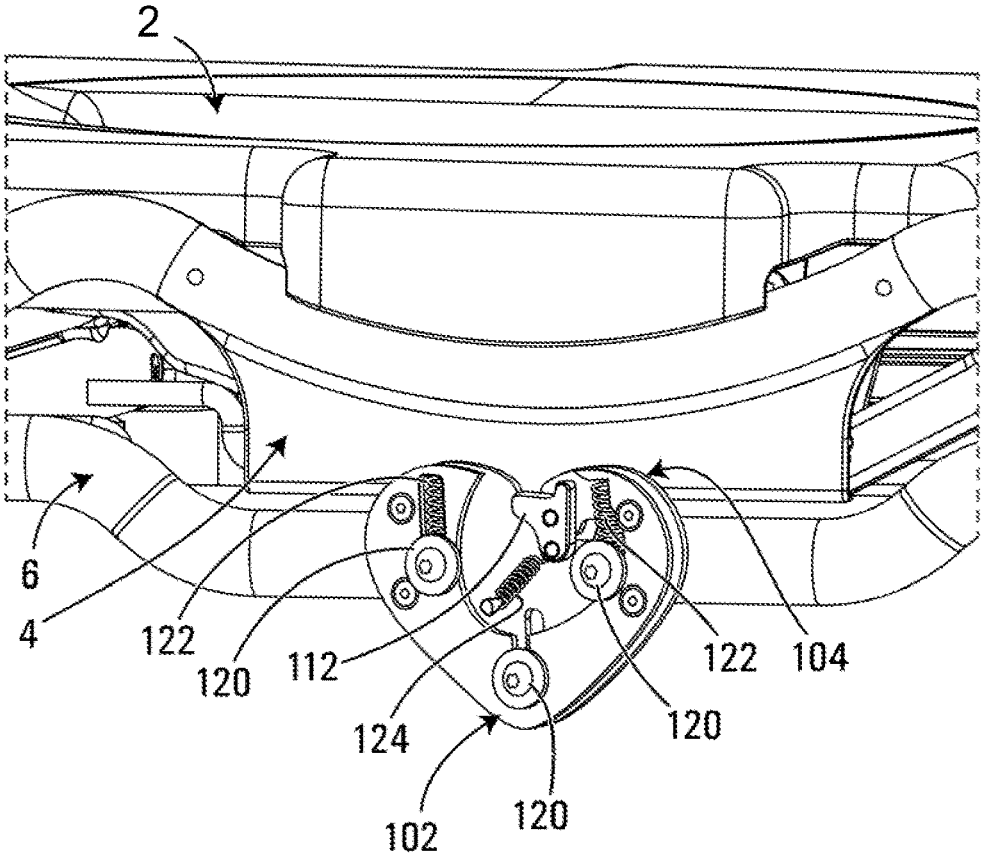
FIG. 22A is a partial perspective view of the wheelchair of FIG. 14 showing a bridge engagement member mounted on the wheelchair with a blocking member of the bridge engagement member in a raised position in accordance with one embodiment.
Figure 22B:
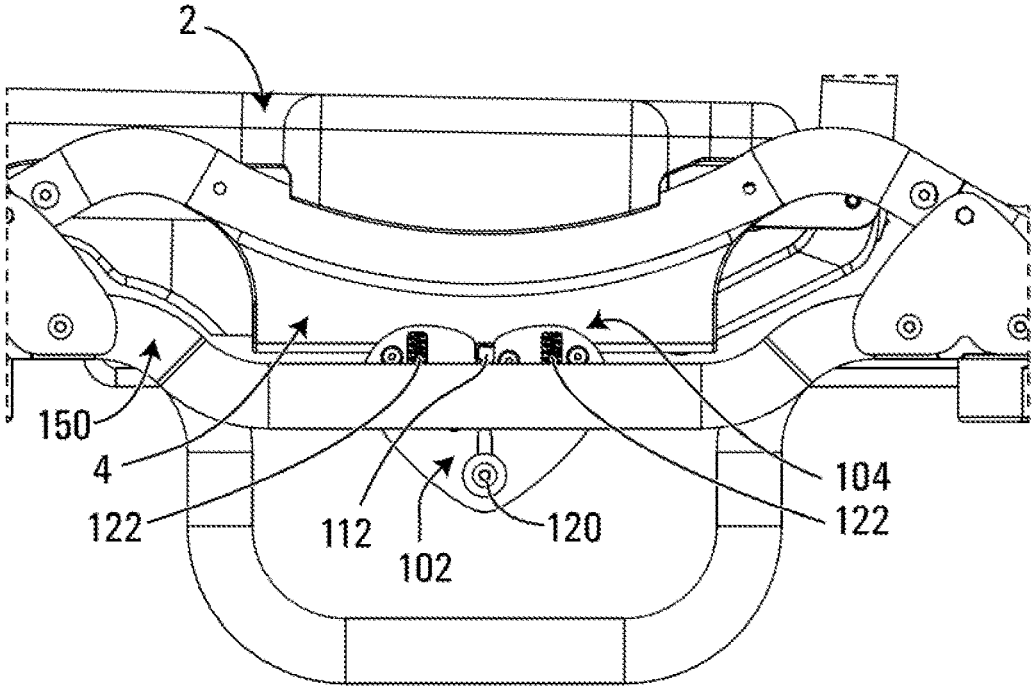
FIG. 22B is a side view of the wheelchair and chair support member of FIG. 22A showing the bridge engagement member mounted on the wheelchair with the blocking member in the raised position.

In the example illustrated, when the bridge engagement member 102 is not engaged by the chair engagement member 132, the blocking member 104 is raised (see e.g. FIGS. 22A and 22B). As the chair engagement member 132 engages with the bridge engagement member 102 (see e.g. FIGS. 23*a*, 23*b* and 24), the blocking member 104 is moved to the lowered position.

The bridge engagement member 102 can include a mount 110. The mount 110 can be used to fixedly secure the bridge engagement member 102 to the wheelchair base 6. The blocking member 104 can be movably mounted to the mount 110. Alternatively, the blocking member 104 may be movable mounted to the wheelchair base 6 directly.

In the example illustrated, mounting coupling members 120 are used to mount the blocking member 104 to the mount 110 (see FIGS. 25 and 26). The coupling members 120 provide a movable mounting between the blocking member 104 and the mount 110. This allows the blocking member 104 to transition between the raised position and the lowered position.

In the example illustrated, the blocking member 104 includes a gap or section 123 along which each coupling member 120 is movable. The coupling members 120 move within the gap 123 to transition the blocking member 104 between the raised position and the lowered position.

In some examples, the blocking member 104 can be biased to the raised position. This may ensure that the blocking member 104 prevents the chair seat 2 from moving off the wheelchair track section 100 unwanted.

Alternatively, the blocking member 104 may not be biased to the raised position. For example, the blocking member 104 may be manually adjustable between the raised position and lowered position.

In some examples, springs may be used to bias the blocking member 104 to the raised position. The springs may be in a reduced tension state when the blocking member 104 is in the raised position. When the blocking member 104 transitions to the lowered position, the springs may be moved to a state of increased tension. As a result, the springs may tend to bias the blocking member 104 to the raised position.

In the example illustrated, the bridge engagement member 102 includes the blocking member 104 and biasing springs 122 (see FIGS. 22-26). Alternatively, as mentioned above, the blocking member 104 may be mounted directly to the wheelchair base 6. In such embodiments, the biasing springs may be provided by the blocking member 104.

The biasing springs 122 are connected to the blocking member 104 and the coupling members 120. The biasing springs 122 bias the blocking member 104 to the raised position by pushing the coupling members to the lower end of the sections 123.

In some examples, a latch may be used to transition the blocking member 104 to the lowered position. The latch 112 may be pivotally mounted to the blocking member 104. The latch 112 may rotate with respect to the blocking member 104 about the pivotal connector 113. As the exposed end 115 of latch 112 is engaged and pushed downward, the latch 112 may lower the blocking member 104 from the raised position to the lowered position.

In the example illustrated, the bridge engagement member 102 includes the latch 112. The latch 112 may be positioned partially in the receiving portion 108. As the arm 136 is received in the receiving portion 108, the arm 136 can engage the exposed end 115 of latch 112. The arm 136 pushing the exposed end 115 of latch 112 may cause the latch 112 to lower the blocking member 104 from the raised position to the lowered position.

Alternatively, the latch 112 may be manually operated to lower the blocking member 104. Additionally or alternatively, the latch 112 may be provided on the wheelchair base 6 elsewhere other than the bridge engagement member 102.

In some examples, a second end 121 of the latch 112 can be attached to a spring 124. The spring 124 in turn can also be attached to the blocking member 104 below the latch 112. The tension of spring 124 can maintain the latch 112 and the blocking member 104 close together. As the exposed end of the latch 112 is engaged and moved downward, the second end 121 of the latch 112 is raised and extends the spring 124. This increases the tension in spring 124. As a result, the spring 124 may pull the blocking member 104 from the raised position to the lowered position to reduce the tension.

In the example illustrated, the arm 136 pushes downward on the exposed end 121 of latch 112 as it is received by the receiving portion 108 (see FIGS. 23A and 23B). The second end 121 of latch 112 can in turn extend spring 124 (see FIGS. 25 and 26). The spring 124 is tensed as a result and pulls on the blocking member 104 to lower it to reduce the tension. This can cause the blocking member 104 to move to the lowered position.

When the bridge portion 130 is disengaged from the wheelchair base 6, the arm 136 can be raised out of the receiving portion 108. The latch 112 may now be free to return to its original position with spring 124 in a less tensed position (see FIG. 25). The biasing springs 122 may then push the blocking member 104 back to the raised position.

The tension of the biasing springs 122 and spring 124 can be selected to permit the blocking member 104 to be biased to the raised position and then lowered as latch 112 is engaged.

When the bridge portion 130 is engaged with the wheelchair base 6, the bridge track section 132 and the wheelchair track section 100 can be aligned. The bridge track section 132 and wheelchair track section 100 can then define a continuous track.

When the bridge portion 130 is in the in-use position and engaged with the wheelchair base 6, the wheelchair track section 100, bridge track section 132 and chair support track section 154 can be aligned. This can provide a continuous chair transfer track from the wheelchair base 6 to the chair support member 150. The chair seat 2 may be moved along the continuous chair transfer track to transition from being supported by the wheelchair base 6 to being supported by the chair support member 150 or vice versa.

Figure 19:
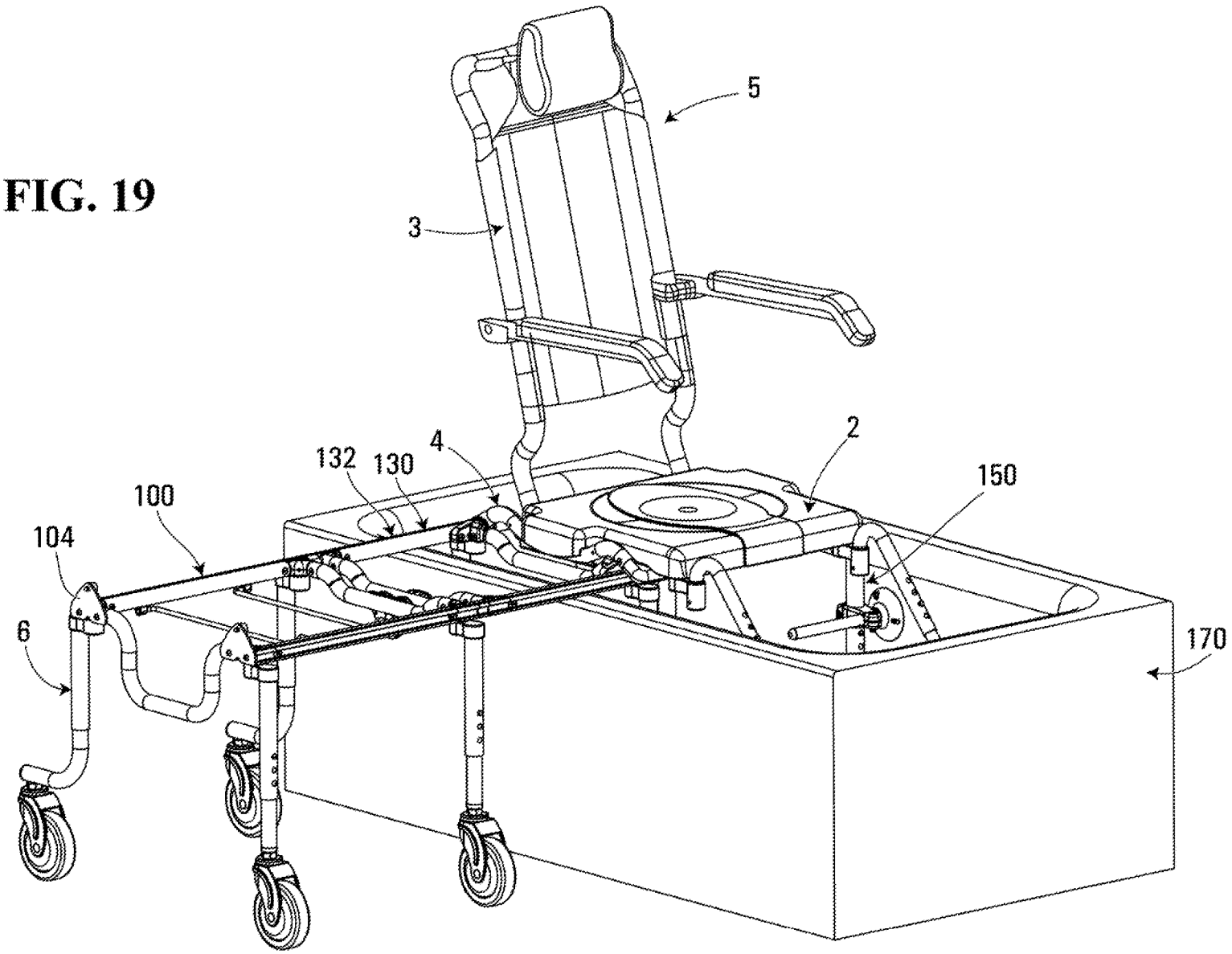
FIG. 19 is a perspective view of the wheelchair, chair support member and bridge portion member of FIG. 14 with the bridge portion member in the in-use position, the chair support member positioned in a base of a washing enclosure and the chair seat supported by the chair support member and the seat back in the upright position.
Figure 21:
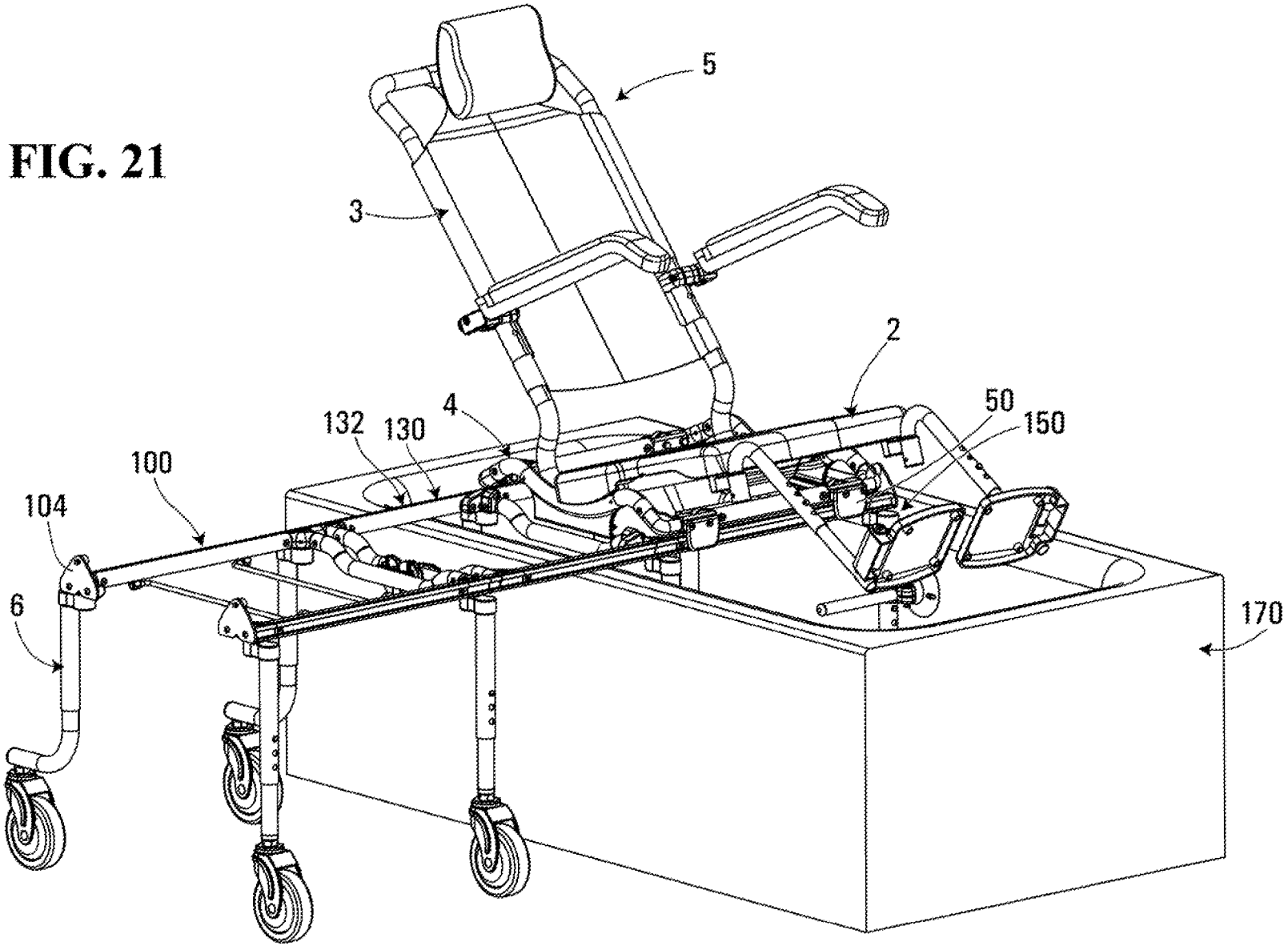
FIG. 21 is a perspective view of the wheelchair, chair support member and bridge portion member of FIG. 14 with the bridge portion member in the in-use position, the chair support member positioned in a base of a washing enclosure and the chair seat supported by the chair support member and the seat and seat back in the fully inclined position.

The chair support member 150 can be positioned in the base 170 of a washing enclosure as shown FIGS. 19 and 21. The chair support member 150 can support the chair seat 2 above the base 170 of the washing enclosure. This can facilitate bathing a person seated in the chair seat 2 using the washing enclosure.

The chair support member 150 may be of any design that provides a support for receiving the chair seat 2. As exemplified, the chair support member 150 has a plurality of legs 156 that extend to the floor of the washing enclosure base 170. Each leg 156 may have a support member foot 158 positionable on the floor of the washing enclosure base 170. Any chair support member 150 known in the art may be used.

The feet 158 may be manufactured to provide traction in the base 170 while a person is bathing. For example, the feet 158 may have rubber tips or soles to provide stability while bathing. In some examples, the feet 158 may also include soles/tips with suction cups to secure the chair support member 150 to the base 170. Alternatively, the feet 158 may be of any other suitable configuration known in the bathing chair arts.

In some examples, the legs 156 may be adjustable. For example, the legs 156 may be extended or retracted to adjust the height of the chair support member 150. This may allow the height of the chair support member 150 to be adjusted to align with the height of wheelchair 1. This may also allow the height of the chair support member 150 to be adjusted to account for the height of the sides of the washing enclosure.

The chair support member 150 can also include stabilizing members 160. For example, the stabilizing members 160 may brace the chair support member 150 against the sides of the washing enclosure. As shown in the example illustrated, the stabilizing member 160 may extend from the chair legs 156.

The distal ends or tips of the stabilizing members 160 can be manufactured to provide traction against the sides of the washing enclosure when wet, e.g. during bathing. For example, the distal ends of the stabilizing members 160 may include suction members that can be secured to the sides of the washing enclosure.

The upper end 152 of the chair support member 150 can receive and support the chair seat 2. Thus, a person in the support chair 5 can be supported within a washing enclosure on the chair support member 150. This may also allow the support chair 5 to be positioned at a height that facilitates assisted bathing.

The chair support member 150 may include one or more blocking members 164 to prevent the chair seat 2 from moving off the end of the chair support member 150. The blocking members 164 may be similar to blocking members 104 on the wheelchair base 6. The blocking members 164 may define a barrier that prevents the chair seat 2 from sliding off the end of the chair support track section 154.

As mentioned, the chair seat 2 can be movably mounted to the wheelchair track section 100, bridge track section 132, and/or chair support track section 154) using mounting portions 50. The mounting portions 50 may include seat translation members movably connecting the chair seat 2 to the track section.

The mounting portions 50 on seat frame 4 may include translation members that are laterally moveable with respect to the wheelchair base 6 and/or chair support member 150. The translation members can be used to move the support chair 5 along track sections defined by the wheelchair base 6, bridge portion 130 and chair support member 150. The translation members can be provided on both the front and rear of the seat frame 4.

The mounting portions 50 may include one or more rollers. In the example illustrated, the mounting portions 50 include rollers 52 (See FIG. 10). The rollers 52 may be movable along a track provided on the wheelchair base 6 or other support members, such as the bridge portion 130 and/or chair support member 150. The rollers 52 can be used to roll the chair seat 2 along the track section more easily.

Alternatively, the seat translation members may be of any other suitable configuration allowing the chairs seat 2 to translate along the track sections, including, for example a configuration in which the seat translation members are slideable along the track section.

The mounting portions 50 may also include one or more securing members 54. The securing members 54 can secure the support chair 5 on the support members, such as the wheelchair base 6, bridge portion 130 and/or chair support member 150. The securing members 54 may securably mount the seat frame 4 to a track defined by the support member. The securing members 54 can maintain the support chair 5 mounted on the support members while still permitting lateral movement with respect to the support members.

The securing members 54 can include one or more extending arms 55. The arms 55 may be received by a groove 101 defined by the side of the track (See FIGS. 13 and 14). In some examples, the groove 101 may also prevent the chair seat 2 from sliding off the wheelchair base 6 and/or chair support member 150 by including stops at either end of the track. Thus, the ends of the groove 101 may engage the securing members 54 to prevent the chair seat 2 from sliding off the track.

In some examples, the bath transfer apparatus may include a chair seat locking member 56. The chair seat locking member 56 may lockably secure the chair seat 2 in position along the track. This may prevent the seat 2 from moving along the track accidentally/unintentionally.

The chair seat locking member 56 may be moveable between a locked position, in which the chair seat 2 is prevented from translating along the track, and an unlocked position in which the chair seat 2 is enabled to translate along the track. When the locking member 56 is in the locked position the chair seat 2 may be fixed in position on the track. When the locking member 56 is in the unlocked position the chair seat 2 may be laterally movable on the track.

In some examples, the chair seat locking member 56 may be manually operable. This may provide increased control to an operator of the transfer apparatus.

Alternatively, the chair seat locking member 56 may be automatically moved between the locked and unlocked positions. For example, the chair seat locking member 56 may move between the locked and unlocked positions as the bridge portion 130 engages and disengages the wheelchair base 6. This may reduce the steps required for an operator to move the chair seat 2 along the track sections.

The transfer apparatus may include a release member 58. The release member 58 may be used to move the chair seat locking member 56 between the locked and unlocked positions. In some examples, the release member 58 may be manually actuated to move the chair seat locking member 56 between the locked and unlocked positions. Alternatively, the chair seat locking member may be automatically movable from the locked position to the unlocking position, for example when the bridge portion 130 moves to the in-use position and engages the wheelchair 1.

In some examples, the chair seat locking member 56 may be biased to the locked position. This may ensure that a user actively actuates the release member 56 in order to translate the chair seat 2 along the track.

Alternatively, the chair seat locking member 56 may not be biased to either the locked or unlocked position. The release member 58 may be used to move the chair seat locking member 56 into either the locked or unlocked position. This may allow an operator to unlock the chair seat locking member 56 and then use both hands to move the chair seat 2 along the track.

It will also be appreciated that, in some other embodiments, the wheelchair 1 may only use the reclining feature disclosed herein. In such alternate embodiments, the support chair need not be moveable away from the wheelchair base 6 but may be of a standard design.

In some other embodiments, the support chair 5 may be non-removable (e.g., fixed to) chair support member 50 and may therefore only use the reclining feature disclosed herein.

It will also be appreciated that the blocking member feature disclosed herein may be used with any track system that is used to transfer a person from one location to another.

Bridge Lock for a Seat Transfer Apparatus

The following is a general description of a bridge locking mechanism for a transfer apparatus for a chair seat of a wheelchair and/or other support chair and other features set out herein that may be used by itself or in combination with one or more embodiments disclosed herein, including a tilting mechanism for a chair and a transfer apparatus for a chair seat. The following description contains various features of a bridge locking mechanism which may be used individually or in any combination or sub-combination.

Referring to FIGS. 30-40, the transfer apparatus may include one or more locks usable to secure the bridge portion 130 to the wheelchair 1. When the bridge portion 130 is moved (e.g. rotated) from a detached position, e.g. a storage position, (i.e. a position detached from the wheelchair 1 as exemplified in FIG. 16) to the in-use position engaged with the wheelchair 1 as exemplified in FIG. 17, the one or more locks can be engaged to inhibit separation of the bridge portion 130 and wheelchair 1.

Figure 37:
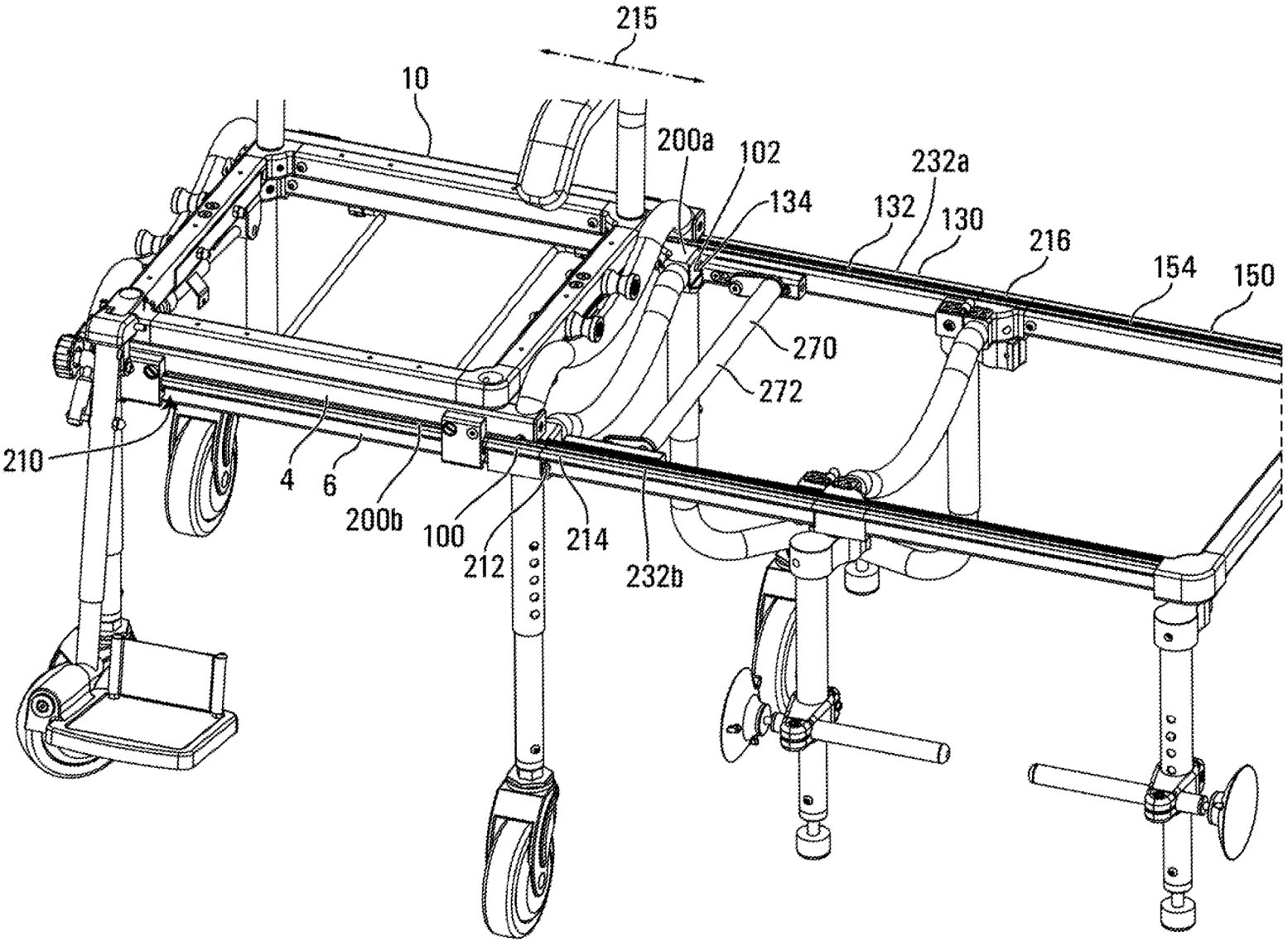
FIG. 37 is a top perspective view of the wheelchair and the bridge portion member of FIG. 34 and a chair support member with the bridge portion member in the in-use position in accordance with one embodiment.

As shown in FIG. 37, the wheelchair track 100 and bridge track section 132 extend in a longitudinal direction 215. The wheelchair track section 100 extends between a first section end 210 and a second section end 212 and the bridge track section 132 extends in the longitudinal direction 215 between a first bridge section end 214 (proximate outer end 133) and a second bridge section end 216 (proximate inner end 131).

When the bridge portion 130 is moved to the in-use position and engaged with wheelchair 1 (as shown in FIG. 37), the second section end 212 can be aligned with the first bridge section end 214. The chair seat 2 can thus translate from the wheelchair base 6 along the bridge track section 132 to the chair support track section 154 in the longitudinal direction 215.

The transfer apparatus may include a first lock that is usable to inhibit rotational motion of the bridge portion 132 to the detached or storage position. The first lock can be adjusted between a locked position and an unlocked position. In the locked position, the first lock can inhibit the rotational motion of the bridge portion 130. In the unlocked position, the first lock may no longer inhibit rotational motion of the bridge portion 130.

The first lock may include corresponding locking members provided on the bridge portion 130 and wheelchair 1 that engage one another to inhibit the rotational motion of the bridge portion 130. The locking members may be any members that are lockingly securable together, e.g. mateable connectors.

In the example illustrated in FIGS. 30-40, the locking members of the first lock can include bridge engagement member 102 and chair engagement member 134. When secured together, the bridge engagement member 102 and chair engagement member 134 can prevent the bridge portion 130 from rotating to the detached or storage position. This can define the locked position of the first lock (see e.g. FIG. 36).

In the example illustrated, the bridge engagement member 102 and chair engagement member 134 can prevent the bridge portion 130 from moving relative to the wheelchair along any direction that lies in a plane transverse to the longitudinal direction 215. When disengaged (see e.g. FIG. 37), the bridge engagement member 102 and chair engagement member 134 may permit the bridge portion 130 to rotate to the detached position. This can define the unlocked position of the first lock.

As shown, the chair engagement member 134 (provided on the bridge portion 130) includes an extendable locking member 234. The bridge engagement member 102 (provided on the wheelchair 1) includes a recess 202 corresponding to the locking member 234. Alternately, the retractable locking member may be provided on the wheelchair 1 and the recess may be provided by the bridge portion 130. The recess 202 can be shaped to receive the locking member 234.

Figure 39:
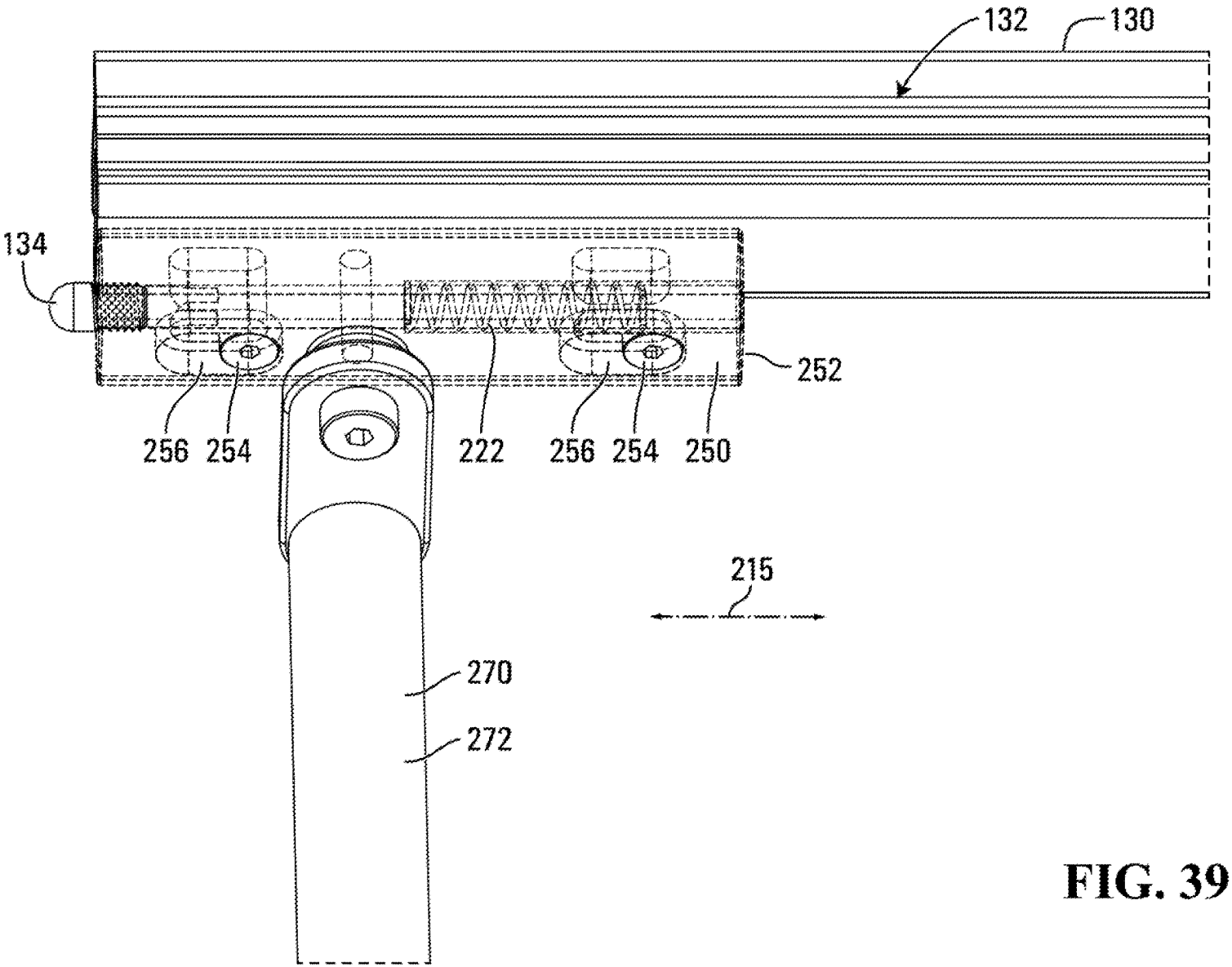
FIG. 39 is a top perspective view of the bridge locking member of FIG. 38 in accordance with one embodiment; and, FIG. 40 is a top perspective view of the bridge locking member of FIG. 38 with the bridge locking member in an unlocked position in accordance with one embodiment.
Figure 40:
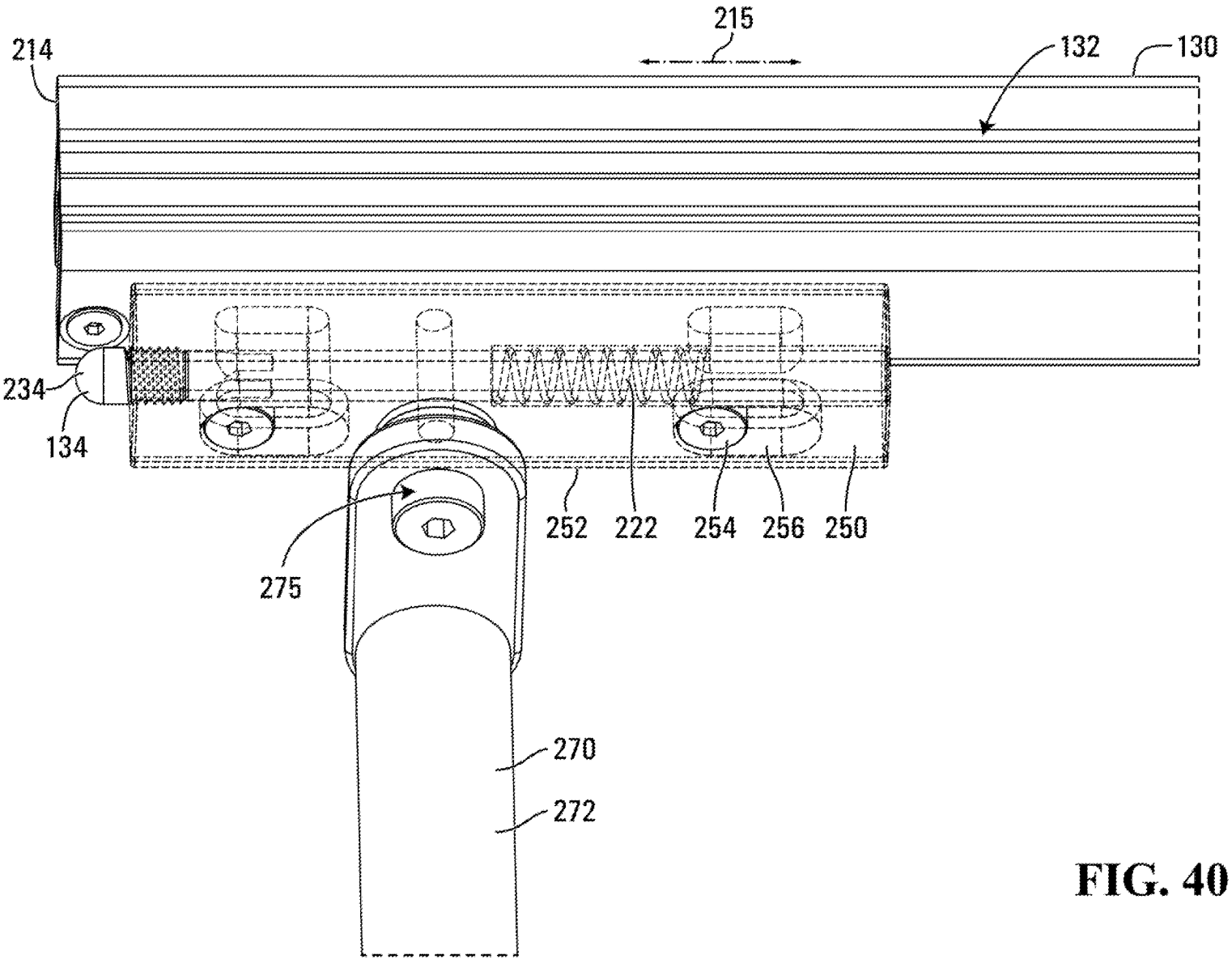

The locking member 234 can be adjusted between an extended position (see e.g. FIGS. 35 and 39) and a retracted position (see e.g. FIGS. 37 and 40). When the bridge portion 130 is lowered, the locking member 234 may extend longitudinally towards the wheelchair 1. With the bridge portion 130 lowered, the retractable locking member 234 can be positioned in the extended position and within the recess 202. In this position, the locking member 234 and recess 202 cooperate to inhibit rotational motion of the bridge portion 130 to the detached position.

Figure 38:
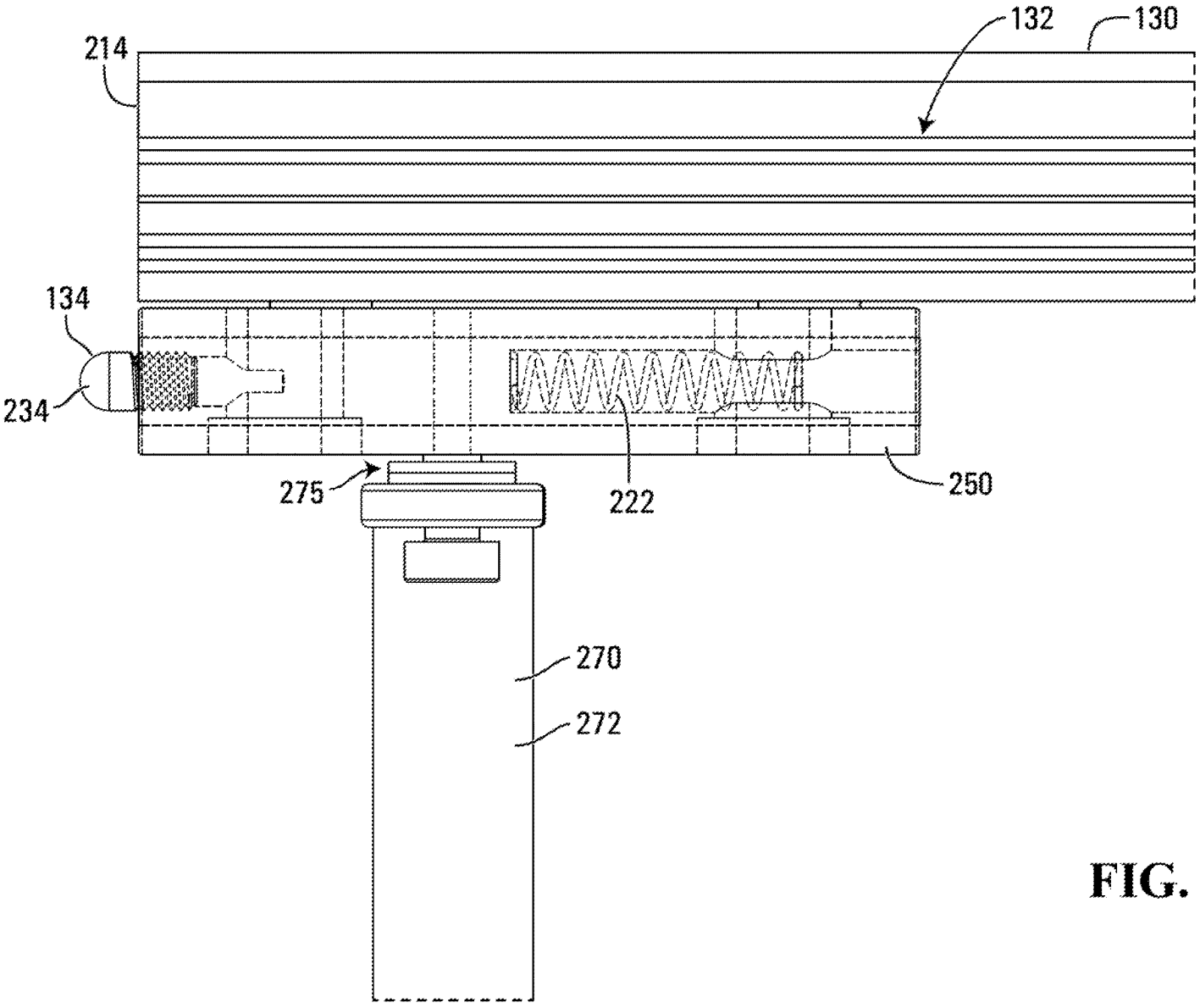
FIG. 38 is an top view of a bridge locking member of the bridge portion member of FIG. 30 with the bridge locking member in a locked position and a bridge lock housing omitted in accordance with one embodiment.

As shown in FIG. 38, the locking member 234 may extend longitudinally beyond the first bridge end 214 when in the extended position. Alternately, the locking member 234 may not extend beyond the first bridge end 214. For example, the locking member 234 may engage a recess that extends or projects outward beyond the second end 212 of the wheelchair track section 100.

The retracted position (see e.g. FIG. 40) can be spaced apart from the extended position (see e.g. FIG. 39) in the longitudinal direction 215. In the retracted position, the locking member 234 can be positioned closer to the second bridge section end 216 than in the extended position.

The first lock may be configured to lock automatically when the bridge portion 130 and wheelchair 1 are engaged. When the bridge portion 130 is moved to the in-use position, the first lock may be automatically adjusted to the locked position. This may facilitate use of the transfer apparatus, by maintaining the bridge portion 130 in the in-use position without requiring a user to manually operate a lock mechanism.

Alternately, the first lock may be manually adjusted to the locked position.

In the example illustrated, the retractable locking member 234 is biased to the extended position. The first lock can include a biasing member configured to bias the locking member 234 to the extended position. As a result, as the bridge portion 130 is lowered to align the retractable locking member 234 with the recess 202, the biasing member can drive the locking member 234 to extend into the recess 202. As a result, the locking member 234 and recess 202 can automatically engage when aligned.

Figure 32:
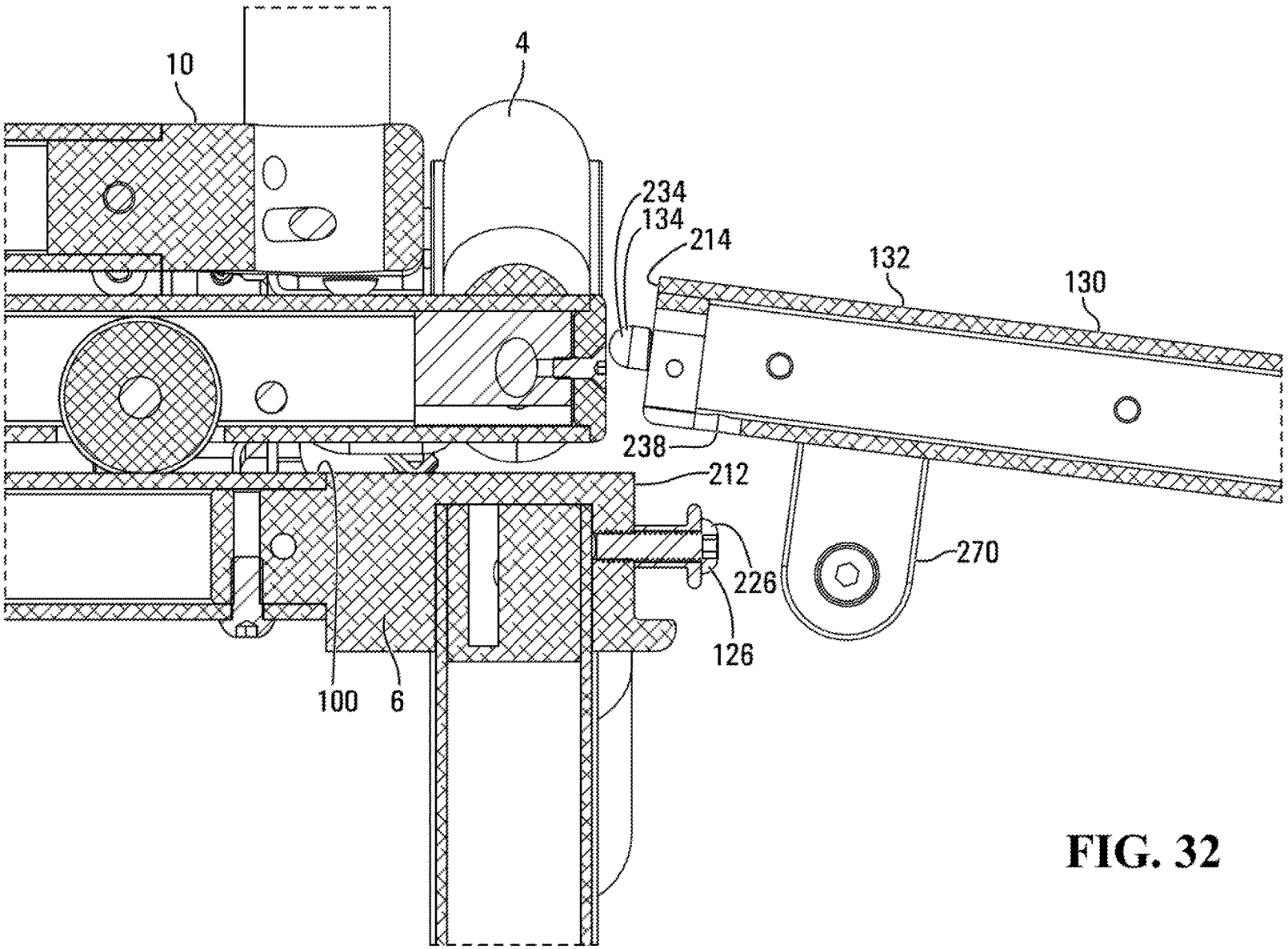
FIG. 32 is side sectional view of the wheelchair and the bridge portion member of FIG. 31 in accordance with one embodiment.
Figure 33:
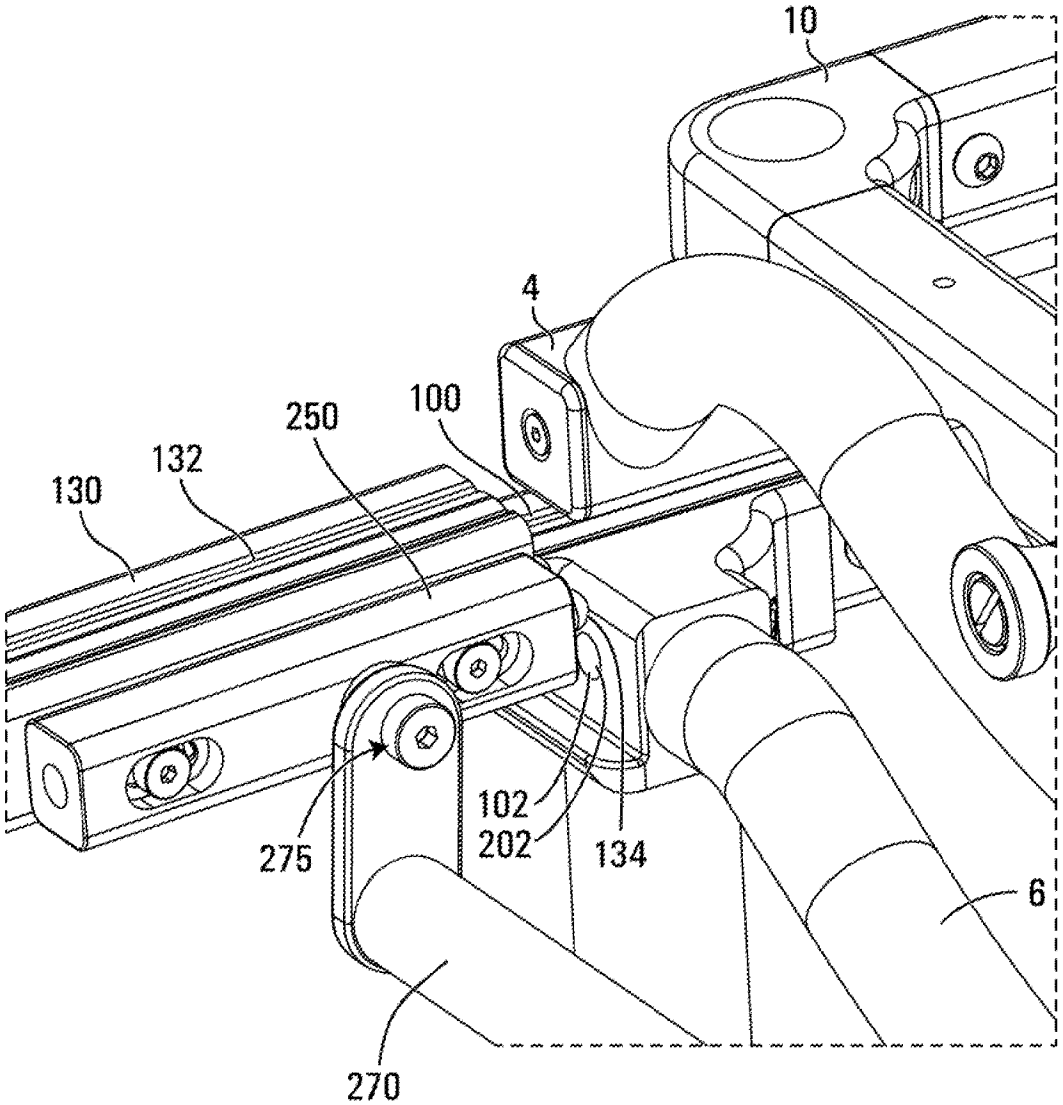
FIG. 33 is a top perspective view of the wheelchair and the bridge portion member of FIG. 31 with the bridge portion member transitioned further towards the in-use position in accordance with one embodiment.
Figure 34:
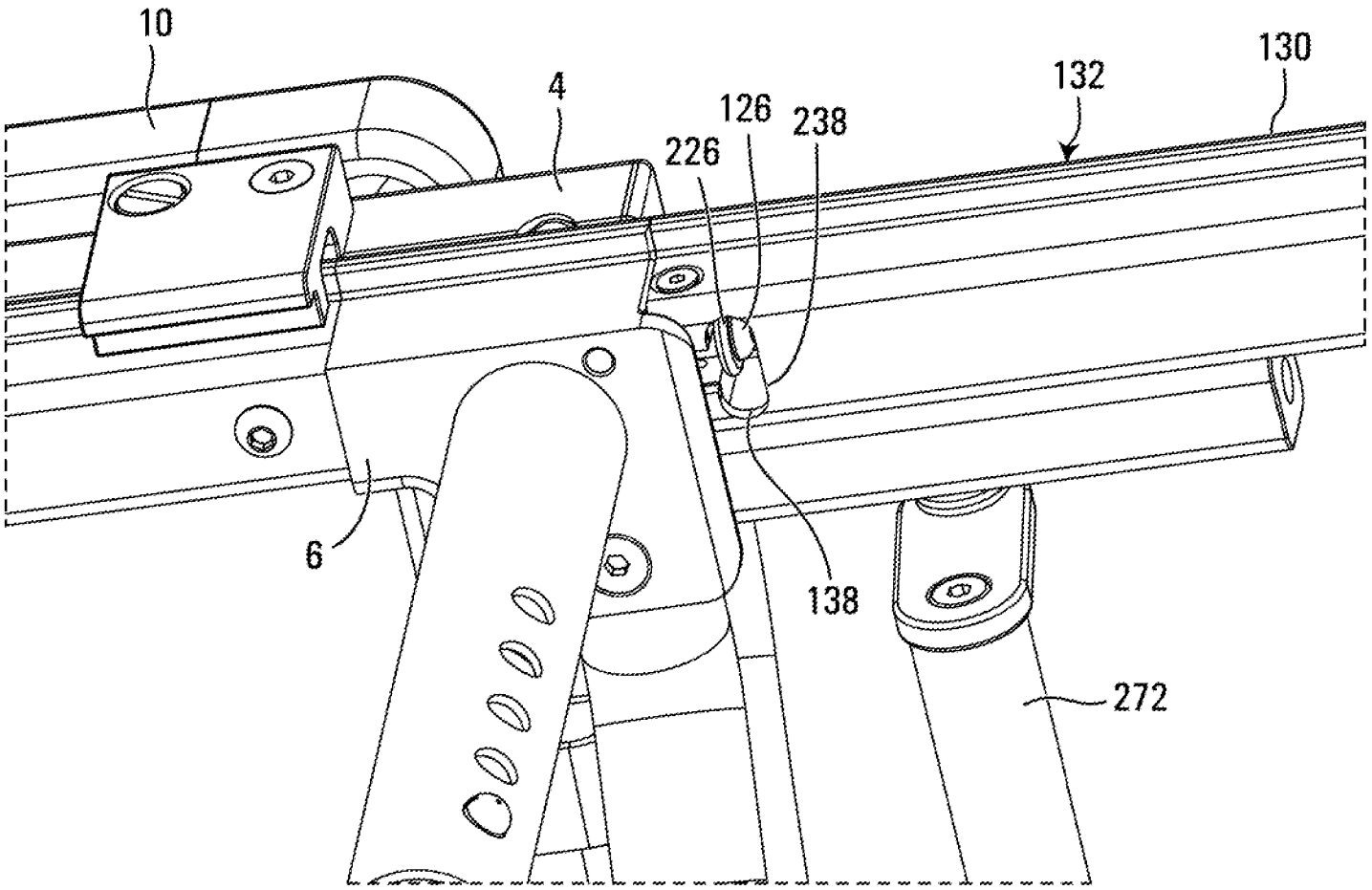
FIG. 34 is an bottom perspective view of the wheelchair and the bridge portion member of FIG. 31 with the bridge portion member in the in-use position in accordance with one embodiment.
Figure 35:
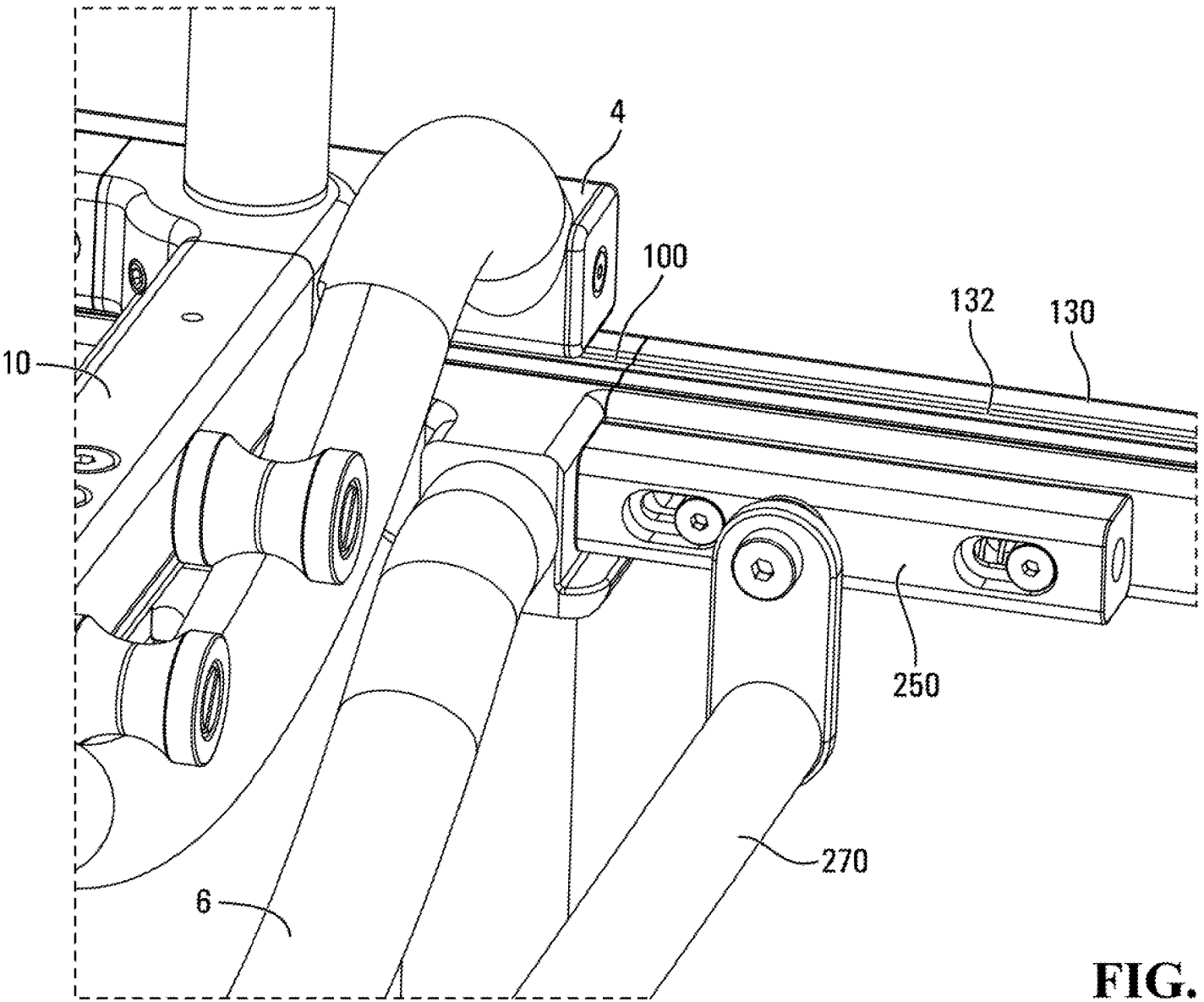
FIG. 35 is a top perspective view of the wheelchair and the bridge portion member of FIG. 34 with a bridge locking member in a locked position in accordance with one embodiment.
Figure 36:
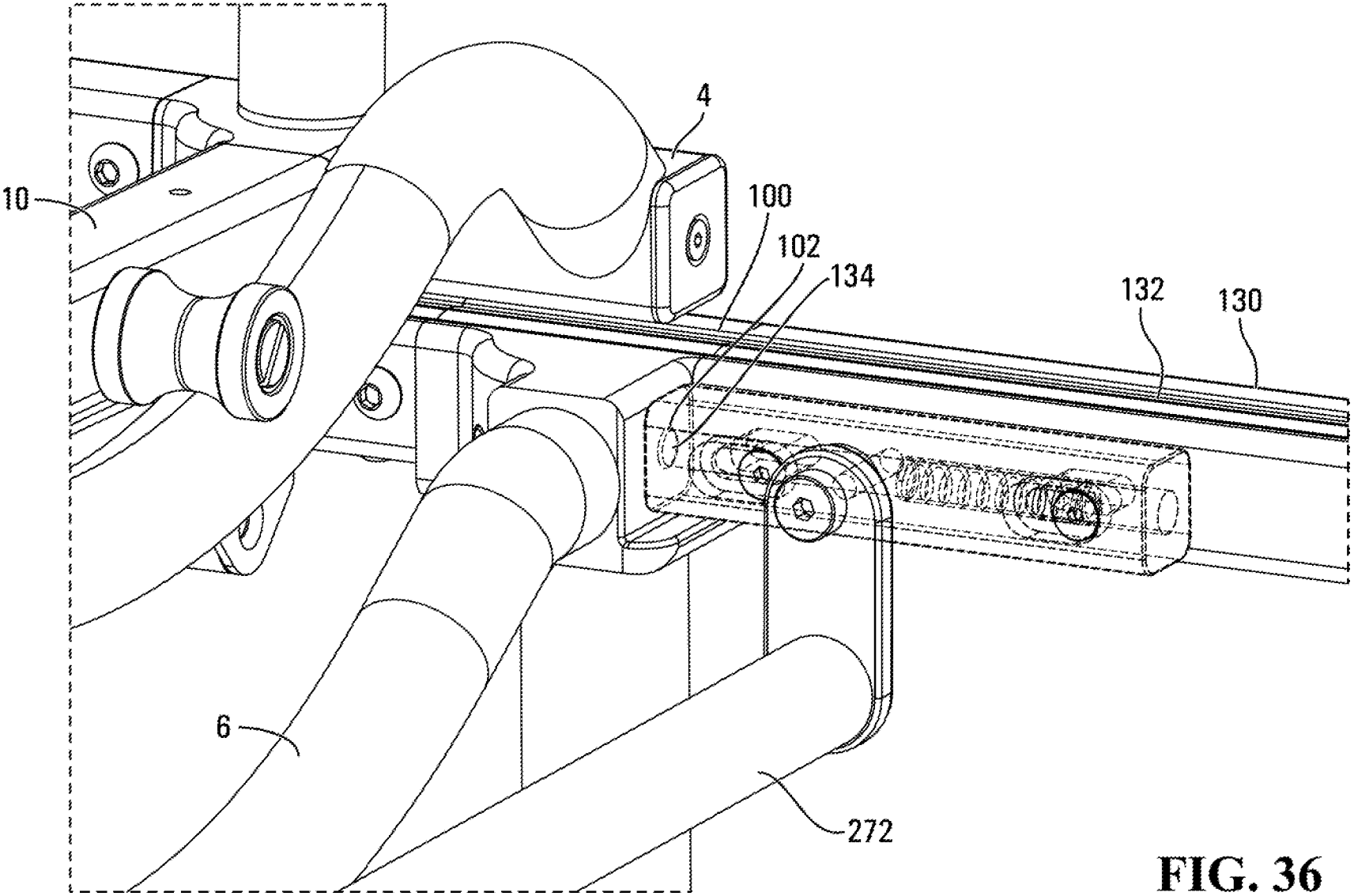
FIG. 36 is a top perspective view of the wheelchair and the bridge portion member of FIG. 34 with a bridge locking member in a locked position and a bridge lock housing omitted in accordance with one embodiment.

As shown, for example in FIGS. 32-34, as the bridge portion 130 is lowered, the locking member 234 may initially engage the wheelchair 1. The locking member 234 may be driven from the extended position towards the retracted position by this engagement with the wheelchair 1. Subsequently, upon the locking member 234 being aligned with the recess 202, the locking member 234 can automatically return to the extended position.

The locking member 234 can be movably mounted to the bridge track section 132. This mounting can allow the locking member 234 to be adjusted in the longitudinal direction 215 between the extended position and the retracted position. For example, the locking member 234 may be translatable in the longitudinal direction by itself or, as exemplified, with a housing to which the locking member 234 is mounted.

FIGS. 38-40 illustrate a mounting unit 250 that can be used to movably mount the retractable locking member 234 to the bridge track section 132. As shown, the mounting unit 250 can position the locking member 234 to extend parallel to bridge track section 132. This may allow the locking member 234 to assist with aligning the bridge track section 132 and the wheelchair track section 100.

In the example illustrated, mounting members 254 can be used to mount the locking member 234 to the bridge track section 132. The mounting members 254 may be engageable with corresponding mounting recesses or slots 256. The mounting members 254 can be movably (e.g. slideably) received within the corresponding slots 256.

As shown, the mounting slots 256 extend in the longitudinal direction 215. The mounting slots 256 can define a longitudinal translation path for the corresponding mounting members 254. The mounting members 254 can move along the longitudinal translation path to allow the retractable locking member 134 to move between the extended position and the retracted position.

In the example illustrated, the mounting members 254 are fixed to the bridge track section 132 and the slots are formed in a mounting unit housing 252. As shown, the slots 256 can be defined by gaps or recesses formed in the housing 252. Alternately, the slots 256 may be provided by the bridge track section 132 and the mounting members 254 may be provided by the housing 252. Although two pairs of mounting members 254 and slots 256 are shown, greater or fewer pairs may be used to mount the locking member 134 to the bridge track section 130.

As shown in FIG. 38, the biasing member used to bias the locking member 234 to the extended position can include one or more springs 222. The springs 222 may be in a reduced tension state when the locking member 134 is in the extended position. When the locking member 134 is moved to the retracted position, the tension in spring 222 can increased. As a result, the springs 222 may tend to bias the locking member 134 to the extended position.

The spring 222 can be positioned to contact a corresponding mounting member 254. The tension in spring 222 can bias the support member 254 towards the second bridge section end 216, pushing the support member 254 to the rear of the corresponding slot 256 (see e.g. FIG. 39). As the support member 254 moves forward in the corresponding slot 256, the mounting member 254 can increase the tension in springs 222 and thereby the spring can bias the retractable locking member 134 to the extended position.

Optionally, a second lock to inhibit separation of the wheelchair 1 and the bridge portion 130 in the longitudinal direction 215 may be provided. Together, the first lock and second lock can lockably secure the bridge portion 130 to the wheelchair 1 in the in-use position.

The second lock may include a pair of interengaging locking members. A first locking member can be provided on wheelchair 1 and a corresponding second (interengageable) locking member can be provided on the bridge portion 130. The locking members may lockingly engage one another to secure the second lock.

In the example illustrated (see e.g. FIG. 31), the engaging locking members of the second lock can include the chair track alignment member 126 and bridge track alignment member 138. When secured together, the chair track alignment member 126 and bridge track alignment member 138 can prevent longitudinal separation of the wheelchair 1 and bridge portion 130. This can define the locked position of the first lock (see e.g. FIG. 34).

As illustrated, the chair track alignment member 126 includes an arm 226 provided by the wheelchair 1 and the bridge track alignment member 138 includes a slot 238 provided by the bridge portion 130. Alternately, the bridge track alignment member 138 may include an arm while the chair track alignment member 126 may include a slot.

The arm 226 is receivable within the slot 238. In some examples, the arm 226 may be rotatably receivable by the slot 238 (e.g., as the bridge portion is lowered to the in use position). As shown by FIGS. 31 to 34, as the bridge portion 130 is lowered the slot 238 can rotate over the arm 226 (i.e., the arm 226 is received in the slot as the slot 238 travels downwardly until the bridge portion 130 is in the in-use position). The arm 226 and slot 238 can engage one another, with the arm 226 positioned within the slot 238 when the bridge portion 130 reaches the in-use position. For example, the first bridge section end 214 may have a front wall that has a groove therein. The arm 226 extends through the groove to be received in the bridge portion 130. If a longitudinal force is applied to move the bride portion 130 away from the wheelchair 1, then arm 226 will engage the front wall, which will inhibit longitudinal movement of the bridge portion 130 away from the wheelchair 1. Accordingly, the arm 226 and slot 238 can then cooperate to inhibit separation of the bridge portion 130 and the wheelchair 1 in the longitudinal direction 215.

In some examples, when the bridge portion 130 is moved to the in-use position, both the first lock and second lock may be automatically adjusted to the corresponding locked position. This may ensure that the bridge portion 130 is automatically secured to the wheelchair 1 when moved to the in-use position.

The transfer apparatus can also include a release member 270. The release member 270 can be used to adjust the first lock and/or the second lock from a locked position (see e.g. FIGS. 44 and 39) to an unlocked position (see e.g. FIGS. 31 and 40).

The release member 270 may be manually operated by a user to adjust the position of the first lock and/or second lock. The release member 270 can include a handle 272 to facilitate locking or unlocking the bridge portion 130 to/from the wheelchair 1.

The release member 270 may be drivingly connected to the retractable locking member 234. The release member 270 can be used to translate the retractable locking member 234 from the extended position (see e.g. FIG. 36) to the retracted position (see e.g. FIG. 39). For example, a user may pull the handle 272 longitudinally towards the second end 216 of the bridge portion 130 to adjust the retractable locking member 234 to the retracted position. Accordingly, the user may use the handle 272 to overcome the biasing provided by springs 222.

Alternately or in addition, the release member 270 may be rotationally drivingly connected to the retractable locking member 234. As shown, the release member 270 can include a rotatable mounting unit 275 used to mount the release member 270 to the housing 252. Accordingly, the release member 270 may be rotatable between a locked position (see e.g. FIG. 36) and an unlocked position (see e.g. FIG. 37) in which the handle 272 has been rotated (e.g., through 80-120°). Concurrently with the release member 270 being rotated to the unlocked position, the handle 272 may be pulled longitudinally towards second end 216 whereby the release member 270 may be pulled away from the wheelchair 1, and accordingly the locking member 234 may be moved to the retracted position.

In an alternate embodiment, the release member 270 may be drivingly connected to the locking member 234 (e.g., to the mounting unit housing 252) via, e.g., a cam, to drive the locking member 234 to the unlocked position as the release member is rotated t the unlocked position. Accordingly, the release member 270 may be rotatable between a locked position (see e.g. FIG. 36) in which the retractable locking member 234 is in the extended position and an unlocked position (see e.g. FIG. 37) in which the release member 270 has driven the retractable locking member 234 to the retracted position.

The release member 270 may also be used to disengage the engageable locking members 126 and 138 of the second lock. For example, when the retractable locking member 234 is in the retracted position the release member 270 may be used to separate the slot 238 from the arm 226, e.g. by lifting handle 272 to thereby raise the bridge portion 130, e.g., to the detached position.

Accordingly, it will be appreciated that the release member 270 may be usable to concurrently adjust the first lock unit and the second lock unit. For example, a user may rotate or pull on the release member 270 to unlock the first lock while concurrently raising the handle 272 to disengage the second lock.

In some examples, only one of the first and second lock may have independently moving components. For instance, in the example illustrated in FIGS. 30-40, the first lock includes a movable locking member 234 while the components of the second lock (e.g. the chair track alignment member 126 and bridge track alignment member 138) are fixedly mounted.

That is, the chair track alignment member 126 is fixed to the wheelchair 1 (e.g. fixedly mounted to wheelchair base 6 or formed integrally with the wheelchair base 6) and the bridge track alignment member 138 is fixed to the bridge track section 132 (e.g. fixedly mounted to the bridge track section 132 or formed integrally with the bridge track section 132 or other components of bridge portion 130). This may reduce the number of moving parts used to secure the bridge portion 130 to the wheelchair 1, which may simplify manufacturing and reduce part failure.

As shown, the first lock includes a movable locking member 234 provided by the bridge portion. Alternately, a movable locking member may be mounted on the wheelchair 1, such as the receiving portion 108 provided by the movable blocking member 104 shown in FIGS. 20-26.

Optionally, as exemplified, the transfer apparatus may include a lock system for each rail of the chair seat track. As shown, the wheelchair track section 100 includes first and second parallel wheelchair track elements 200*a* and 200*b*. The bridge track section 132 also includes corresponding first and second parallel bridge track elements 232*a* and 232*b*. When the bridge 130 is moved to the in-use position, the first parallel bridge track element 232*a* can be aligned with the first parallel wheelchair track element 200*a* to define a first pair of combined track elements and the second parallel bridge track element 232*b* can be aligned with the second parallel wheelchair track element 200*b* to define a second pair of combined track elements.

A separate lock unit may be provided to secure each pair of combined track elements and thereby secure the bridge portion 130 to the wheelchair 1 in the in-use position. Each lock unit may include a first lock (e.g. with a retractable locking member 234 and corresponding recess) and a second lock (e.g. with an arm 226 and corresponding slot 138). This may ensure that each pair of track elements is secured together to provide a continuous track along which the chair seat can be moved.

Alternately, a single lock unit may be used to secure both pairs of track elements. For example, a centrally positioned locking unit may be used to secure both pairs of track elements.

Alternately, two second lock units may be provided to prevent longitudinal separation of the pairs of track elements (each pair of track elements may have a second lock as exemplified) and only a single first lock unit that inhibits rotational movement of the bridge portion 130, as shown in FIGS. 20-26 for example.

Optionally, a single release member may be used to adjust each lock unit. For example, the release member 270 may be usable to concurrently lock and/or unlock the lock units with each pair of combined track elements. Accordingly, as exemplified, a single release member 270 may be used to concurrently unlock each of the first locks.

As used herein, the wording "and/or" is intended to represent an inclusive—or. That is, "X and/or Y" is intended to mean X or Y or both, for example. As a further example, "X, Y, and/or Z" is intended to mean X or Y or Z or any combination thereof.

While the above description describes features of example embodiments, it will be appreciated that some features and/or functions of the described embodiments are susceptible to modification without departing from the spirit and principles of operation of the described embodiments. For example, the various characteristics which are described by means of the represented embodiments or examples may be selectively combined with each other. Accordingly, what has been described above is intended to be illustrative of the claimed concept and non-limiting. It will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

The invention claimed is:

1. A transfer apparatus comprising:

a) a wheelchair comprising a chair seat translatable on a wheelchair track section of a wheelchair base, wherein the wheelchair track section extends in a longitudinal direction between a first section end and a second section end;

b) a chair support member positionable in a base of a washing enclosure, the chair support member having a chair support track section;

c) a bridge portion having a bridge track section that extends in a longitudinal direction between a third section end and a fourth section end, wherein the bridge portion is rotatably mounted to the chair support member for movement between a detached position and an in-use position, wherein in the in-use position the bridge portion is engaged with the wheelchair, the second section end is aligned with the third section end and the bridge track section is aligned with the chair support track section, whereby the chair seat is translatable from the wheelchair base along the bridge track section to the chair support track section when the bridge portion is in the in-use position and engaged with the wheelchair; and d) a first lock that is adjustable between a locked position and an unlocked position, the first lock comprising a retractable locking member provided on the bridge portion and operable between an extended position and a retracted position, a receiving recess provided on the wheelchair and shaped to receive the retractable locking member, and a biasing member that biases the retractable locking member to the extended position, wherein when the bridge portion is in the in-use position and engaged with the wheelchair and the first lock is in the locked position, the retractable locking member is positioned in the extended position and positioned in the recess whereby the first lock inhibits rotational motion of the bridge portion to the detached position.

2. The transfer apparatus of claim 1, wherein when the bridge portion is moved to the in-use position and engaged with the wheelchair, the first lock is automatically adjusted to the locked position whereby the rotational motion of the bridge portion is automatically inhibited.

3. The transfer apparatus of claim 1, wherein a) when the retractable locking member is in the retracted position the retractable locking member is moved relative to the extended position in the longitudinal direction towards the fourth section end; and b) as the bridge portion is moved from the detached position to the in-use position, the retractable locking member initially engages the wheelchair and is driven from the extended position towards the retracted position by engagement with the wheelchair, and subsequently upon the retractable locking member aligning with the receiving recess, the biasing member automatically extends the retractable locking member into the receiving recess.

4. The transfer apparatus of claim 1, wherein a) the retractable locking member is movably mounted to the bridge track section for movement in the longitudinal direction between the extended position and the retracted position.

5. The transfer apparatus of claim 4, further comprising a mounting unit that movably mounts the retractable locking member to the bridge track section, wherein the mounting unit comprises:

a) a mounting slot that extends in the longitudinal direction;

b) a support member that is received within the mounting slot;

wherein the mounting slot defines a longitudinal translation path for the support member, and the support member moves along the longitudinal translation path as the retractable locking member moves between the extended position and the retracted position.

6. The transfer apparatus of claim 5, wherein:

a) the mounting unit further comprises a housing;

b) the slot is defined by the housing;

c) the support member is fixed to the bridge track section; and d) the biasing member is enclosed within the housing and biased against the support member thereby biasing the retractable locking member to the extended position.

7. The transfer apparatus of claim 1, further comprising a second lock, the second lock comprising a first engagement member provided on the wheelchair and a second engagement member provided on the bridge portion, wherein the first and second engagement members are lockingly engageable when the bridge portion is in the in-use position wherein, when the first and second engagement members are lockingly engaged, the first and second engagement members inhibit separation of the bridge portion and the wheelchair in the longitudinal direction.

8. The transfer apparatus of claim 7, wherein:

a) the first engagement member comprises a slot; and b) the second engagement member comprises a second locking member that is rotatably receivable in the slot.

9. The transfer apparatus of claim 7, further comprising a release member operable to adjust the lock from the locked position to the unlocked position, wherein the release member is manually operated.

10. The transfer apparatus of claim 9, wherein:

a) the release member is operable to transition the retractable locking member from the extended position to the retracted position; and b) when the retractable locking member is in the retracted position, the release member is operable to move the bridge portion to the detached position.

11. The transfer apparatus of claim 1, further comprising a release member that is rotationally drivingly connected to the retractable locking member, the release member is rotatable between a locked position in which the retractable locking member is in the extended position and an unlocked position in which the retractable locking member is in the retracted position, wherein the release member is manually operated.

12. The transfer apparatus of claim 11, wherein the release member comprises a handle usable to move the bridge portion between the detached position and the in-use position.

13. The transfer apparatus of claim 7, wherein a) the wheelchair track section comprises first and second parallel wheelchair track elements;

b) the bridge track section comprises first and second parallel bridge track elements, wherein the first parallel bridge track element aligns with the first parallel wheelchair track element and defines a first pair of combined track elements and the second parallel bridge track element aligns with the second parallel wheelchair track element and defines a second pair of combined track elements;

c) wherein the first lock comprises a first lock unit that is configured to secure the first pair of combined track elements, and d) a second lock unit that is configured to secure the second pair of combined track elements.

14. The transfer apparatus of claim 13, further comprising a release member that is operable to concurrently unlock the first lock unit and the second lock unit.

15. A transfer apparatus for a chair seat of a wheelchair, the transfer apparatus comprising:

a) a wheelchair comprising a chair seat translatable on a wheelchair track section of a wheelchair base, wherein the wheelchair track section extends in a longitudinal direction between a first section end and a second section end;

b) a chair support member positionable in a base of a washing enclosure, the chair support member having a chair support track section;

c) a bridge portion having a bridge track section that extends in a longitudinal direction between a third section end and a fourth section end, wherein the bridge portion is rotatably mounted to the chair support member for movement between a detached position and an in-use position, wherein in the in-use position the bridge portion is engaged with the wheelchair, the second section end is aligned with the third section end and the bridge track section is aligned with the chair support track section, whereby the chair seat is translatable from the wheelchair base along the bridge track section to the chair support track section when the bridge portion is in the in-use position and engaged with the wheelchair;

d) a first lock that is adjustable between a locked position and an unlocked position, wherein, in the locked position, the first lock inhibits rotational motion of the bridge portion to the detached position; and, e) a second lock that is adjustable between a locked position and an unlocked position, wherein, in the locked position, the second lock inhibits separation of the bridge portion and the wheelchair in the longitudinal direction.

16. The transfer apparatus of claim 15, wherein when the bridge portion is moved to the in-use position and engaged with the wheelchair, the first lock is automatically adjusted to the locked position and the second lock is automatically adjusted to the locked position, whereby the bridge portion is secured to the wheelchair.

17. The transfer apparatus of claim 15, wherein the first lock comprises:

a) a retractable locking member provided on the bridge portion and operable between an extended position and a retracted position;

b) a receiving recess provided on the wheelchair, wherein the receiving recess is shaped to receive the retractable locking member; and wherein when the bridge portion is in the in-use position and engaged with the wheelchair and the first lock is in the locked position, the retractable locking member is positioned in the extended position and positioned in the recess whereby the first lock inhibits rotational motion of the bridge portion to the detached position.

18. The transfer apparatus of claim 17, wherein the first lock comprises a biasing member that biases the retractable locking member to the extended position.

19. The transfer apparatus of claim 18, wherein:

a) when the retractable locking member is in the retracted position the retractable locking member is moved relative to the extended position in the longitudinal direction towards the fourth section end; and b) as the bridge portion is moved from the detached position to the in-use position, the retractable locking member initially engages the wheelchair and is driven from the extended position towards the retracted position by engagement with the wheelchair, and subsequently upon the retractable locking member aligning with the receiving recess, the biasing member automatically extends the retractable locking member into the receiving recess.

20. The transfer apparatus of claim 17, wherein a) the retractable locking member is movably mounted to the bridge track section for movement in the longitudinal direction between the extended position and the retracted position.

21. The transfer apparatus of claim 15, wherein:

a) the second lock comprises a first engagement member provided on the wheelchair and a second engagement member provided on the bridge portion, wherein the first and second engagement members are lockingly engageable when the bridge portion is in the in-use position wherein, when the first and second engagement members are lockingly engaged, the first and second engagement members inhibit separation of the bridge portion and the wheelchair in the longitudinal direction.

22. The transfer apparatus of claim 21, wherein:

a) the first engagement member comprises a slot; and b) the second engagement member comprises a second locking member that is rotatably receivable in the slot.

23. The transfer apparatus of claim 15, further comprising a release member operable to adjust the first lock from the locked position to the unlocked position, wherein the release member is manually operated.

24. The transfer apparatus of claim 17, wherein:

a) the release member is operable to transition the retractable locking member from the extended position to the retracted position; and b) when the retractable locking member is in the retracted position, the release member is operable to move the bridge portion to the detached position.

25. The transfer apparatus of claim 17, further comprising a release member that is rotationally drivingly connected to the retractable locking member, the release member is rotatable between a locked position in which the retractable locking member is in the extended position and an unlocked position in which the retractable locking member is in the retracted position, wherein the release member is manually operated.

26. The transfer apparatus of claim 25, wherein the release member comprises a handle usable to move the bridge portion between the detached position and the in-use position.

* * * * *